US012171289B2

(12) United States Patent
Lotti

(10) Patent No.: US 12,171,289 B2
(45) Date of Patent: Dec. 24, 2024

(54) CASES FOR STORING LASH EXTENSIONS AND METHODS FOR USE AND MANUFACTURE THEREOF

(71) Applicant: Lashify, Inc., North Hollywood, CA (US)

(72) Inventor: Sahara Lotti, North Hollywood, CA (US)

(73) Assignee: Lashify, Inc., North Hollywood, CA (US)

( * ) Notice: Subject to any disclaimer, the term of this patent is extended or adjusted under 35 U.S.C. 154(b) by 0 days.

(21) Appl. No.: 18/118,627

(22) Filed: Mar. 7, 2023

(65) Prior Publication Data

US 2023/0218030 A1 Jul. 13, 2023

Related U.S. Application Data

(63) Continuation of application No. 16/644,948, filed as application No. PCT/US2019/057104 on Oct. 19, 2019, now Pat. No. 11,647,802.

(60) Provisional application No. 62/748,335, filed on Oct. 19, 2018.

(51) Int. Cl.

| | |
|---|---|
| ***A45C 11/00*** | (2006.01) |
| ***A41G 5/02*** | (2006.01) |
| *B65D 85/00* | (2006.01) |

(52) U.S. Cl.
CPC ..... *A41G 5/02* (2013.01); *A45C 11/008* (2013.01); *B65D 85/00* (2013.01)

(58) Field of Classification Search
CPC ..... A41G 5/02; A45D 2200/05; A45C 11/008
See application file for complete search history.

(56) References Cited

U.S. PATENT DOCUMENTS

| | | | |
|---|---|---|---|
| 783,924 | A | 2/1905 | Boeehm |
| 834,683 | A | 10/1906 | Severin |
| 994,619 | A | 6/1911 | Taylor |
| 1,021,063 | A | 3/1912 | Miller |
| 1,450,259 | A | 4/1923 | Charles |
| 1,657,497 | A | 1/1928 | Cichon |
| 1,831,801 | A | 11/1931 | Birk |
| 1,897,747 | A | 2/1933 | Birk |
| 1,920,401 | A | 8/1933 | Kahn |

(Continued)

FOREIGN PATENT DOCUMENTS

| | | | |
|---|---|---|---|
| CA | 216492 | A | 3/1922 |
| CA | 2904764 | A1 | 9/2014 |

(Continued)

OTHER PUBLICATIONS

Machine Translation of Nedelec. Available Oct. 2007.*

(Continued)

*Primary Examiner* — Rachel R Steitz
*Assistant Examiner* — Brianne E Kalach
(74) *Attorney, Agent, or Firm* — Lowenstein Sandler LLP

(57) ABSTRACT

A case for storing artificial lash extensions includes a body having a first outer sidewall having first curved surface, and first storage slots extending inward from the first curved surface of the first outer sidewall. Each of the first storage slots includes a first floor that extends inward from the first curved surface. The case includes a gasket configured to releasably hold the artificial lash extensions in the first plurality of storage slots.

30 Claims, 29 Drawing Sheets

(56) References Cited

U.S. PATENT DOCUMENTS

| | | | |
|---|---|---|---|
| 1,987,931 | A | 1/1935 | Jacob |
| 2,004,046 | A | 6/1935 | Glaser et al. |
| 2,013,011 | A | 9/1935 | Sheldon |
| D101,791 | S | 11/1936 | Rauh |
| 2,079,256 | A | 5/1937 | Kaiser |
| D129,526 | S | 9/1941 | Hanisch |
| 2,268,082 | A | 12/1941 | Festus, Sr. |
| 2,323,595 | A | 7/1943 | Hanisch |
| 2,392,694 | A | 1/1946 | Rector |
| 2,421,432 | A | 6/1947 | Phillips |
| D154,227 | S | 6/1949 | Alvizua |
| D155,559 | S | 10/1949 | Tillmann |
| 2,618,279 | A | 11/1952 | Reiffert |
| 2,630,516 | A | 3/1953 | Rausch et al. |
| 2,812,768 | A | 11/1957 | Giuliano |
| D189,888 | S | 3/1961 | Tapper |
| 3,016,059 | A | 1/1962 | Hutton |
| 3,032,042 | A | 5/1962 | Borg |
| 3,032,342 | A | 5/1962 | Glass |
| 3,174,321 | A | 3/1965 | Williams |
| 3,175,232 | A | 3/1965 | Stowell |
| 3,245,416 | A | 4/1966 | Victor |
| 3,266,500 | A | 8/1966 | Weld |
| 3,295,534 | A | 1/1967 | Jess |
| 3,306,139 | A | 2/1967 | Brackett |
| 3,315,689 | A | 4/1967 | Mehron |
| 3,339,561 | A | 9/1967 | Brickner |
| 3,343,552 | A | 9/1967 | Steffen |
| D210,180 | S | 2/1968 | Nathan |
| 3,392,727 | A | 7/1968 | Hanlon |
| D213,239 | S | 1/1969 | Flewwellin |
| 3,447,540 | A | 6/1969 | Osher |
| 3,454,015 | A | 7/1969 | Udes |
| 3,461,886 | A | 8/1969 | Bau |
| D215,985 | S | 11/1969 | Victor |
| 3,478,754 | A | 11/1969 | Martin, Jr. |
| 3,491,775 | A | 1/1970 | Aylott |
| 3,516,423 | A | 6/1970 | Seidler |
| 3,547,135 | A | 12/1970 | Roos |
| 3,557,653 | A | 1/1971 | Kim |
| D219,854 | S | 2/1971 | Pearl |
| 3,561,454 | A | 2/1971 | O'connell |
| D222,518 | S | 10/1971 | Brittain |
| 3,625,229 | A | 12/1971 | Silson |
| 3,645,281 | A | 2/1972 | Seidler |
| 3,670,742 | A | 6/1972 | Weaner |
| 3,703,180 | A | 11/1972 | Aylott |
| 3,818,784 | A | 6/1974 | Mc |
| 3,828,803 | A | 8/1974 | Windsor |
| 3,833,007 | A | 9/1974 | Jacobs |
| 3,900,038 | A | 8/1975 | Masters |
| D240,769 | S | 7/1976 | Bowman |
| 3,968,807 | A | 7/1976 | Kraicer |
| 3,970,092 | A | 7/1976 | Nelson |
| 3,970,992 | A | 7/1976 | Boothroyd et al. |
| 3,971,392 | A | 7/1976 | Brehmer |
| 3,980,092 | A | 9/1976 | Garufi |
| 3,982,313 | A | 9/1976 | Nelson, Jr. |
| 4,016,889 | A | 4/1977 | Cowles |
| 4,018,336 | A | 4/1977 | Aylott |
| 4,029,111 | A | 6/1977 | Barton |
| 4,049,006 | A | 9/1977 | Saunders et al. |
| 4,163,535 | A | 8/1979 | Austin |
| 4,168,713 | A | 9/1979 | Agiotis |
| 4,203,518 | A | 5/1980 | Current |
| 4,205,693 | A | 6/1980 | Mallouf |
| 4,225,693 | A | 9/1980 | McCormick |
| 4,254,772 | A | 3/1981 | McNamee |
| 4,254,784 | A | 3/1981 | Nelson |
| 4,284,092 | A | 8/1981 | Auretta |
| 4,296,765 | A | 10/1981 | Bachtell |
| D261,601 | S | 11/1981 | Kettlestrings |
| 4,299,242 | A | 11/1981 | Choe |
| 4,360,033 | A | 11/1982 | Schmehling |
| D269,820 | S | 7/1983 | Bisson |
| 4,395,824 | A | 8/1983 | Puro |
| D270,551 | S | 9/1983 | Thayer |
| 4,458,701 | A | 7/1984 | Holland |
| 4,509,539 | A | 4/1985 | Alfieri |
| D280,354 | S | 8/1985 | Bakic |
| D281,259 | S | 11/1985 | Hensley |
| D281,825 | S | 12/1985 | Bakic |
| 4,600,029 | A | 7/1986 | Ueberschaar |
| 4,697,856 | A | 10/1987 | Abraham |
| 4,739,777 | A | 4/1988 | Nelson |
| 4,761,028 | A | 8/1988 | Dulebohn |
| 4,767,492 | A | 8/1988 | Fukusima et al. |
| D298,070 | S | 10/1988 | Ferrari |
| 4,784,713 | A | 11/1988 | Van Nieulande |
| D299,561 | S | 1/1989 | Bakic |
| D301,371 | S | 5/1989 | Kaprelian |
| D302,602 | S | 8/1989 | Bakic |
| 4,865,057 | A | 9/1989 | Braun |
| 4,934,387 | A | 6/1990 | Megna |
| 4,964,428 | A | 10/1990 | Lamatrice |
| D314,066 | S | 1/1991 | Bakic |
| 5,003,467 | A | 3/1991 | Donaldson et al. |
| 5,010,914 | A | 4/1991 | Merges |
| D318,346 | S | 7/1991 | Bakic |
| 5,033,626 | A | 7/1991 | Platti |
| 5,072,745 | A | 12/1991 | Cheh |
| 5,082,010 | A | 1/1992 | Skaryd et al. |
| 5,117,846 | A | 6/1992 | Finamore et al. |
| D328,246 | S | 7/1992 | Nottingham |
| 5,154,195 | A | 10/1992 | Irisawa |
| D342,671 | S | 12/1993 | Elliott |
| D343,340 | S | 1/1994 | Frye, Jr. |
| 5,307,826 | A | 5/1994 | Iosilevich |
| D348,219 | S | 6/1994 | Goldberg |
| 5,322,166 | A | 6/1994 | Crowther |
| 5,368,052 | A | 11/1994 | Finamore |
| 5,377,700 | A | 1/1995 | Harris |
| D358,312 | S | 5/1995 | Keenan |
| D358,908 | S | 5/1995 | Rawski |
| 5,411,775 | A | 5/1995 | Wilson |
| 5,419,345 | A | 5/1995 | Kadymir |
| D359,583 | S | 6/1995 | Abbo |
| D368,495 | S | 4/1996 | Rypinski |
| 5,533,529 | A | 7/1996 | Ohno |
| 5,547,529 | A | 8/1996 | Woolf |
| D373,726 | S | 9/1996 | Power |
| 5,571,543 | A | 11/1996 | Song |
| D379,923 | S | 6/1997 | De Baschmakoff |
| D380,616 | S | 7/1997 | Leslie |
| D382,198 | S | 8/1997 | Mulhauser |
| D386,808 | S | 11/1997 | Litton |
| D387,483 | S | 12/1997 | Sloan |
| D388,549 | S | 12/1997 | Mouyiaris |
| 5,746,232 | A | 5/1998 | Martin et al. |
| 5,765,571 | A | 6/1998 | Dinnel |
| D397,040 | S | 8/1998 | Bakic |
| 5,813,418 | A | 9/1998 | Pillars |
| D403,922 | S | 1/1999 | Terracciano |
| D404,531 | S | 1/1999 | Bakic |
| 5,894,846 | A | 4/1999 | Gang |
| 5,896,996 | A | 4/1999 | Chuang |
| D411,649 | S | 6/1999 | Bakic |
| 5,944,028 | A | 8/1999 | Gebhard |
| D418,018 | S | 12/1999 | Winsted |
| D418,253 | S | 12/1999 | Bakic |
| 6,003,467 | A | 12/1999 | Shelton-Ferrell |
| 6,016,814 | A | 1/2000 | Elliott |
| 6,019,107 | A | 2/2000 | Overmyer et al. |
| 6,029,674 | A | 2/2000 | Han |
| 6,032,609 | A | 3/2000 | Luoma |
| 6,035,861 | A | 3/2000 | Copello |
| 6,092,291 | A | 7/2000 | Cendoma |
| 6,109,274 | A | 8/2000 | Ingersoll |
| D437,086 | S | 1/2001 | Dickert |
| 6,174,321 | B1 | 1/2001 | Webb |
| 6,182,839 | B1 | 2/2001 | Robbins |
| D442,304 | S | 5/2001 | Huang |
| 6,230,715 | B1 | 5/2001 | Cho |
| D443,471 | S | 6/2001 | Lillelund |

(56) References Cited

U.S. PATENT DOCUMENTS

| | | | |
|---|---|---|---|
| 6,247,476 | B1 | 6/2001 | Sartena |
| 6,257,250 | B1 | 7/2001 | Sartena |
| 6,265,010 | B1 | 7/2001 | Franco |
| D448,927 | S | 10/2001 | Vazquez |
| 6,302,115 | B1 | 10/2001 | Sartena |
| 6,308,716 | B1 | 10/2001 | Han |
| D452,151 | S | 12/2001 | Scott |
| 6,325,071 | B1 | 12/2001 | Butcher |
| D454,981 | S | 3/2002 | Lamagna |
| D456,077 | S | 4/2002 | Etter |
| D456,097 | S | 4/2002 | Lamagna |
| D458,413 | S | 6/2002 | Boilen |
| 6,405,736 | B2 | 6/2002 | Townsend |
| 6,439,406 | B1 | 8/2002 | Duhon |
| D463,280 | S | 9/2002 | Brozell |
| D463,744 | S | 10/2002 | Brozell |
| D464,565 | S | 10/2002 | Weinstein |
| D464,877 | S | 10/2002 | Weinstein |
| 6,471,515 | B2 | 10/2002 | Feuer |
| D467,800 | S | 12/2002 | Chen |
| 6,494,212 | B1 | 12/2002 | Yamakoshi |
| 6,530,379 | B2 | 3/2003 | Iosilevich |
| D472,675 | S | 4/2003 | Lamagna |
| D472,810 | S | 4/2003 | Gelardi |
| D473,106 | S | 4/2003 | Scherer |
| 6,561,197 | B2 | 5/2003 | Harrison |
| 6,567,640 | B2 | 5/2003 | Ishikawa |
| D475,616 | S | 6/2003 | Lambrecht |
| 6,581,609 | B2 | 6/2003 | Ott |
| D479,365 | S | 9/2003 | Todeschini |
| D480,864 | S | 10/2003 | Sayers |
| D481,946 | S | 11/2003 | Nicholson |
| D481,952 | S | 11/2003 | Orsomando |
| D482,495 | S | 11/2003 | Jackel-Marken |
| D482,928 | S | 12/2003 | Liu |
| D482,934 | S | 12/2003 | Liu |
| D483,232 | S | 12/2003 | Liu |
| D483,633 | S | 12/2003 | Jansson |
| D483,909 | S | 12/2003 | Todeschini |
| D485,359 | S | 1/2004 | McMichael |
| 6,688,315 | B1 | 2/2004 | Harrison |
| 6,691,714 | B1 | 2/2004 | Yaguchi et al. |
| 6,708,696 | B2 | 3/2004 | Ferguson |
| D488,353 | S | 4/2004 | Govrik |
| D488,618 | S | 4/2004 | Wekstein |
| D490,932 | S | 6/2004 | Mammone |
| D491,336 | S | 6/2004 | Cecere |
| D495,834 | S | 9/2004 | Todeschini |
| D496,759 | S | 9/2004 | Rodriguez |
| 6,789,551 | B2 | 9/2004 | Iosilevich |
| 6,820,625 | B2 | 11/2004 | Park |
| D501,580 | S | 2/2005 | Sugawara |
| D506,573 | S | 6/2005 | de Grandcourt |
| D507,678 | S | 7/2005 | Lamagna |
| 6,935,348 | B2 | 8/2005 | Gold |
| 6,935,349 | B2 | 8/2005 | Nicot et al. |
| D509,942 | S | 9/2005 | Connolly |
| D512,913 | S | 12/2005 | Gauthier |
| 6,973,931 | B1 | 12/2005 | King |
| 6,981,814 | B2 | 1/2006 | Geardino |
| D515,242 | S | 2/2006 | Cho |
| D515,742 | S | 2/2006 | Anderson et al. |
| D516,247 | S | 2/2006 | Merheje |
| 7,000,775 | B2 | 2/2006 | Gelardi |
| 7,036,518 | B2 | 5/2006 | Park |
| D522,376 | S | 6/2006 | Hales |
| 7,128,213 | B2 | 10/2006 | Tung |
| D532,891 | S | 11/2006 | Buthier |
| D533,650 | S | 12/2006 | Ohta |
| 7,147,127 | B2 | 12/2006 | Lepke |
| D534,426 | S | 1/2007 | Bakic |
| 7,159,720 | B2 | 1/2007 | Pearson |
| 7,168,432 | B1 | 1/2007 | Brumfield |
| D537,208 | S | 2/2007 | Shaljian |
| D540,112 | S | 4/2007 | Nichols |
| D543,662 | S | 5/2007 | Bivona |
| D543,663 | S | 5/2007 | Bivona et al. |
| D543,815 | S | 6/2007 | Metcalf |
| D543,850 | S | 6/2007 | Legros |
| D544,148 | S | 6/2007 | Bivona |
| D544,202 | S | 6/2007 | Markfelder |
| D545,396 | S | 6/2007 | Casey |
| 7,228,863 | B2 | 6/2007 | Dumler |
| D546,002 | S | 7/2007 | Bowen |
| D547,940 | S | 8/2007 | Sandy |
| D559,457 | S | 1/2008 | Garland et al. |
| D561,045 | S | 2/2008 | Lee |
| D561,357 | S | 2/2008 | Leclercq |
| D561,942 | S | 2/2008 | Khubani |
| 7,331,351 | B1 | 2/2008 | Asai |
| D563,157 | S | 3/2008 | Bouveret |
| D563,616 | S | 3/2008 | Lynde |
| D563,728 | S | 3/2008 | Welch, III |
| 7,343,921 | B2 | 3/2008 | Salinas |
| D569,041 | S | 5/2008 | Azoulay |
| D569,553 | S | 5/2008 | Cho |
| 7,374,048 | B2 | 5/2008 | Mazurek |
| D571,543 | S | 6/2008 | Sungadi |
| D573,306 | S | 7/2008 | Yoo |
| D573,308 | S | 7/2008 | Wittke-Kothe |
| D575,904 | S | 8/2008 | Iqbal |
| D579,059 | S | 10/2008 | Chan |
| 7,469,701 | B1 | 12/2008 | Bernard |
| D584,449 | S | 1/2009 | Shaljian |
| D587,529 | S | 3/2009 | Pratt |
| D588,746 | S | 3/2009 | Ross |
| 7,501,178 | B2 | 3/2009 | Sato |
| D591,599 | S | 5/2009 | Okin |
| D592,917 | S | 5/2009 | Jalet et al. |
| D592,923 | S | 5/2009 | Konopka |
| 7,533,676 | B2 | 5/2009 | Sthair |
| D595,054 | S | 6/2009 | Whitaker |
| 7,543,718 | B2 | 6/2009 | Simon |
| D600,441 | S | 9/2009 | Estrada |
| D602,354 | S | 10/2009 | Dibnah |
| 7,600,519 | B2 | 10/2009 | Dinh |
| D604,579 | S | 11/2009 | Robinson |
| 7,610,921 | B2 | 11/2009 | Gold |
| D605,514 | S | 12/2009 | Weber |
| 7,637,265 | B2 | 12/2009 | Funatsu et al. |
| D607,332 | S | 1/2010 | Huntington |
| D615,290 | S | 5/2010 | Heffner |
| D617,187 | S | 6/2010 | Murray |
| D617,943 | S | 6/2010 | Bouix |
| D618,078 | S | 6/2010 | Cripps |
| 7,748,391 | B2 | 7/2010 | Vance |
| D627,103 | S | 11/2010 | Cho |
| 7,836,899 | B2 | 11/2010 | Sugai et al. |
| D631,606 | S | 1/2011 | Chen |
| 7,896,192 | B2 | 3/2011 | Conley |
| D636,127 | S | 4/2011 | Allison et al. |
| D638,733 | S | 5/2011 | Sullivan |
| 7,938,128 | B2 | 5/2011 | Gueret |
| D639,196 | S | 6/2011 | Sullivan |
| D640,005 | S | 6/2011 | Lee |
| D640,834 | S | 6/2011 | Chen |
| D641,106 | S | 7/2011 | Williams et al. |
| 8,015,980 | B2 | 9/2011 | Rabe et al. |
| 8,025,065 | B2 | 9/2011 | Guliker |
| 8,042,553 | B2 | 10/2011 | Paris |
| D647,799 | S | 11/2011 | Dunwoody |
| 8,061,367 | B2 | 11/2011 | Rabe et al. |
| D650,669 | S | 12/2011 | Dunwoody |
| D650,670 | S | 12/2011 | Dunwoody |
| D651,082 | S | 12/2011 | Dunwoody |
| 8,113,218 | B2 | 2/2012 | Nguyen |
| 8,127,774 | B2 | 3/2012 | Dinh |
| D657,496 | S | 4/2012 | Flatt |
| D657,696 | S | 4/2012 | Floyd |
| D659,330 | S | 5/2012 | Davis |
| 8,171,943 | B2 | 5/2012 | Hamano |
| 8,186,361 | B2 | 5/2012 | Hampton |
| D661,185 | S | 6/2012 | Battat |
| D661,599 | S | 6/2012 | Floyd |

(56) References Cited

U.S. PATENT DOCUMENTS

| | | | |
|---|---|---|---|
| 8,191,556 | B2 | 6/2012 | Betts |
| 8,196,591 | B2 | 6/2012 | Lee |
| 8,205,761 | B2 | 6/2012 | Stull, Sr. |
| D663,113 | S | 7/2012 | Simms |
| D664,011 | S | 7/2012 | Affonso |
| 8,225,800 | B2 | 7/2012 | Byrne |
| D669,223 | S | 10/2012 | Lee |
| D670,030 | S | 10/2012 | Nguyen |
| D673,325 | S | 12/2012 | Martines |
| 8,342,186 | B2 | 1/2013 | Freelove |
| 8,347,896 | B2 | 1/2013 | Liao |
| D679,590 | S | 4/2013 | Stull, Sr. |
| D679,591 | S | 4/2013 | Stull, Sr. |
| D679,592 | S | 4/2013 | Stull, Sr. |
| D679,595 | S | 4/2013 | Stull, Sr. |
| D679,596 | S | 4/2013 | Stull, Sr. |
| D682,103 | S | 5/2013 | Jedlicka |
| D682,688 | S | 5/2013 | Murray |
| 8,434,500 | B2 | 5/2013 | Alex |
| D686,495 | S | 7/2013 | Murray |
| D690,419 | S | 9/2013 | Porat |
| 8,528,571 | B2 | 9/2013 | Costa |
| 8,567,640 | B1 | 10/2013 | Johnson-Lofton |
| 8,578,946 | B2 | 11/2013 | Ellery |
| 8,590,543 | B2 | 11/2013 | Goff et al. |
| 8,596,284 | B2 | 12/2013 | Byrne |
| 8,616,223 | B2 | 12/2013 | Rabe et al. |
| D698,078 | S | 1/2014 | Purizhansky |
| 8,657,170 | B2 | 2/2014 | Martinez |
| D700,799 | S | 3/2014 | Ludeman |
| 8,672,377 | B2 | 3/2014 | Ina |
| D702,510 | S | 4/2014 | Segal |
| 8,701,685 | B2 | 4/2014 | Chipman |
| D707,392 | S | 6/2014 | Yu |
| D707,556 | S | 6/2014 | Kawamura |
| 8,739,803 | B2 | 6/2014 | Freelove |
| 8,752,562 | B2 | 6/2014 | Dinh |
| D709,129 | S | 7/2014 | Moertl |
| D711,227 | S | 8/2014 | Sheikh |
| D713,217 | S | 9/2014 | Micara-Sartori |
| D714,494 | S | 9/2014 | Vasquez |
| 8,826,919 | B2 | 9/2014 | Dinh |
| D716,498 | S | 10/2014 | Wolff |
| D717,038 | S | 11/2014 | Lee |
| D717,536 | S | 11/2014 | Gupta |
| D718,498 | S | 11/2014 | Gu |
| 8,875,718 | B2 | 11/2014 | Dinh |
| 8,881,741 | B1 | 11/2014 | Mattson |
| 8,881,744 | B2 | 11/2014 | Mckinstry |
| D718,901 | S | 12/2014 | Parker |
| 8,939,159 | B2 | 1/2015 | Yeo |
| 8,967,158 | B2 | 3/2015 | Sanbonmatsu |
| 9,004,076 | B2 | 4/2015 | Le |
| 9,004,299 | B2 | 4/2015 | Hardin |
| 9,027,568 | B2 | 5/2015 | Lee |
| 9,044,076 | B2 | 6/2015 | Temple |
| 9,078,480 | B2 | 7/2015 | Beschta |
| 9,107,461 | B2 | 8/2015 | Martins et al. |
| D738,579 | S | 9/2015 | Owens |
| D738,611 | S | 9/2015 | Gupta |
| 9,149,083 | B1 | 10/2015 | Dinh |
| 9,155,345 | B2 | 10/2015 | Nisim et al. |
| 9,179,722 | B2 | 11/2015 | Le |
| 9,185,943 | B2 | 11/2015 | Merszei |
| D746,046 | S | 12/2015 | Lee |
| D746,514 | S | 12/2015 | Lambridis |
| 9,215,901 | B1 | 12/2015 | Schroeder |
| 9,254,012 | B2 | 2/2016 | Pham |
| D751,904 | S | 3/2016 | Landrum |
| 9,277,777 | B2 | 3/2016 | Lee |
| 9,284,111 | B2 | 3/2016 | Huang |
| D753,455 | S | 4/2016 | Hyma |
| D753,881 | S | 4/2016 | Hussain |
| 9,314,085 | B2 | 4/2016 | Hatch |
| D755,577 | S | 5/2016 | Segal |
| D757,274 | S | 5/2016 | Gelb |
| D758,009 | S | 5/2016 | Berkos |
| 9,339,072 | B2 | 5/2016 | Kenna |
| 9,351,752 | B2 | 5/2016 | Slavin |
| D761,489 | S | 7/2016 | Krakovszki |
| D762,433 | S | 8/2016 | Yang |
| D764,688 | S | 8/2016 | Robinson |
| D765,909 | S | 9/2016 | Marchica |
| 9,433,421 | B2 | 9/2016 | Ueno et al. |
| 9,439,465 | B2 | 9/2016 | Ott |
| 9,451,800 | B2 | 9/2016 | Dinh |
| 9,456,646 | B2 | 10/2016 | Calina |
| 9,462,837 | B2 | 10/2016 | Ngo |
| 9,468,245 | B2 | 10/2016 | Woods |
| D771,318 | S | 11/2016 | Taff |
| 9,486,025 | B1 | 11/2016 | Dinh |
| 9,504,285 | B2 | 11/2016 | Lin |
| D773,915 | S | 12/2016 | Barakat |
| D775,270 | S | 12/2016 | Moffat |
| 9,516,908 | B2 | 12/2016 | Miyatake et al. |
| 9,565,883 | B2 | 2/2017 | Dinh |
| D780,994 | S | 3/2017 | Hardwick |
| 9,596,898 | B2 | 3/2017 | Seawright |
| D783,899 | S | 4/2017 | Roh |
| D783,901 | S | 4/2017 | Kim |
| D784,615 | S | 4/2017 | Choi |
| 9,622,527 | B2 | 4/2017 | Nguyen |
| D788,556 | S | 6/2017 | James |
| 9,730,481 | B2 | 8/2017 | Uresti |
| D796,582 | S | 9/2017 | Beard |
| D800,966 | S | 10/2017 | Silva |
| 9,815,655 | B2 | 11/2017 | Crapet et al. |
| D805,135 | S | 12/2017 | Beard |
| D806,315 | S | 12/2017 | Hardwick |
| 9,833,028 | B2 | 12/2017 | Jang et al. |
| 9,848,661 | B2 | 12/2017 | Harris et al. |
| 9,848,662 | B2 | 12/2017 | Dinh |
| D810,534 | S | 2/2018 | Liu |
| D810,543 | S | 2/2018 | Astradsson |
| D811,872 | S | 3/2018 | Wu |
| D812,303 | S | 3/2018 | Pascullo |
| D814,107 | S | 3/2018 | Lotti |
| D814,260 | S | 4/2018 | Dhubb |
| 9,930,919 | B1 | 4/2018 | Branker et al. |
| 9,946,169 | B2 | 4/2018 | Endo |
| D817,132 | S | 5/2018 | Yang |
| D819,891 | S | 6/2018 | Kenig et al. |
| 9,993,373 | B2 | 6/2018 | Nassif |
| D823,538 | S | 7/2018 | Ruggaber |
| D823,683 | S | 7/2018 | Caldwell |
| D825,333 | S | 8/2018 | Ozamiz |
| D826,019 | S | 8/2018 | Keehner |
| D828,013 | S | 9/2018 | van Wijngaarden |
| D828,014 | S | 9/2018 | van Wijngaarden |
| D828,629 | S | 9/2018 | Hussain |
| D829,381 | S | 9/2018 | Kim |
| D830,170 | S | 10/2018 | Holmes |
| D832,701 | S | 11/2018 | Oates |
| D832,702 | S | 11/2018 | Oates |
| D835,465 | S | 12/2018 | Son |
| D836,432 | S | 12/2018 | Riedel |
| 10,149,528 | B2 | 12/2018 | Erickson |
| D836,943 | S | 1/2019 | Klieman |
| D837,653 | S | 1/2019 | Meranus |
| D840,104 | S | 2/2019 | Hussain et al. |
| 10,264,837 | B2 | 4/2019 | Park |
| D847,631 | S | 5/2019 | Villbrandt |
| D847,632 | S | 5/2019 | Villbrandt |
| D848,795 | S | 5/2019 | Butler |
| D850,715 | S | 6/2019 | Lotti |
| D852,412 | S | 6/2019 | Grund |
| 10,362,823 | B1 | 7/2019 | Hill |
| D862,796 | S | 10/2019 | Jin Kim |
| D863,419 | S | 10/2019 | Oguma |
| D863,679 | S | 10/2019 | Lotti |
| 10,433,607 | B2 | 10/2019 | Ahn |
| D867,664 | S | 11/2019 | Lotti |
| D867,668 | S | 11/2019 | Lotti |
| 10,479,566 | B2 | 11/2019 | Doyle |

(56) References Cited

U.S. PATENT DOCUMENTS

D871,673 S 12/2019 Qureshi
10,532,861 B2 1/2020 Kimmel
D877,416 S 3/2020 Lotti
D884,273 S 5/2020 Liu
10,638,826 B2 5/2020 Lotti
10,660,388 B2 5/2020 Lotti
D887,664 S 6/2020 Liao et al.
D890,430 S 7/2020 Lotti
10,721,984 B2 7/2020 Lotti
D895,201 S 9/2020 Lotti
D895,958 S 9/2020 Guo
10,791,782 B2 10/2020 Nakamura et al.
10,892,048 B2 1/2021 Reddy
D909,680 S 2/2021 Hussain et al.
D914,965 S 3/2021 Lotti
D917,153 S 4/2021 Denei
D918,475 S 5/2021 Hu
D920,400 S 5/2021 Saito
D920,465 S 5/2021 Bould
D926,372 S 7/2021 Liang
D930,788 S 9/2021 Roth
D932,101 S 9/2021 Davis
D937,482 S 11/2021 Kim
11,172,749 B2 11/2021 Lotti
11,219,260 B2 1/2022 Lotti
11,234,472 B2 2/2022 Lotti
11,253,020 B2 2/2022 Lotti
D952,258 S 5/2022 Lotti
11,330,855 B2 5/2022 Lotti
11,330,856 B2 5/2022 Lotti
D955,635 S 6/2022 Lotti
D955,645 S 6/2022 Lotti
D961,845 S 8/2022 Wang
11,432,608 B2 9/2022 Lotti
11,446,017 B2 9/2022 Klassen et al.
11,466,182 B2 10/2022 Lotti
D971,505 S 11/2022 Lotti
D971,506 S 11/2022 Lotti
D972,218 S 12/2022 Liu
D980,521 S 3/2023 Lotti
D984,050 S 4/2023 Lotti
D987,891 S 5/2023 Lotti
D995,914 S 8/2023 Lotti
D1,006,319 S 11/2023 Lotti
D1,008,558 S 12/2023 Liu
11,832,710 B2 12/2023 Lotti
D1,013,277 S 1/2024 Lotti
2001/0023699 A1 9/2001 Matthews
2001/0035192 A1 11/2001 Townsend
2001/0037813 A1 11/2001 Ra
2002/0056465 A1 5/2002 Shin
2002/0094507 A1 7/2002 Feuer
2002/0103421 A1 8/2002 Putrino et al.
2002/0114657 A1 8/2002 Gueret
2002/0127514 A1 9/2002 Dietrich
2002/0198597 A1 12/2002 Godfrey
2003/0005941 A1 1/2003 Iosilevich
2003/0111467 A1 6/2003 Norman
2003/0155317 A1 8/2003 McNeeley
2003/0226571 A1 12/2003 Rahman
2004/0011371 A1 1/2004 Harrison
2004/0011372 A1 1/2004 Park
2004/0051327 A1 3/2004 Yoon
2004/0079382 A1 4/2004 Profitt-Campbell
2004/0168696 A1 9/2004 Cox
2004/0173233 A1 9/2004 Tokko
2004/0211436 A1 10/2004 Knight
2005/0061341 A1 3/2005 Choe
2005/0098190 A1 5/2005 Kim
2005/0098191 A1 5/2005 Frazier
2005/0115581 A1 6/2005 Choi
2005/0166939 A1 8/2005 Stroud
2005/0194015 A1 9/2005 Watts
2005/0247326 A1 11/2005 Park
2005/0252517 A1 11/2005 Salinas
2005/0252518 A1 11/2005 Salinas
2006/0028040 A1 2/2006 Cohen et al.
2006/0065280 A1 3/2006 Cheung
2006/0065281 A1 3/2006 Kim
2006/0081267 A1 4/2006 Kuptiz
2006/0096609 A1 5/2006 Nwokola
2006/0124658 A1 6/2006 Coe
2006/0129187 A1 6/2006 Cho
2006/0142693 A1 6/2006 Kahen
2006/0175853 A1 8/2006 Anderson et al.
2006/0180168 A1 8/2006 Dinnel
2006/0180171 A1 8/2006 Kim
2006/0266376 A1 11/2006 Basso
2007/0023062 A1 2/2007 McKinstry et al.
2007/0050207 A1 3/2007 Merszei
2007/0084749 A1 4/2007 Demelo
2007/0157941 A1 7/2007 Awad et al.
2007/0157944 A1 7/2007 Catron et al.
2007/0172264 A1 7/2007 An
2007/0199571 A1 8/2007 McCulloch
2007/0221240 A1 9/2007 Junsuh
2007/0227550 A1 10/2007 Merszei
2007/0272263 A1 11/2007 Gold
2007/0272264 A1 11/2007 Byrne
2007/0295353 A1 12/2007 Dinh
2008/0017210 A1 1/2008 Eaton
2008/0196732 A1 8/2008 Merszei
2008/0223390 A1 9/2008 Brown
2008/0276949 A1 11/2008 Lee
2008/0283072 A1 11/2008 Sun
2009/0014023 A1 1/2009 Waters
2009/0026676 A1 1/2009 Kurita et al.
2009/0028625 A1 1/2009 Bonneyrat
2009/0071490 A1 3/2009 Sthair
2009/0071492 A1 3/2009 Oh
2009/0178689 A1 7/2009 Navarro et al.
2009/0217936 A1 9/2009 Sato et al.
2009/0217939 A1 9/2009 Rabe
2009/0223534 A1 9/2009 Green
2009/0241973 A1 10/2009 Hampton
2009/0241979 A1 10/2009 Navarro et al.
2009/0255547 A1 10/2009 Starks et al.
2009/0266373 A1 10/2009 Kupitz
2009/0266376 A1 10/2009 Beschta
2010/0043816 A1 2/2010 Dix
2010/0065078 A1 3/2010 Reece
2010/0070526 A1 3/2010 Matias
2010/0127228 A1 5/2010 Xie
2010/0170526 A1 7/2010 Nguyen
2011/0079233 A1 4/2011 Cheh
2011/0079235 A1 4/2011 Reed
2011/0079236 A1 4/2011 Lee
2011/0121592 A1 5/2011 Cho
2011/0127228 A1 6/2011 Sagel
2011/0220136 A1 9/2011 Kang
2011/0226274 A1 9/2011 Turner
2011/0240049 A1 10/2011 Kim et al.
2011/0278869 A1 11/2011 Lee
2011/0290271 A1 12/2011 Rabe
2011/0290937 A1 12/2011 Salkeld
2012/0009002 A1 1/2012 Lo et al.
2012/0037177 A1 2/2012 Teater
2012/0055499 A1 3/2012 Sanbonmatsu
2012/0160258 A1 6/2012 Cruz et al.
2012/0160259 A1 6/2012 Nguyen et al.
2012/0174939 A1 7/2012 Starks et al.
2012/0180804 A1 7/2012 Hochi et al.
2012/0266903 A1 10/2012 Devlin
2012/0305020 A1 12/2012 Byrne
2012/0318290 A1 12/2012 Kim
2013/0019889 A1 1/2013 Palmer-Rogers
2013/0032162 A1 2/2013 Major
2013/0042881 A1 2/2013 Mutchler
2013/0042884 A1 2/2013 Wilkinson
2013/0110032 A1 5/2013 Luzon
2013/0152960 A1 6/2013 Pays et al.
2013/0160783 A1 6/2013 Ahn et al.
2013/0167855 A1 7/2013 Kupitz
2013/0167858 A1 7/2013 Lee

(56) References Cited

U.S. PATENT DOCUMENTS

| | | | |
|---|---|---|---|
| 2013/0213431 | A1 | 8/2013 | Geva et al. |
| 2013/0255706 | A1 | 10/2013 | Dinh |
| 2013/0276807 | A1 | 10/2013 | Teater |
| 2013/0298931 | A1 | 11/2013 | Samain |
| 2013/0306089 | A1 | 11/2013 | Araujo |
| 2013/0306094 | A1 | 11/2013 | West |
| 2013/0312781 | A1 | 11/2013 | Murphy |
| 2013/0312782 | A1 | 11/2013 | Kindall |
| 2013/0320025 | A1 | 12/2013 | Mazzetta |
| 2013/0333714 | A1 | 12/2013 | Merszei |
| 2014/0011372 | A1 | 1/2014 | Kato et al. |
| 2014/0060559 | A1 | 3/2014 | Lin |
| 2014/0069451 | A1 | 3/2014 | Hwang |
| 2014/0083447 | A1 | 3/2014 | Rabe et al. |
| 2014/0110304 | A1 | 4/2014 | Wu |
| 2014/0116456 | A1 | 5/2014 | Palmer-Rogers |
| 2014/0135914 | A1 | 5/2014 | Conant |
| 2014/0216488 | A1 | 8/2014 | Dinh |
| 2014/0332025 | A1 | 11/2014 | Kim et al. |
| 2015/0020840 | A1 | 1/2015 | Rabe et al. |
| 2015/0075549 | A1 | 3/2015 | Lee et al. |
| 2015/0114421 | A1 | 4/2015 | Pham |
| 2015/0114422 | A1 | 4/2015 | Abraham et al. |
| 2015/0114423 | A1 | 4/2015 | Sanbonmatsu |
| 2015/0128986 | A1 | 5/2015 | Stookey |
| 2015/0136162 | A1 | 5/2015 | Brouillet |
| 2015/0173442 | A1 | 6/2015 | Raouf |
| 2015/0181967 | A1 | 7/2015 | Dinh |
| 2015/0181968 | A1 | 7/2015 | Uresti |
| 2015/0201691 | A1 | 7/2015 | Palmer-Rogers |
| 2015/0201692 | A1 | 7/2015 | Hansen et al. |
| 2015/0216246 | A1 | 8/2015 | Ahn |
| 2015/0230884 | A1 | 8/2015 | McDonald et al. |
| 2015/0351467 | A1 | 12/2015 | Simoes |
| 2016/0016702 | A1 | 1/2016 | Siskindovich |
| 2016/0037847 | A1 | 2/2016 | Tavakoli |
| 2016/0037848 | A1 | 2/2016 | Lee |
| 2016/0050996 | A1 | 2/2016 | Kwon |
| 2016/0058088 | A1 | 3/2016 | Le |
| 2016/0088889 | A1 | 3/2016 | Kettavong |
| 2016/0135531 | A1 | 5/2016 | Ezechukwu |
| 2016/0166039 | A1 | 6/2016 | Luu |
| 2016/0174645 | A1 | 6/2016 | Goldner |
| 2016/0192724 | A1 | 7/2016 | Scott et al. |
| 2016/0192725 | A1 | 7/2016 | Merszei |
| 2016/0206031 | A1 | 7/2016 | Stoka |
| 2016/0219959 | A1 | 8/2016 | Chipman |
| 2016/0286881 | A1 | 10/2016 | Ko |
| 2016/0324241 | A2 | 11/2016 | Lee |
| 2016/0324242 | A1 | 11/2016 | Hansen |
| 2016/0345648 | A1 | 12/2016 | Miniello |
| 2016/0353821 | A1 | 12/2016 | Calina |
| 2016/0353861 | A1 | 12/2016 | Carey |
| 2017/0000204 | A1 | 1/2017 | Wibowo |
| 2017/0006947 | A1 | 1/2017 | Uresti |
| 2017/0020219 | A1 | 1/2017 | Beschta |
| 2017/0049172 | A1 | 2/2017 | Ahn |
| 2017/0049173 | A1 | 2/2017 | Dinh |
| 2017/0055615 | A1 | 3/2017 | Crocilla |
| 2017/0079356 | A1 | 3/2017 | Dinh |
| 2017/0079357 | A1 | 3/2017 | Dinh |
| 2017/0079358 | A1 | 3/2017 | Dinh |
| 2017/0112214 | A1 | 4/2017 | Ahn |
| 2017/0112215 | A1 | 4/2017 | Dinh |
| 2017/0112264 | A1 | 4/2017 | Park |
| 2017/0127743 | A1 | 5/2017 | Nakamura et al. |
| 2017/0150763 | A1 | 6/2017 | Schroeder |
| 2017/0208885 | A1 | 7/2017 | Alex |
| 2017/0231309 | A1 | 8/2017 | Han |
| 2017/0258163 | A1 | 9/2017 | Uresti |
| 2017/0265550 | A1 | 9/2017 | Han et al. |
| 2017/0311667 | A1 | 11/2017 | Passariello et al. |
| 2017/0340041 | A1 | 11/2017 | Nguyen |
| 2017/0347731 | A1 | 12/2017 | Chipman et al. |
| 2017/0358245 | A1 | 12/2017 | Dana |
| 2017/0360134 | A1 | 12/2017 | Crocilla |
| 2017/0360135 | A1 | 12/2017 | Ahn |
| 2017/0360136 | A1 | 12/2017 | Ferrier et al. |
| 2018/0065779 | A1 | 3/2018 | Chiba |
| 2018/0098591 | A1 | 4/2018 | Leeflang |
| 2018/0160755 | A1 | 6/2018 | Hansen |
| 2018/0235299 | A1 | 8/2018 | Stoka |
| 2018/0242671 | A1 | 8/2018 | Merszei |
| 2018/0242672 | A1 | 8/2018 | Lotti |
| 2018/0242715 | A1 | 8/2018 | Lotti |
| 2018/0352885 | A1 | 12/2018 | Kim |
| 2018/0352886 | A1 | 12/2018 | Schroeder |
| 2019/0133227 | A1 | 5/2019 | Le |
| 2019/0191851 | A1 | 6/2019 | Esposito |
| 2019/0254373 | A1 | 8/2019 | Kim |
| 2019/0254374 | A1 | 8/2019 | Schroeder |
| 2019/0320772 | A1 | 10/2019 | Dudas |
| 2020/0093211 | A1 | 3/2020 | Lee |
| 2020/0196694 | A1 | 6/2020 | Lotti |
| 2020/0260839 | A1 | 8/2020 | Lotti |
| 2020/0315314 | A1 | 10/2020 | Hantani |
| 2020/0323324 | A1 | 10/2020 | Chang |
| 2020/0323325 | A1 | 10/2020 | Kim et al. |
| 2021/0030140 | A1 | 2/2021 | Chico |
| 2021/0337949 | A1 | 11/2021 | Ardin |
| 2022/0160094 | A1 | 5/2022 | Lyons et al. |

FOREIGN PATENT DOCUMENTS

| | | | |
|---|---|---|---|
| CN | 102355833 | A | 2/2012 |
| CN | 302315323 | | 2/2013 |
| CN | 102975141 | A | 3/2013 |
| CN | 103027410 | A | 4/2013 |
| CN | 103717108 | A | 4/2014 |
| CN | 103734961 | A | 4/2014 |
| CN | 203897379 | U | 10/2014 |
| CN | 303086463 | | 1/2015 |
| CN | 204191855 | U | 3/2015 |
| CN | 304049505 | S | 2/2017 |
| CN | 304049506 | S | 2/2017 |
| CN | 106983203 | A | 7/2017 |
| CN | 304310042 | S | 10/2017 |
| CN | 304329374 | S | 10/2017 |
| CN | 304329375 | S | 10/2017 |
| CN | 304382151 | S | 12/2017 |
| CN | 304452297 | | 1/2018 |
| CN | 304497372 | S | 2/2018 |
| CN | 207084233 | U | 3/2018 |
| CN | 304777737 | S | 8/2018 |
| CN | 304859863 | S | 10/2018 |
| CN | 304859864 | S | 10/2018 |
| CN | 305599881 | S | 2/2020 |
| CN | 305719777 | | 4/2020 |
| CN | 305729159 | S | 4/2020 |
| CN | 305738664 | | 4/2020 |
| CN | 111418982 | A | 7/2020 |
| CN | 305916370 | | 7/2020 |
| DE | 950232 | C | 10/1956 |
| EM | 006381257-0001 | | 4/2019 |
| EM | 006381257-0002 | | 4/2019 |
| EM | 006381257-0003 | | 4/2019 |
| EP | 1839526 | B1 | 7/2009 |
| EP | 006381257 | | 10/2014 |
| FR | 569600 | A | 4/1924 |
| FR | 1435971 | A | 4/1966 |
| FR | 1539430 | A | 9/1968 |
| FR | 2897760 | A1 | 8/2007 |
| FR | 1839526 | * | 10/2007 |
| GB | 190218723 | A | 11/1902 |
| GB | 102106 | A | 11/1916 |
| GB | 1021063 | A | 2/1966 |
| GB | 1042020 | * | 9/1966 |
| GB | 1263815 | A | 2/1972 |
| GB | 1272616 | A | 5/1972 |
| GB | 1307107 | A | 2/1973 |
| GB | 2369712 | B | 3/2004 |
| GB | 2450250 | A | 12/2008 |
| GB | 2458230 | A | 9/2009 |
| GB | 2458230 | B | 5/2010 |

(56) References Cited

FOREIGN PATENT DOCUMENTS

| | | | |
|---|---|---|---|
| GB | 2516622 | A | 2/2015 |
| GB | 6024289 | | 12/2017 |
| JP | S471395 | U | 8/1972 |
| JP | S4721880 | U | 11/1972 |
| JP | S484711 | U | 1/1973 |
| JP | S484711 | Y1 | 2/1973 |
| JP | S486937 | Y1 | 2/1973 |
| JP | 48007948 | B | 3/1973 |
| JP | S4833591 | U | 4/1973 |
| JP | S4993157 | A | 9/1974 |
| JP | S5383862 | A | 7/1978 |
| JP | 3101488 | U | 6/2004 |
| JP | 2007222271 | A | 9/2007 |
| JP | 2009040718 | A | 2/2009 |
| JP | 3155628 | U | 11/2009 |
| JP | 3157680 | U | 2/2010 |
| JP | 2010099141 | A | 5/2010 |
| JP | 2010137329 | A | 6/2010 |
| JP | 2011106066 | A | 6/2011 |
| JP | 2011122288 | A | 6/2011 |
| JP | 3170596 | U | 9/2011 |
| JP | 2011177395 | A | 9/2011 |
| JP | 3175232 | U | 4/2012 |
| JP | 2015105447 | A | 6/2015 |
| JP | 5823118 | B2 | 11/2015 |
| JP | 3201846 | U | 1/2016 |
| JP | 2016027220 | A | 2/2016 |
| JP | 2016510841 | A | 4/2016 |
| JP | 5955355 | B2 | 7/2016 |
| JP | 2016163699 | A | 9/2016 |
| JP | 2017012047 | A | 1/2017 |
| JP | 6130571 | B1 | 5/2017 |
| JP | 2018076626 | A | 5/2018 |
| JP | 2019044277 | A | 3/2019 |
| JP | 2019063975 | A | 4/2019 |
| JP | 2019094588 | A | 6/2019 |
| JP | 1671784 | S | 11/2020 |
| JP | 2021151399 | A | 9/2021 |
| KR | 200165452 | Y1 | 2/2000 |
| KR | 200171517 | Y1 | 3/2000 |
| KR | 200240234 | Y1 | 10/2001 |
| KR | 200260653 | Y1 | 1/2002 |
| KR | 20020065306 | A | 8/2002 |
| KR | 200350229 | Y1 | 5/2004 |
| KR | 100450341 | B1 | 10/2004 |
| KR | 200367525 | Y1 | 11/2004 |
| KR | 200369937 | Y1 | 12/2004 |
| KR | 200394275 | Y1 | 9/2005 |
| KR | 200395554 | Y1 | 9/2005 |
| KR | 20060010717 | A | 2/2006 |
| KR | 200439673 | Y1 | 4/2008 |
| KR | 20090010717 | A | 1/2009 |
| KR | 20090010717 | U | 10/2009 |
| KR | 20100112249 | A | 10/2010 |
| KR | 20110113819 | A | 10/2011 |
| KR | 101234507 | B1 | 2/2013 |
| KR | 20130082427 | A | 7/2013 |
| KR | 101336422 | B1 | 12/2013 |
| KR | 101392845 | B1 | 5/2014 |
| KR | 101396272 | B1 | 5/2014 |
| KR | 101509029 | B1 | 4/2015 |
| KR | 20150033455 | A | 4/2015 |
| KR | 101566166 | B1 | 11/2015 |
| KR | 20160090493 | A | 8/2016 |
| KR | 300906653 | | 5/2017 |
| KR | 101829167 | B1 | 2/2018 |
| KR | 20200127191 | A | 11/2020 |
| PL | 230008 | B1 | 9/2018 |
| RU | 2417719 | C1 | 5/2011 |
| RU | 2419364 | C2 | 5/2011 |
| RU | 2558482 | C1 | 8/2015 |
| RU | 156273 | U1 | 11/2015 |
| RU | 2576010 | C2 | 2/2016 |
| TW | M388245 | U | 9/2010 |
| TW | M430199 | U | 6/2012 |
| TW | M476490 | U | 4/2014 |
| TW | 201519805 | A | 6/2015 |
| TW | M541752 | U | 5/2017 |
| WO | 2007138289 | A1 | 12/2007 |
| WO | 2008140152 | A1 | 11/2008 |
| WO | 2009082098 | A2 | 7/2009 |
| WO | 2012026315 | A1 | 3/2012 |
| WO | 2014029935 | A1 | 2/2014 |
| WO | 2014139943 | A1 | 9/2014 |
| WO | 2014163364 | A1 | 10/2014 |
| WO | 2015116246 | A1 | 8/2015 |
| WO | 2015190845 | A1 | 12/2015 |
| WO | 2017086254 | A1 | 5/2017 |
| WO | 2018002914 | A1 | 1/2018 |
| WO | 2018022914 | A1 | 2/2018 |
| WO | 2018119034 | A1 | 6/2018 |
| WO | 2020082056 | A1 | 4/2020 |
| WO | 2020082058 | A1 | 4/2020 |

OTHER PUBLICATIONS

Office Action for European Patent Application No. 17884561.6, mailed Mar. 5, 2024, 6 Pages.

WEB: "Best Tweezers—Ergonomic Products," The Wayback Machine, Feb. 14, 2014, 2 pages, [Downloaded on Mar. 28, 2024] Retrieved from [URL: https://web.archive.org/web/20120214160346/ http://www.beauty2makeup.com:80/blog/best-tweezers/].

WEB: "Diamond Elite Tweezer—Main," Embellashes, Feb. 20, 2024, 3 pages, [Downloaded on Mar. 28, 2024] Retrieved from [URL: https://embellashes.com/product/diamond-elite-tweezer-2/].

WEB: "Eyelash Extensions Tweezer," Shine Beauty Group, Feb. 20, 2024, 6 pages, [Downloaded on Mar. 28, 2024] Retrieved from [URL: https://www.shinebeautygroup.com/eyelash-extension-products/p/diamond-elite-tweezers-1].

WEB: "ProComfort Ceramic Angled Lash Extensions Tweezer," Xtreme Lashes, Feb. 20, 2024, 3 pages, [Downloaded on Mar. 28, 2024] Retrieved from [URL: https://www.xtremelashes.com/tweezers-and-tools/procomfort-ceramic-angled-tweezer?selection=&gad_source=1&gclid=EAIaIQobChMI34KCotq4hA . . . ].

YOUTUBE: "Bella Lash Diamond Elite Tweezers," Jul. 11, 2016, 36 pages, [Downloaded on Mar. 28, 2024] Retrieved from [URL: https://www.youtube.com/watch?v=yWB4YR6CkYc].

YOUTUBE: "How to : Master Applying False Eyelashes," Jan. 23, 2014, 137 pages, [Downloaded on Mar. 28, 2024] Retrieved from [URL: https://www.youtube.com/watch?v=rtX7pZgiJe8].

YOUTUBE: "How to apply Cluster/Party Lashes 2," Feb. 12, 2014, 79 pages, [Downloaded on Mar. 28, 2024] Retrieved from [URL: https://www.youtube.com/watch?v=faKvACCAvNU].

YOUTUBE: "Introducing: ProComfort Ceramic Angled Tweezer," Aug. 29, 2014, 13 pages, [Downloaded on Mar. 28, 2024] Retrieved from [URL: https://www.youtube.com/watch?v=oAHGR_Y8mvk].

YOUTUBE: "Process of Making Mellow Eyelashes," Nov. 12, 2015, 60 pages, [Downloaded on Mar. 28, 2024] Retrieved from [URL: https://www.youtube.com/watch?v =-VlhGQX58HM].

Hongiun Web Page: Oct. 31, 2018, 16 Pages, Retrieved from URL:https://detail. 1686.com/offer/574685154963.html?spm=a2615.7691456.iewlist.75.22f96dc5Msy00t.

IENVY: "KISS-IENVY Collection," 2 Pages, [Retrieved on Dec. 30, 2020] Retrieved from URL: ienvybykiss.com.

Imagessentials: "How to Wear False Eyelashes Without Looking Like You're Wearing Them," 2012, 5 Pages, Retrieved from URL: https://imagessentials.wordpress.com/2012/03/30/how-to-wear-false-eyelashes-without-looking-like-youre-wearing-any/.

Influenster: "Kiss I-ENVY Eye Lash Adhesive (6g Individual, Clear) Reviews," 4 Pages, [Retrieved on Dec. 30, 2020] Retrieved from URL: https://www.influenster.com/reviews/kiss-i-envy-eye-lash-adhesive-6g-individual-clear.

Instagram: "Lashify Wand," 1 Page, [Retrieved on 2019] Retrieved from URL: https://www.instagram.com/p/BWgeQ8wg00SR/iqshid=zauiyw8a6v5.

International Search Report and Written Opinion for International Application No. PCT/US2017/044217, mailed Nov. 27, 2017, 15 Pages.

(56) References Cited

OTHER PUBLICATIONS

International Search Report and Written Opinion for International Application No. PCT/US2017/067513, mailed Mar. 12, 2018, 10 Pages.
International Search Report and Written Opinion for International Application No. PCT/US2019/057102, mailed Dec. 23, 2019, 12 Pages.
International Search Report and Written Opinion for International Application No. PCT/US2019/057104, mailed Dec. 19, 2019, 8 Pages.
International Search Report and Written Opinion for International Application No. PCT/US2020/013554, mailed May 7, 2020, 8 Pages.
International Search Report and Written Opinion for International Application No. PCT/US2020/013561, mailed May 7, 2020, 10 Pages.
International Search Report and Written Opinion for International Application No. PCT/US2020/054014, mailed Jan. 20, 2021, 11 Pages.
International Search Report and Written Opinion for International Application No. PCT/US2022/039083, mailed Oct. 31, 2022, 16 Pages.
International Search Report and Written Opinion for International Application No. PCT/US2022/045558, mailed Dec. 20, 2022, 15 Pages.
Japonesque False Eyelash Applicator, 1 Page.
JAPONESQUE: "False Lash Applicator," Feb. 13, 2019, 6 Pages, Retrieved from URL: https://japonesque.com/products/implements/false-lash-applicator/.
Kiss Nail Products Inc: Third Supplemental Objections and Responses to Lashify, Inc.'s First Set of Interrogatories (Nos. 1-56) Investigation No. 337-TA-1226, "In the Matter of Certain Artificial Eyelash Extension Systems, Products, and Components Thereof," Mar. 10, 2021, 430 Pages.
KISSUSA: "A True Lash Extension Look in Minutes Falscara the New Way to Lash," Feb. 5, 2021, 6 Pages, Retrieved from URL: https://www.kissusa.com/falscara-false-ayelash-extension-look.
KISSUSA: "DIY Lash Extensions By: KISS," May 20, 2021, 1 Page, [Retrieved on Apr. 7, 2023] Retrieved from URL: https://www.kissusa.com/kiss-falscara-eyelash-starter-kit-01.
KISSUSA: "Falscara Starter Kit," Dec. 15, 2021, 1 Page, [Retrieved on Apr. 7, 2023] Retrieved from URL: https://www.kissusa.com/lashes/kiss-falscara-eyelash-starter-kit-01.
KISSUSA: "Falsecara Eyelash By: KISS," Sep. 20, 2020, 5 Pages, [Retrieved on Apr. 17, 2021] Retrieved from URL: https://web.archive.org/web/20201126033616/https://www.kissusa.com/lashes/kiss-falscara-eyelash-starter-kit-01.
KISSUSA: "Kiss Falscara Eyelash-Bond Seal," 3 Pages, Retrieved from URL: https://www.kissusa.com/kiss-falscara-eyelash-bond-seal.
LADES: "Eyelashes Clip—2 Pieces False Eyelashes Applicator Tool Eyelash Extension Tweezers Remover Clip Nipper," Amazon, Aug. 2, 2017, 22 Pages, XP055720051, Retrieved from URL: https://www.amazon.co.uk/Eyelashes-Clip-Applicator-Extension-Tweezers/dp/B07PK6VBVW.
Lash Applicator By: Pro Lashbeauty (Dec. 14, 2023) https://www.amazon.com/dp/B0CB3ZZRTJ/ref=sspa_dk_detail_0psc=1&pd_rd_i=B0CB3ZZRTJ&pd_rd_w=v4LsUcontent-id=amzn1.sym.68f30e61-3dba-4ebe-8f1b-a0b000b95ff8&pf_rd_p=(May 3, 2023).
Lashaddict: "Kiss I-Envy by Kiss Premium Quattro 02 Lashes," 4 Pages, [Retrieved on Dec. 30, 2020] Retrieved from URL: https://www.lashaddict.nl/kiss-i-envy-lashes-quattro-02.html.
LASHIFY: "Fuse Control Wand V2, Lashify," Reviewed on Oct. 23, 2018 on Lashify.com, 1 Page, [Retrieved on Dec. 31, 2018] Retrieved from URL: https://lashify.com/collections/lashify-tools/products/fuse-control-wand-v2variant=13400696586351#shopify-product-reviewsretrieved.
LASHIFY: "Lashify Gossamer Lash Cartridge," Jun. 15, 2018, 2 Pages, Retrieved from URL: https://lashify.com/collections/shop-1/products/gossamer-eye-lozenge-c-style/variant=783670738950.
LASHIFY: "Violet Gossamer," Sep. 30, 2020, 7 Pages, Site Visited Feb. 17, 2021, Retrieved from URL: https://lashify.com/products/gossamer-lash-cartridge-prismatic-colors-violetvariant=20045369835631.
Lindstrom I., et al., "Occupational Asthma and Rhinitis Caused by Cyanoacrylate-based Eyelash Extension Glues," Occupational Medicine, Apr. 3, 2013, vol. 63, No. 4, pp. 294-297.
Loveyelashes: "Kiss I-Envy Premium Quattro 01 Lashes," 2 Pages, [Retrieved on Dec. 30, 2020] Retrieved from URL: https://www.loveyelashes.com/bfont-colorgreenstrip-lashesfontb-299-envy-by-kiss-quattro-01-(1555, 129, 1,48)p.html#.
MAC Cosmetics: "34 Lash," Feb. 14, 2019, 1 Page, Retrieved from URL: http://www.bornprettystore.com/false-eyelashes-thick-natural-simulation-recyclable-curly-false-eyelash-makeup-cosmetic-tools-p-44675.html.
MAC: "MAC Lash Applicator," 2014, 4 Pages, Retrieved From URL: https://www.maccosmetics.com/product/13811/32724/products/brushes-tools/tools/sponges-applicators/lash-applicator?gclid=EAlalQobChMlsqzhnlz79AIVHAalCROqngPWEAQYAyABEgKxP_D_BwE&gclsrc=aw.ds.
Madame Madeline: "Ardell Dual Lash Applicator (62059)," 3 Pages, [Retrieved on Oct. 18, 2018] Retrieved from URL: https://www.madamemadeline.com/online_shoppe/proddetail.asp?prod=mm62059.
Madame Madeline: "Kiss I-Envy Premium Quattro 01 Lashes (KPE62)," 2 Pages, [Retrieved on Dec. 30, 2020] Retrieved from URL: https://www.madamemadeline.com/online_shoppe/proddetail.asp?prod=mmKPE62.
Made in China: "New Product Eyelashes Aid Eyelashes Applicator Innovative Eyelashes Curler," 2018, 2 Pages, [Retrieved on Feb. 13, 2019], Retrieved from URL: https://www.made-in-china.com/productdirectory.do?word=creative+eyelashe-curler&subaction=hunt&style=b&mode=and&code=0&comProvince=nolimit&order=0&isOpenCoiTection=1.
MATWEB: "Overview Of Materials For Polybutylene Terephthalate (PBT), Unreinforced, Molded," [Retrieved on Mar. 29, 2023] 5 Pages, Retrieved from [URL: https://www.matweb.com/search/datasheet_print.aspx?matguid=781bd0e9d0854fd5a919866c39ea3065].
Modernbeauty: "Kiss I-Envy Individual Eye Lash Adhesive," 3 Pages, [Retrieved on Dec. 30, 2020] Retrieved from URL: https://www.modernbeauty.com/cosmetics/lashes/false-lashes/ Product/26961-i-envy-individual-eyelash-adhesive-retail.html.
Notter E., "The Art of the Chocolatier from Classic Confections to Sensational Showpieces," John Wiley &Sons, Jan. 18, 2011, 4 Pages.
Office Action for Australian Patent Application No. AU20190360273, mailed Nov. 13, 2023, 3 Pages.
Office Action for Australian Patent Application No. AU20220235619, mailed Nov. 14, 2023, 2 Pages.
Office Action for Canadian Patent Application No. CA3123630 mailed on Jan. 19, 2024, 7 Pages.
Office Action for Chinese Patent Application No. 202110550925.3, mailed Oct. 31, 2023, 24 Pages.
Office Action for European Patent Application No. 20190873364, mailed Sep. 19, 2023, 7 Pages.
Office Action for Indonesian Patent Application IDP00202205125 mailed Jan. 24, 2024, 3 pages.
Office action for Japanese Application No. 2019504850, dated Aug. 30, 2021, 8 Pages.
Office Action for Japanese Patent Application No. JP2023-014624, mailed Dec. 18, 2023, 7 Pages.
Pak Lajpall: "Nail Artist Tweezers PL-1," 1 Page, [Retrieved on Feb. 13, 2019], Retrieved from URL: http://www.laipall.com/proddetail.prod=nail-artists-tweezers1.
Palin G.R., "Plastics for Engineers: An Introductory Course," Chapter 13, Thermosetting Plastics, Elsevier, 1967, pp. 125-139.
Patent Trial and Appeal Board (PTAB), PGR2021-00045, *Kiss Nail Products Incorporated* (Petitioner) v. *Lashify Incorporated* (Patent Owner).
Patent Trial and Appeal Board (PTAB), PGR2021-00046, *Kiss Nail Product Incorporated* v. *Lashify Incorporated* (Patent Owner).

(56) References Cited

OTHER PUBLICATIONS

YOUTUBE: "How To Apply False Lashes . . . Underneath !?," Jan. 13, 2017, 66 Pages, Retrieved from URL: https://www.youtube.com/watch?v=mlkvFgb8PmA.
YOUTUBE: "How to Apply iENVY Quattro Collection Eyelashes," Aug. 18, 2015, 14 Pages, Retrieved from URL:https://www.youtube.com/watch?v=kW-ovlGoCmc.
YOUTUBE: "How To Apply Individual False Lashes—Lashes Love Leather," 2016, 24 Pages, Retrieved from URL: https://www.youtube.com/watch?v=nLMz-lauMkl.
YOUTUBE: "How to Apply Individual Lashes," Apr. 5, 2010, 77 Pages, Retrieved from URL: https://www.youtube.com/watch?v=9X84CUIWqgo.
YOUTUBE: "How to Apply Individual Lashes," Mar. 16, 2013, 77 Pages, Retrieved from URL: https://www.youtube.com/watch?v=aLHE2SqzlO8.
YOUTUBE: "How to Apply Lashes Using Sephora Bull Eye Lash Applicator," Nov. 14, 2012, 32 Pages, Retrieved from URL: https://www.youtube.com/watch?v=yYwcYzXJX4M.
YOUTUBE: "How To Fake Eyelash Extensions Reviewing Kiss Ever EZ Lashes," 2015, 40 Pages, Retrieved from URL: https://www.youtube.com/watch?v=AhJyTcClaMs.
YOUTUBE: "How To Master Individual Fake Eyelashes NewBeauty Tips Tutorials," Aug. 21, 2015, 56 Pages, Retrieved from URL: https://www.youtube.com/watch?v=ObltZN1NsB0&t=44s.
Youtube: "In Depth Tutorial Ardell Lashtite Glue Apply Under My Natural Lashes," Feb. 24, 2015, 40 Pages, Retrieved from URL: https://www.youtube.com/watch?v=comq0clt56o.
YOUTUBE: "Introducing Kiss EverEZ Trio Lashes," May 10, 2013, 47 Pages, Retrieved from URL: https://www.youtube.com/watch?v=37z4VMQ7Yxc.
Youtube: "Lisa Eldridge—How To Apply Individual False Eyelashes Tutorial," Youtube, Mar. 17, 2010, 45 Pages, Retrieved from URL: https://www.youtube.com/watch?v=lKO10VdtLFU.
YOUTUBE: "Solving the Oval Office Puzzle Box," Puzzle Master Incorporated, Published by PuzzleOZ, Jun. 4, 2017, 7 Pages, Site Vistied May 17, 2019, Retrieved from URL: https://www.youtube.com/watchv=wzZCm9sUU7E.
YouTube [online] [video], Sep. 17, 2014, https://www.youtube.com/watch?v=gfoGzBwvcnE.
YOUTUBE: "Process of Making False Eyelash Product," Lux Beauty Lashes, Dec. 12, 2015, 53 Pages, Retrieved from URL: https://www.youtube.com/ watchv=515QCxnjrkQ.
YOUTUBE: "Reverse Eyelash Hack: Does it work?," Oct. 12, 2016, 75 Pages, Retrieved from URL: https://www.youtube.com/watch?v=sx_X89xdBbE.
YOUTUBE: "Reverse Eyelash Trick Makeup Hack," Sep. 18, 2016, 55 Pages, Retrieved from URL: https://www.youtube.com/watch?/=FQFF1sOQbCI.
YOUTUBE: "Reverse Eyelash Tutorial—Irisbeilin," Sep. 13, 2016, 20 Pages, Retrieved from URL: https://www.youtube.com/watch/=q1Cu0p6bqHs.
YOUTUBE: "Review New Kiss I Envy EZ Lashes Trio Lashes—Easier Than Individual Lashes," Mar. 10, 2021, 47 Pages, Retrieved from URL: https://www.youtube.com/watch?v=BS9G6jgDgOA.
YOUTUBE: "The Best Way to Apply False Lashes," Cosmopolitan, Apr. 1, 2016, 4 Pages, Retrieved from URL: https://www.youtube.com/watch?/=40yZu-4KZs8.
YOUTUBE: "Trio Lashes Are So In Right Now | Ever EZ Lashes By KISS," Feb. 20, 2015, 43 Pages, Retrieved from URL: https://www.youtube.com/watch?v=bx6PXgZMvhg.
YOUTUBE: "Volume Tweezers," Jun. 11, 2014, 20 Pages, Retrieved from URL: https://www.youtube.com/watchv=vvbDF18x2h8.
Canadian Patent Application No. 3206108, Office Action dated Apr. 17, 2024.
Office Action for Canadian Patent Application No. 3123631, mailed Feb. 21, 2024, 6 Pages.
Office Action for Chinese Patent Application No. 202080069380.8, mailed Mar. 2, 2024, 15 Pages.
Office Action for Japanese Patent Application No. 2022121728, mailed Feb. 8, 2024, 2 Pages.
Office Action for Japanese Patent Application No. 2022520667, mailed Dec. 7, 2023, 2 Pages.
Office Action for Japanese Patent Application No. 2023112532, mailed Feb. 26, 2024, 1 Page.
Office Action for Singapore Application No. 10202106633V, mailed Feb. 27, 2024, 6 Pages.
Peonies and Lilies: "Bourjois 2 in 1 Tweezers and Faux Fabulous Eyelashes," Beauty, Lifestyle, Travel, Oct. 24, 2012, 2 Pages.
Picclick: "I-Envy By Kiss So WISPY #01 Strip Eyelashes KPE58 False Lashes Black 1 Pair New," Dec. 30, 2020, 8 Pages, Retrieved from URL: https://www.picclickimg.com/d/w1600/pict/292311410878_/i-ENVY-by-Kiss-SO-WISPY-01-Strip-Eyelashes.jpg.
Pinterest: "How to Apply iENVY Quattro Collection Eyelashes," Dec. 30, 2020, 14 Pages, [Retrieved on Mar. 31, 2023] Retrieved from URL: https://www.pinterest.com/pin/433472151413160 80/.
Pinterest: "Kiss Bring the Salon Home," 2 Pages, [Retrieved on Dec. 30, 2020] Retrieved from URL: https://www.pinterest.com.au/pin/19562579608263895/.
Pinterest: "Kiss I-Envy 100% Human Eyelash So Wispy 03," 3 Pages, [Retrieved on Dec. 30, 2020] Retrieved from URL: ;https://www.pinterest.co.kr/pin/308285536984155041/.
Pinterest: "Kiss I-Envy by Kiss 100% Human Pre Cut Eyelash Quattro 02 Lashes, " 2 Pages, [Retrieved on Dec. 30, 2020] Retrieved from URL: https://www.pinterest.cl/pin/576038608568497288/amp_client_id=CLIENT_ID(_J&mweb_unauth_id=&from_amp_pin_page=true.
Pinterest: "Kiss Premium Lashes, I-ENVY by KISS Premium Lashes," 2 Pages, [Retrieved on Dec. 30, 2020] Retrieved from URL: https://www.pinterest.es/amp/pin/449515606533816815/.
Qingdao Hongfutian Eyelash Co., Ltd., Youtube, Oct. 13, 2016, 21 Pages, Retrieved from URL: https://www.youtube.com/watch?v=rlnKgJJm7-0".
Rich., "Buzludzha Monument, Gueorguy Stoilov Circa," Justanotherbackpacker.com, Apr. 29, 2014, 10 Pages, Site Visited on Aug. 27, 2019, Retrieved from URL: http://www.justanotherbackpacker.com/buzludzha-monument-bulgaria-ufo/.
Rodulfo K., "This DIY Lash Extension Kit Has Ruined Mascara for Me Forever," ELLE, May 16, 2018, 6 Pages, [Retrieved on Dec. 31, 2018] Retrieved from URL: https://www.elle.com/beauty/makeup-skin-care/a20704236/lashify-lashes-kit-review/.
Rosato M.G., et al., "Basics and Overviews of Plastics Fabricating Processes," Springer Science & Business Media, New York, 2000, pp. 39-52.
Satkowski M.M., "The Crystallization and Morphology of Polyethylene and its Blends," Doctoral Dissertations 1896—Feb. 2014, Jan. 1, 1990, 4 Pages.
Search Report and Written Opinion for Singapore Application No. 10202106633V, dated Jan. 21, 2022, 13 Pages.
Shopee: "Tweezer Applicator for False Fake Eyelash Eye Lash Lashes Falsies Cosmetic Tool," Jul. 14, 2019, 1 Page, [Retrieved on Oct. 14, 2022] Retrieved from URL: https://shopee.ph/Tweezer-Applicator-For-False-Fake-Eyelash-Eye-Lash-Lashes-Falsies-Cosmetic-Tool-i.63392971.1750684108.
Shopee: "VETUS Tweezers, Anti Static Non-Magnetic, High Precision Stainless Steel Tweezer Tool," Aug. 10, 2021, 1 Page, [Retrieved on Oct. 14, 2022] Retrieved from URL: https://shopee.com.my/VETUS-Tweezers-Anti-Static-Non-Magnetic-High-Precision-Stainless-Steel-Tweezer-Tool-i. 183308257.783935374.
Siegmann A., et al., "Melting and Crystallization of Poly (Ethylene Terephthalate) under Pressure," Journal of Polymer Science: Polymer Physics Edition, 1980, vol. 18 (11), pp. 2181-2196.
Silmy's Eyelashes, Youtube, 2011, 11 Pages, Retrieved from URL: https://www.youtube.com/watch?v=I_rg1ybHUwY.
Staar Alert: "Locking Automated Medication Dispenser," Starralert.com, WayBack Machine, Staar Altelt, Aug. 14, 2020, 4 Pages, [Retrieved online on Feb. 19, 2021] Retrieved from URL: https://www.staaralert.com/locking-medication-dispenser.
"The Small Things, How to Fake a Thicker Lash Line," May 17, 2017, Retrieved from URL: https://www.thesmallthingsblog.com/2016/05/how-to-Fake-a-thicker-lash-lme/#:text=Pick%20up%20a%20gel%20orof%20a%20thicker%20lash%20lme.

(56) References Cited

OTHER PUBLICATIONS

The Sunday Girl: "Bourjois-2-in-1 Tweezers and False Eyelash Applicator Review," Nov. 5, 2012, 1 Page, [Retrieved on Apr. 13, 2021] Retrieved from URL: http://www.thesundaygirl.com/2012/11/bourjois-2-in-1-tweezers-and-false.html.
Troughton M.J., et al., "Handbook of Plastics Joining: A Practical Guide," 2nd Edition, William Andrew Incorporated, Oct. 17, 2008, 25 Pages.
Tweezers: "Eyelash Tweezers—FEITA Precision Eyelash Extension Tweezers Set—Professional Straight & Curved Pointed Very Fine Tip Tweezers for Lash Extensions—Black—2Pcs," Reviewed on Dec. 13, 2016 on Amazon.com, 30 Pages, [Retrieved on Dec. 31, 2018] Retrieved from URL: https://www.amazon.com/Eyelash-Tweezers-Precision-Extension-Professional/dp/B0112KSUDSth=1.
UBUY: "I-Envy by Kiss Premium Quattro 02 Lashes," Dec. 30, 2020, 3 Pages, Retrieved from URL: https://www.ubuy.com.kw/en-sa/catalog/product/view/id/37236.
United Beauty Supply: "Kiss I-Envy Trio Lashes Ultra Volume KPEC—3X Volume," 7 Pages, [Retrieved on Mar. 9, 2021] Retrieved from URL: https://www.unitedbeautysupply.com/product/kiss-i-envy-trio-lashes-ultra-/olume-kpec/.
United States District Court District of California San Francisco Division, 3:20-cv-06086, *Lashify Incorporated* v. *Alicia Zeng and Patrick Ellsworth d/b/a Lilac St; and Artemis Family Beginnings Incorporated*.
United States District Court District of New Jersey, 2:20-cv-10023-JMV-MF, *Lashify Incorporated* v. *Kiss Nail Products Incorporated*.
U.S.Salonsupply: "Kiss I-Envy Premium Quattro 01 Lashes," 2 Pages, [Retrieved on Dec. 30, 2020] Retrieved from URL: https://www.ussalonsupply.com/Kiss-I-Envy-Quattro-01-Lashes-p_120305.html.
Varga J., et al., "Vibration Welding of Alpha and Beta Isotactic Polypropylenes: Mechanical Properties and structure," Express Polymer Letters, Mar. 1, 2008, vol. 2, No. 3, pp. 5-19.
Versionone S., "Cruiser Portable Speaker," NYNE, Published at thegamerwithkids.com, Posted on Apr. 6, 2015, not listed, [Cite Visited Jun. 20, 2018], 3 Pages, Retrieved from URL: https://thegamerwithkids.com/2015/04/06/nyne-cruiser-review-a-wireless-speaker-for-your-bycicle/.
Walmart: "Kiss I-Envy by Kiss Premium Quattro 02 Lashes," 8 Pages, [Retrieved on Dec. 30, 2020] Retrieved from URL: https://www.walmart.com/ip/Kiss-I-Envy-Quattro-02- Lashes/187353459.
"Why Tightlining is the Makeup Trick you Need to Try," Get The Gloss, May 6, 2016, 6 Pages, Retrieved from URL: https://www.getthegloss.com/beauty/makeup/why-tightlining-is-the-makeup-trick-you-need-to-try.
YOUTUBE: "How To Apply False Lashes UNDER Your Lashes Reverse Eyelash Trick Makeup Hack," 2016, 40 Pages, Retrieved from URL: https://www.youtube.com/watch?v=BCq4xCQrQHE.
YOUTUBE: "How To Apply Individual Lashes ft. Ardell Individuals | Melissa Alatorre," 2015, 46 Pages, Retrieved from URL: https://www.youtube.com/watchv=c2iqLwjryWM.
YOUTUBE: "All About Eyelash Extensions! FAQ's Application FAQ'S SaturdayNightsAlrite," 2013, 175 Pages, Retrieved from URL: https://www.youtube.com/watch?v=MTL70W58191.
YOUTUBE: "Applying False Lashes Underneath Your Own Top Eye Lashes Best Beauty Tip/Hack Ever," Jul. 2, 2016, 46 Pages, Retrieved from URL: https://www.youtube.com/watch2v-FzEtZgY-5Y8.
YOUTUBE: "Applying Falsies Under Lash?! Does It Work?," Sep. 14, 2016, 57 Pages, Retrieved from URL: https://www.youtube.com/watch?v=V96EKKAe03c.
YOUTUBE: "Applying Falsies Under Lash Does It Work!!," Sep. 27, 2016, 57 Pages, Retrieved from URL: https://www.youtube.com/watch?v=5kytWJOQbg.
YOUTUBE: "Applying Falsies Underneath Lash," Sep. 24, 2016, 47 Pages, Retrieved from URL: https://www.youtube.com/watch?v=6VopJnVWv8st=13s.
YOUTUBE: "Applying Falsies Underneath Reverse Best Lash Hack," Sep. 22, 2016, 20 Pages, Retrieved from URL: https://www.youtube.com/watch?v=GhG5hoMh000.
YOUTUBE: "Artificial Eyelashes (1949)," Apr. 13, 2014, 87 Pages, Retrieved from URL: https://www.youtube.com/watch?v=8Fv7EzDvo58.
YOUTUBE: "Crazy False Eyelash Hack For Natural Comfortable Lashes," 2017, 31 Pages, Retrieved from URL: https://www.youtube.com/watch?v=99rHNYe3GFw.
YOUTUBE: "Deyeko—Olga Lydia Factory Visit," Jun. 24, 2013, 47 Pages, Retrieved from URL: https://www.youtube.com/watch?v=Q5ZLklqkEtY.
YOUTUBE: "Dream Lashes Curved Volume Tweezer—3 Minute Test," Sep. 30, 2016, 1.15-1.30, 1 Page [Downloaded on Feb. 13, 2019] Retrieved from URL: https://www.youtube.com/watch?v:vwqYeEOSD7s.
YOUTUBE: "False Lashes Tips And Tricks For Beginners, The How to Guide for Lashes," Jan. 27, 2017, 36 Pages, Retrieved from URL: https://www.youtubecom/watchv=BaQO8g4iUxY.
YOUTUBE: "Falsecara By: KISS," Jan. 2, 2021, 1 Page, [Retrieved on Nov. 14, 2023] Retrieved from [URL:https://www.kissusa.com/products/falscara-starter-kit-diy-lash-extensions].
YOUTUBE: "FalseLashes, Falscara By: KISS," Dec. 23, 2019, 1 Page, [Retrieved on Apr. 4, 2023] Retrieved from URL: https://www.youtube.com/watch?v=cQfRFdZa1zE.
YOUTUBE: "Goodyard Eyelash Production Process," Goodyardhair Factory, 2016, 57 Pages, Retrieved from URL: https://www.youtube.com/watch?v=FlxGtTPNALo.
YOUTUBE: "How False Eyelashes Are Made," Nov. 29, 2015, 69 Pages, Retrieved from URL: https://www.youtube.com/watch/=hqsxokthwqg.
YOUTUBE: "How to Apply Cluster Party Lashes 2," Feb. 12, 2014, 43 Pages, Retrieved from URL: https://www.youtube.com/watch?v=faKvACCAvNU.
YOUTUBE: "How To Apply False Eyelashes For Beginners Two Easy Ways," Sep. 6, 2013, 29 Pages, Retrieved from URL: https://www.youtube.com/watch?app=desktopv=790S17fNzOE.
ALLURE: "Lashify False Lashes Review," Published By Sable Yong, Oct. 10, 2018, 9 Pages, Site Visited Feb. 17, 2021, Retrieved from URL: https://www.allure.com/story/lashify-false-eyelashes-review-photos.
AMAZON: "6 Pieces Eyelash Packaging Cirle Box with Mirror, Eyelash Storage Box Empty Lash Case with Lash Holder for Women Girls (Rose Gold)," Maitys, Amazon.com, Jun. 23, 2020, 1996-2021, pp. 1-8, Site visited Oct. 25, 2021, Retrieved from URL: https://www.amazon.co.uk/piece-Eyelash-Packaging-Circle-Storage/dp/B08BNZ5GQQth=1.
AMAZON: "Alessi Yoyo Pill Box, Published by Michel Bouquillon," Nov. 20, 2018, 9 Pages, Site Visted Aug. 6, 2020, Retrieved from URL: https://www.amazon.com/Alessi-Stainless-Steel-Michel-Bouquillon/dp/B07KKFQNQ6.
AMAZON: "Eyelash Applicator Tool By: Lasnten," Mar. 2, 2022, 1 Page, [Retrieved on Nov. 14, 2023] Retrieved from [https://www.amazon.com/Lasnten-Applicator-Tweezers-Extensions-Stainless/dp/B0CG9DDLTN?th=1].
AMAZON: "KISS I-ENVY Premium Quattro 01 Lashes," 3 Pages, [Retrieved on Dec. 30, 2020] Retrieved from URL: https://www.amazon.ca/Kiss-ienvy-quattro-Makeup-Count/dp/B016SKJJKM.
AMAZON: "KISS I-ENVY Quattro 02 Lashes, Pack of 3," 5 Pages, [Retrieved on Dec. 30, 2020] Retrieved from URL: https://www.amazon.com/iEnvy-Kiss-Quattro-Lashes-Pack/dp/B01706J2FG.
AMAZON: "KISS I-ENVY Quattro Lashes 01, Pack of 3," 5 Pages, [Retrieved on Dec. 30, 2020] Retrieved from URL: https://www.amazon.com/iEnvy-Kiss-Quattro-Lashes-Pack/dp/B06XGBTCHW.
AMAZON: "KISS I-ENVY Trio Medium Lashes 30 Trio Lashes (2 Pack)," 7 Pages, [Retrieved on Mar. 9, 2021] Retrieved from URL: https://www.amazon.com/Kiss-Envy-Trio-Medium-Lashes/dp/B018JORMXU.
AMAZON: "KISS I-ENVY Ultra Black Trio Medium Lashes KPEC02UB (2 Pack), " 7 Pages, [Retrieved on Mar. 9, 2021] Retrieved from URL: https://www.amazon.com/Kiss-Envy-Ultra-Black-Medium/dp/B00W2C4HPS?th=1.

(56) References Cited

OTHER PUBLICATIONS

AMAZON: "Lashview Vetus Angled Pointed Perfect Craft Fine Angled Removal Stainless Steel Tip Curved Tweezers for Professional Grafting Eyelash Extension False Eyelash Nail Art Electionics Medical," By Lashview Vetus, Found on Amazon on Apr. 15, 2021, 1 Page, Retrieved from URL: https://www.amazon.com/dp/B01M4KQOCH/ref=sspa_dk_detail_0psc=1&pd_rd_i=Mar. 22, 2018.
AMAZON: "Leteveri Eyelash Applicator Tool—35mm Width False Eyelash Tool with Silicone Clip Design, 2PCS Eyelash Tweezers for False Lashes," Oct. 12, 2022, 1 Page, [Retrieved on Mar. 10, 2023] Retrieved from URL: https://www.amazon.com/Leteveri-Eyelash-Applicator-Tool-Silicone/dp/BOBM5QYC1F/ref=sr_1_3?crid=3SMPJ51ZRAT4N&keywords=.
AMAZON: "Ocamo False Eyelashes Curler Stainless Steel Extension Eye Lash Applicator Remover Tweezers Clip Makeup Tools," 3 Pages, [Retrieved on Oct. 10, 2018] Retrieved from URL: https://www.amazon.kin/Ocamo-Eyelashes-Stanless-Extension-Applicator/dp/B07FT5XW8C?ag=googinhydr18418-21&tag=googinkenshoo-21&ascsu.
AMAZON.COM: "Kiss Ever Ez Lahes 30 Count Trio Lashes in Various Lengths 57927: Beauty," 8 Pages, [Retrieved on Mar. 9, 2021] Retrieved from URL: https://www.amazon.com/kiss-Lahes-Lashes-Various-Lengths/dp/B00JH7SR4S.
AMMANCART: "KISS I-ENVY Premium Quattro 01 Lashes," 2 Pages, [Retrieved on Dec. 30, 2020] Retrieved from URL: https://www.ammancart.com/products/kiss-i-envy-premium-quattro-01-ashes-kpe62.
BEAUTYLICIOUS: "KISS I-ENVY Pre-Cut Lashes," 4 Pages, [Retrieved on Dec. 30, 2020] Retrieved from URL: https://www.shopbeautylicious.com/products/kiss-i-envy-pre-cut-lashes.
BEAUTYPRODUCSTUSA: "KISS I-ENVY Premium Quattro 01 Lashes," 2 Pages, [Retrieved on Dec. 30, 2020] Retrieved from URL: https://www.beautyproductsusa.com/home/322-kiss-i-envy-strip-eyelash- quattro-01-kpe62.html.
BICOASTAL BEAUTI: "KISS i-ENVY Premium Quattro 01 Lashes (KPE62)," 3 Pages, [Retrieved on Dec. 30, 2020] Retrieved from URL: https://www.bicoastalbeauti.com/shop/kiss-brand-lashes/kiss-i-envy-premium-quattro/.
BILOBEAUTY: "KISS I-ENVY Premium Quattro 01 Lashes," 2 Pages, [Retrieved on Dec. 30, 2020] Retrieved from URL: https://www.biloltd.net/product-p/60351.html.
BL LASHES: "Your Guide to Russian Volume Lash Extensions," 10 Pages, [Retrieved on Mar. 29, 2023] Retrieved from URL: https://www.bllashes.com/blogs/blog/your-guide-to-the-must-have-tools-for-russian-volume-lashes.
BORN PRETTY: "False Eyelashes Thick Natural Simulation Recyclable Curly False Eyelash Makeup Cosmetic Tools," 6 Pages, [Retrieved on Oct. 18, 2018] Retrieved from URL: http://www.bornprettystore.com/false-eyelashes-thick-natural-simulation-recyclable-curly-false-eyelash-makeup-cosmetic-tools-p-44675.
Brandrup J., et al., "Polymer Data Handbook," 1999, New York: Wiley, Edited by James E. Mark, vol. 89, 7 Pages.
BUYKOREA: "Plastic, False Eyelash Applicator, Multy colour," Tweed K Inc., pp. 1-3, [Retrieved on Feb. 14, 2019] Retrieved from URL: http://www.buykorea.or.kr/product-details/Plastic-False-Eyelash-Applicator-Multy-colour-3106709.html.
Cardellino C., "You've Been Applying False Eyelashes Wrong Your Whole Life," Cosmopolitan, Mar. 25, 2016, 12 Pages, [Retrieved on Aug. 23, 2019] Retrieved from URL: https://www.cosmopolitan.com/style-)eauty/beauty/how-to/a55781/this-false-eyelash-hack-will-change-your-life/.
CASHMERE COSMETICS: "KISS I-ENVY Premium Quattro 01 Lashes," 4 Pages, [Retrieved on Dec. 30, 2020] Retrieved from URL: https://www.cashmerecosmetics.com/product/kiss-i-envy-quattro-01-lashes/.
Delicate Hummingbird: "Ha! I've Mastered the False Lashes!," Nov. 10, 2011, 12 Pages, Retrieved from URL: http://delicatehummingbird.blogspot.com/2011/11/ha-ive-mastered-false-lashes.html.
EBAY: "KISS I-ENVY Strip Eyelashes—Pack of 2 (Choose Your Style)," 2 Pages, [Retrieved on Dec. 30, 2020] Retrieved from URL: https://www.ebay.com.au/itm/Kiss-I-Envy-Strip-Eyelashes-Pack-of-2-Choose-your-Style/1 83303124469.
EBAY: "BL Kiss I Envy Quattro 01 Lashes—Two Pack," 4 Pages, [Retrieved on Dec. 30, 2020] Retrieved from URL: https://www.ebay.ca/itm/BL-Kiss-I-Envy-Quattro-01-Lashes-Two-PACK-/293706028541.
EBAY: "lenvy," 23 Pages, [Retrieved on Dec. 30, 2020] Retrieved from URL: https://www.ebay.eom/sch/i.html_nkw=lenvy&norover=1&mkevt=1&mkrid=711-156598-701868-2&mkcid=2&keyword=ienvy&crip=435059434779.
EBAY: "Kiss Ever EZ Trio Lashes Medium Combo 30 EA 2pk," [Retrieved on Mar. 9, 2021] Retrieved from URL: https://www.ebay.com/urw/Kiss-Ever-EZ-Trio-Lashes-Medium-Dombo-30-EA-2pk/product-reviews/1117964400?pgn=2#.
EBAY: "KISS I-ENVY Premium Quattro 01 Lashes," 3 Pages, [Retrieved on Dec. 30, 2020] Retrieved from URL: https://www.ebay.eom/p/1044019861.
Ebnesajjad S., et al., "Classification of Adhesives and Compounds," Adhesives technology handbook, Nov. 26, 2014, pp. 67-83.
Electron Microscopy Sciences: "EMS High Precisions and Ultra Fine Tweezers," Feb. 13, 2019, 7 Pages, Retrieved from URL: https://www.emsdiasum.com/microscopy/products/tweezers/ultra_fine.aspx.
Extended European Search Report for European Application No. 17835287.8, mailed Feb. 11, 2020, 5 Pages.
Extended European Search Report for European Application No. 17884561.6, mailed Sep. 11, 2020, 8 Pages.
Extended European Search Report for European Application No. 19873364.4, mailed Jun. 15, 2022, 10 Pages.
Extended European Search Report for European Application No. 19874123.3, mailed Jun. 21, 2022, 8 Pages.
Extended European Search Report for European Application No. 20741513.4, mailed Oct. 21, 2022, 9 Pages.
Extended European Search Report for European Application No. 20741939.1, mailed Sep. 9, 2022, 8 Pages.
Extended European Search Report for European Application No. 21185294.2, mailed Oct. 11, 2021, 9 Pages.
Extended European Search Report for European Application No. 22211037.1, mailed Mar. 7, 2023, 6 Pages.
Eyelash applicator tool By Leteveri found on Amazon (Dec. 14, 2023), https://www.amazon.com/Leteveri-Eyelash-Applicator-Tool-Silicone/dp/BOBM5QYC1F/ref=sr_1_3crid=3SMPJ51ZRAT4N&keywords (Oct. 12, 2022).
FACEBOOK: "Avant Garde Beauty, Eyelash Holder," Aug. 12, 2020, 2 Pages, Eyelash Holder, Site Visited Oct. 5, 2022, Retrieved from URL: https://www.facebook.com/photo/fbid=162270508866790&set=a. 161502768943564.
FALSCARA BY: "The New Line of Kiss Lashes," KISS, 2021, 1 Page, Found online on [Apr. 7, 2023] Retrieved From URL: https://www.youtube.com/watch?v=cQfRFdZa1zE&t=2s.
FALSE EYELASHES: "False Eyelashes 101 Tip: How (and Why) to Layer False Eyelashes," May 2, 2012, 11 Pages, Retrieved from URL: https://elegantlashesblog.wordpress.com/2012/05/02/false-eyelashes-101-tip-how-and-why-to-layer-false-eyelashes/.
First Office Action for Chinese Application No. 201780004312.1, mailed May 7, 2020, 17 Pages.
First Office Action for Chinese Application No. 201780033755.3, mailed Aug. 28, 2020, 8 Pages.
FOCALLURE: "Eyelash Tweezer Applicator By ILash," Shopfocallure, Feb. 14, 2019, 1 Page, Retrieved from URL: https://shopfocallure.com/collections/eyelashes/products/eyelash-tweezer-by-focallure.
GLAD GIRL: "Glad Lash Flare Cluster Lash Application," Jan. 31, 2014, 49 Pages, Retrieved from URL: https://www.youtube.com/watch?v=JU_ZcY95nVo&t=23s.
HOLLYREN: "DIY Eyelash Extensions Superfine Band Cluster Lashes Kit," 3 Pages, [Retrieved on Feb. 5, 2021] Retrieved from URL: https://www.hollyren.com/DIY-Eyelash-Extensions-Superfine-Band-Cluster-Lashes-Kit_7740.html.

(56) References Cited

OTHER PUBLICATIONS

Hollyren: "OEM Eyelash Applicator By: Hollyren," Apr. 7, 2023, 1 Page, Retrieved from URL: https://www.hollyren.com/ProDetail/Oem%20eyelash%20applicator.
Eyelash Applicator Tool By: Lasnten found on Amazon (Jul. 10, 2024)https://www.amazon.com/Lasnten-Applicator-Tweezers-Extensions-Stainless/dp/B0CG9DDLTN?th=1 (Mar. 2, 2022).
False Lashes, FALSCARA By: KISS found on YouTube (Jul. 10, 2024) https://www.youtube.com/watch?v=cQfRFdZa1zE (Dec. 23, 2019).
Falsecara Eyelash By: KISS found on YouTube (Jul. 10, 2024)https://www.kissusa.com/products/falscara-starter-kit-diy-lash-extensions (Jan. 2, 2021).
Office Action for Japanese Patent Application No. 2023109314, mailed Jul. 4, 2024, 6 pages.
Office Action for Japanese Patent Application No. 2023149877, mailed Jul. 1, 2024, 10 pages.
Office Action for Korean Patent Application No. 10-2020-7012359, mailed Jun. 10, 2024, 13 Pages.
YOUTUBE: "Complete Master of Self Eyelash Extensions," YouTube [online] [video], Sep. 17, 2014, 3 Pages, [Retrieved on Mar. 26, 2021], Retrieved from [https://www.youtube.com/watch?v=gfoGzBwvcnE].
ADHESIVE: "Japonesque Sectional 4 Eyelashes," Sep. 26, 2024, 3 Pages, Retrieved from [https://www.amazon.com/JAPONESQUE-ZM-410-Sectional-4- Eyelashes/dp/B0038R1WOU/ref=cmcr_arp_d_pl_foot_top?ie=UTF8].
ALIBABA: "False Eye Lashes 20D Individual Lashes Grafted Eyeslashes Extension," Oct. 2, 2024, 16 Pages, Retrieved from [https://www.alibaba.com/product-detail/false-eye-lashes-20D-individual-lashes_60689734967.html].
AMAZON: "Ardell Knot-Free Individual Lash Double, Black, Medium," Retrieved on Oct. 3, 2024, 9 Pages, Retrieved from [https://www.amazon.com/Ardell-Double-Individuals-Flares-Black/dp/B00CAOFL66/ref=cm_cr_arp_d_product_top?ie=UTF8&th=1].
AMAZON: "Kiss I Envy Knot Free Medium 70 Lashes Ultra Black," [Retrieved on Oct. 3, 2024], 6 Pages, Retrieved from [https://www.amazon.com/Kiss-Medium-Lashes-Ultra-Black/dp/B017O6IM0M?th=1].
AMAZON: "Kiss Looks So Natural Lashes Shy (2 Packs)," Beauty Personal Care, 5 Pages, [Retrieved on Oct. 4, 2024], Retrieved from [https://www.amazon.com/Kiss-Looks-Natural-Lashes-Pack/dp/B01AX2Z6NK].
ARDELL: "Cluster Wispies 600," The Wayback Machine, Jun. 12, 2016, 3 Pages, Retrieved from [https://web.archive.org/web/20160612220611/ http:/ardelllashes.com/Lashes/product_246.html].
ARDELL: "Cluster Wispies 603," The Wayback Machine, May 19, 2016, 3 Pages, Retrieved from [https://web.archive.org/web/20160519162211/ http:/www.ardelllashes.com:80/Lashes/product_247.html].
ARDELL: "Short Black," Aug. 1, 2016, 3 Pages, Retrieved from [https://web.archive.org/web/20160801162839/ http:/www.ardelllashes.com/Lashes/product_89.html].
ARDELL: "Individual Lashes, "ProTip, Retrieved from [https://www.youtube.com/watch?v=6Peg8U65ck4].
ARDELL: "Individual Lashes Started Kit," Jul. 6, 2016, 3 Pages, Retrieved from [https://web.archive.org/web/20160706223201/ http:/www.ardelllashes.com:80/Lashes/product_200.html].
ARDELL: "Lash Lites," The Wayback Machine, Jul. 15, 2016, 2 Pages, Retrieved from [https://web.archive.org/web/20160715175102/ http://www.ardelllashes.com/Lashes/filter_41.html].
ARDELL: "Lashes—Demi Wispies," Jun. 29, 2016, 1 page, Retrieved from https://web.archive.org/web/20160629220043/ http:/www.ardelllashes.com/Lashes/product_237.html.
"ARDELL: Lashes Index," Jul. 15, 2016, Retrieved from [https://web.archive.org/web/20160715175029/ http:/www.ardelllashes.com/Lashes/index.html].
ARDELL: "Lashes-Lash Trios," Jul. 15, 2016, 1 Page, Retrieved from [https://web.archive.org/web/20160715175032/http://www.ardelllashes.com/Lashes/product_238.html].
ARDELL: "Lashes—Long Black" Jul. 8, 2016, 1 Page, Retrieved from [https://web.archive.org/web/20160715175032/ http://www.ardelllashes.com/Lashes/product_238.html].
ARDELL: "Long Black," Jul. 8, 2016, 3 Pages, Retrieved from [https://web.archive.org/web/20160708102833/ http:/www.ardelllashes.com/Lashes/product_93.html].
ARDELL: "Try on Lashes," The Wayback Machine, Jul. 15, 2016, 4 Pages, Retrieved from [https://web.archive.org/web/20160715175036/ http:/www.ardelllashes.com/Lashes/filter_108.html].
BEAUTE4U: "Stars Colors Eyelashes Soft Grafting Eyelash Extension Thick Style 20 Hairs Rabbit anti-Lashes XEB-009," Ideal Beaumax Marketing, Sep. 26, 2024, Retrieved from [https://beaute4u.com/index.php?id_product=56&controller=product].
Camie-Cameron: "How to Apply Individual Lashes Underneath the Eyelid," Camie Cameron Video, Jun. 27, 2016, 31 Pages, Retrieved from [https://www.youtube.com/watch?v=CabxTEY9qjc].
EDMARYS: "Eyelash Hack | Reverse Lash Tutorial," Edmarys Video, Jan. 27, 2017, 22 Pages, Retrieved from [https://www.youtube.com/watch?v=NprJRiAQAi8].
"Fing'rs Lash Pocket," Oct. 1, 2024, 3 Pages, Retrieved from [https://www.amazon.de/-/en/Fing%60rs-Lashes-%20pocket/dp/B00ANLZTJS/ref=sr_1_1?qid=1686689361&refinements=p_89%3AFing%60rs&s=beauty&sr=1-1].
Glad Girl: "Glad Lash Signature 5D—Volume Fans—Mink Lashes Eyeslashes," Jun. 30, 2016, 3 pages, Retrieved from https://web.archive.org/web/20160630100924/ http:/www.eyelashextensions.com/eyelashes/mink-lashes/volume-fans/glad-lash-signature-5d.html.
Glad Girl: "Glad Lash Signature Double Configuration D Y Eyelashes," Sep. 26, 2024, 3 pages, Retrieved from [https://www.gladgirl.com/products/glad-lash-signature-double-configuration-2d-y-eyelashes?srsltid=AfmBOoqEbsioiLD0iJpG4gdT1JyfJq7Z32u6_9fhODFwjWJV9vRN_Uo&variant=31337154150452].
Glad Girl: "Knot-Free Flare Lashes—Eyelashes," Feb. 24, 2016, 3 Pages, Retrieved from https://web.archive.org/web/20160224231654/ http:/www.eyelashextensions.com/knot-free-medium-10-hair-7261.html.
Gladgirl: "W Lashes," Mar. 23, 2016, 2 Pages, Retrieved from [https://web.archive.org/web/20160323083727/ http:/www.eyelashextensions.com/eyelashes/mink-lashes/w-lashes.html].
GLADGIRL: "Glad Lash Belle Strip Lash Application—Under Lash Line Technique," Eyelash Extension Supplies, Jan. 31, 2014, 10 Pages, Retrieved from [https://www.youtube.com/watch?v=6xnLNxbqVKM].
GLADGIRL: "Glad Lash Demi Whispy Strip Lash Application—Under Lash Line Technique," Eyelash Extension Supplies, Jun. 3, 2013, 11 Pages, Retrieved from [https://www.youtube.com/watch?v=Fpsr-XgWQwk].
GLADGIRL: "Knot-Free," Mar. 22, 2016, 2 Pages, Retrieved from [https://web.archive.org/web/20160322053913/ http:/www.eyelashextensions.com/eyelashes/flare-lashes/knot-free.html].
"GLADGIRL: Lash Index," Mar. 10, 2016, 3 Pages, Retrieved from [https://web.archive.org/web/20160310145533/ http:/www.eyelashextensions.com/eyelashes.html].
GLADLASH: "Signature 4D," Jun. 27, 2016, 5 Pages, Retrieved from [https://web.archive.org/web/20160627013832/ http:/www.eyelashextensions.com/eyelashes/mink-lashes/volume-fans/glad-lash-signature-4d.html].
GLADLASH: "Knot-Free W Lash Off the Tray," Jun. 30, 2016, 5 Pages, Retrieved from [https://web.archive.org/web/20160630041938/ http:/www.eyelashextensions.com/eyelashes/mink-lashes/w-lashes/knot-free-w-lash-off-the-tray.html].
Guglielmo A.D., "The New Way To Apply False Lashes," Stylecaster, Feb. 6, 2015, 2 Pages, Retrieved from [https://web.archive.org/web/20160201132329/ http://stylecaster.com/beauty/false- eyelashes-application-tip/].
HOLLYREN: "Beautiful Knot Free Flare Eyelashes for Daily Life #H03," Jun. 11, 2016, 4 Pages, Retrieved from [https://web.archive.

(56) References Cited

OTHER PUBLICATIONS org/web/20160611120459/ http://www.hollyren.com/Beautiful-Knot-Free-Flare-Eyelashes-For- Daily-Life-H03_215.html].
"HOLLYREN: False Eyelashes," Jun. 11, 2016, 2 Pages, Retrieved from [https://web.archive.org/web/20160611120415/ http://www.hollyren.com/all-categories.html].
HOLLYREN: "Make Beauty Easier, Individual Flare Lashes," Jun. 11, 2016, 3 Pages, Retrieved from https://web.archive.org/web/20160611032519/ http:/www.hollyren.com/Individual-Flare-Lashes_cpid9.
HOLLYREN: "Make Beauty Easier, Regular Lashes, Beautiful Fashion False Eyelash For Daily Life #A02 products," Jun. 10, 2016, 2 Pages, Retrieved from https://web.archive.org/web/20160610231445/ http:/www.hollyren.com/Regular-Lashes_cpid12.
HOLLYREN: "Make Beauty Easier, Super Soft Faux Mink False Eyelashes products," Apr. 6, 2016, 2 Pages, Retrieved from https://web.archive.org/web/20160406204549/ http:/www.hollyren.com/Faux-Mink-False-Eyelashes_cpid38.
HOLLYREN: "Make Beauty Easier, Tip Mellow Lashes, Natural Look Tipped Criss Cross False Eyelash #BY05," Jun. 11, 2016, 2 Pages, Retrieved from https://web.archive.org/web/20160611032812/ http:/www.hollyren.com/Tip-Mellow-Lashes_cpid3.
HOLLYREN: "Natural Look Tipped Criss Cross False Eyelash #BY05," May 29, 2016, 2 Pages, Retrieved from [https://web.archive.org/web/20160529101843/ http:/www.hollyren.com/Natural-Look-Tipped-Criss-Cross-False-Eyelash-BY05_46.html].
HOLLYREN: "Quotation of EyeLash Extensions 2013," Jul. 12, 2023, 1 Page, Exhibit F-3 Summary Chart, Defendant's Final Invalidity Contentions, United States District Court for the Western District of Texas—Waco Division, Case No. 6:22-cv-00776-ADA-DTG, *Lashify Inc*, v. *Qingdao Lashbeauty Cosmetic Co, Ltd. d/b/a Worldbeauty and Qingdao Hollyren Cosmetics Co, Ltd. d/b/a Hollyren*.
HOLLYREN: Super Soft Faux Mink False Eyelashes SS03, May 28, 2016, 2 Pages, Retrieved from [https://web.archive.org/web/20160528090621/ http:/www.hollyren.com/Super-Soft-Faux-Mink-False-Eyelashes-SS03_4812.html].
HOLLYREN: Super Soft Faux Mink False Eyelashes SS06, May 28, 2016, 2 Pages, Retrieved from [https://web.archive.org/web/20160528084206/ http:/www.hollyren.com/Super-Soft-Faux-Mink-False-Eyelashes-SS06_4815.html].
HOLLYREN: "Super Soft Faux Mink False Eyelashes SS08," Qingdao Hollyren Cosmetics Co., Ltd, May 28, 2016, 2 Pages, Retrieved from [https://web.archive.org/web/20160528094955/ http:/www.hollyren.com/Super-Soft-Faux-Mink-False-Eyelashes-SS08_4817.html].
HOLLYREN: "Super Soft Faux Mink False Eyelashes SS11" Qingdao Hollyren Cosmetics Co., Ltd, May 28, 2016, 2 Pages, Retrieved from [https://web.archive.org/web/20160528144715/ http:/www.hollyren.com/Super-Soft-Faux-Mink-False-Eyelashes-SS11_4820.html].
HUSSSH SG: "How to Apply Husssh DIY Lashes," HussshSG video, May 28, 2010, 15 Pages, Retrieved from [https://www.youtube.com/watch?v=AIBSySwqsOY].
I.ENVY BY KISS: "Quattro Collection Ad," Hype Hair Magazine, Nov. 2015, vol. 22(8), 1 Page.
I.ENVY: "Knot-Free," Jan. 31, 2015, 2 Pages, Retrieved from [https://web.archive.org/web/20150131220543/ http:/ienvybykiss.com/2013/portfolio-type/knot-free/].
I.ENVY: "Trio Lash-KPECO1UB/02US," Jan. 31, 2015, 2 Pages, Retrieved from [https://web.archive.org/web/20150131220846/ http:/ienvybykiss.com/2013/portfolio/trio-lash-kpec01ub02ub/].
JAPONESQUE: "Sectional 4 Lashes," Aug. 10, 2014, 1 Page, Retrieved from [https://web.archive.org/web/20140810125817/ http:/japonesque.com/lashes-brows/false-lashes/eyelash-sectional-4].
JAPONESQUE: "Sectional 4 Lashes," Oct. 2, 2024 4 Pages, Retrieved from [https://www.amazon.com/JAPONESQUE-ZM-410-Sectional-4-Eyelashes/dp/B0038R1WOU/ref=cm_cr_arp_d_pl_foot_top?ie=UTF8].
JAPONESQUE: "False Lashes—Lashes Brows", Aug. 8, 2014, Retrieved from [https://web.archive.org/web/20140808235016/ http:/japonesque.com/lashes-brows/false-lashes].
Jocelyn-Marcial: "How to Apply Strip Lashes Underneath VS on Top," Jocelyn Marcial Video, Mar. 17, 2017, 24 Pages, Retrieved from [https://www.youtube.com/watch?v=lu_ck8K4otw].
KISS: "I Envy Knot Free Ultra Black Short (KPE04UB), Madame Madeline," Oct. 1, 2015, 3 pages, Retrieved from https://web.archive.org/web/20151001102530/https:/madamemadeline.com/online_shoppe/proddetail.asp?prod=mmKPE04UB.
KISS: "Ever EZ Lashes Single Pack," The Wayback Machine, Jan. 1, 2015, 2 Pages, Retrieved from [https://web.archive.org/web/20150101185551/ http://www.kissusa.com/lashes/ever_ez_lashes/everez_lashes_single_pack#.VKWYPnbP1qY].
KISS: "Ever-EZ Kiss Premium Lashes 03, Ever-EZ Lashes by Kiss—Madame Madeline," Jul. 8, 2016, 2 Pages, Retrieved from https://web.archive.org/web/20160708044512/https:/www.madamemadeline.com/online_shoppe/proddetail.asp?prod=mmKPL03.
KISS: "I Envy by Kiss—How to Apply Individual Lashes," Nails R US Beauty Supply Ltd., Aug. 27, 2017, 17 Pages, Retrieved from [https://www.youtube.com/watch?v=qPLNB_WDJGw].
KISS Looks So Natural False Eyelashes, Shy, 14 mm, 1 Pair, Sep. 26, 2024, 4 pages, Retrieved from https://www.walmart.com/ip/KISS-Looks-So-Natural-False-Eyelashes-Shy/34400580.
KISS: "Strip Lashes Mul,"Haute Couture Multi Pack Lashes Wink, Sep. 26, 2014, 1 Page, Retrieved from [https://web.archive.org/web/20140926011512/ http://www.kissusa.com/lashes/haute_couture/haute_couture_lash_multipack#.VCS-QnbP2Uk].
LASH'EM: "Mink Fur & Horse Mane Eyelashes," Apr. 28, 2014, 2 Pages, Retrieved from [https://web.archive.org/web/20140428032020/ http://www.lashemlashes.com/services.html].
LONG TAI LT-004 Lashes: "Exhibit A-39, Defendant's Final Invalidity Contentions," Jul. 12, 2023, United States District Court for the Western District of Texas—Waco Division, Case No. 6:22-cv-00776-ADA-DTG, *Lashify Inc*, v. *Qingdao Lashbeauty Cosmetic Co, Ltd. d/b/a Worldbeauty and Qingdao Hollyren Cosmetics Co, Ltd. d/b/a Hollyren*, 1 Page.
MADAME MADALINE: "Ardell Duralash Naturals Long Length," Sep. 10, 2025, 3 Pages, Retrieved from [https://web.archive.org/web/20150910130146/https:/www.madamemadeline.com/online_shoppe/proddetail.asp?prod=adl_l].
MADAME MADALINE: EVER EZ KISS Premium Lashes, Kiss Premium Eyelashes, Madame Madaline, Apr. 10, 2016, 5 Pages, Retrieved from [https://web.archive.org/web/20160410103057/https:/www.madamemadeline.com/online_shoppe/products.asp?cat=EVER+EZ+LASHES+by+Kiss].
MADAME MADELINE: "Kiss I-Envy Au Naturale," Sep. 6, 2015, 5 Pages, Retrieved from [https://web.archive.org/web/20150906170057/https:/www.madamemadeline.com/online_shoppe/products.asp?cat=i-ENVY+Strip+Lashes+by+KISS].
MADAME MADELINE: "Ardell Duralash Knot-Free Double Individual Lashes Long," May 6, 2016, 2 Pages, Retrieved from [https://web.archive.org/web/20160506050354/https:/www.madamemadeline.com/online_shoppe/proddetail.asp?prod=mm61496].
MADAME MADELINE: "Ardell Duralash Knot-Free Double Individual Lashes Medium," May 6, 2016, 3 Pages, Retrieved from [https://web.archive.org/web/20160506015523/https:/www.madamemadeline.com/online_shoppe/proddetail.asp?prod=mm61485].
MADAME MADELINE: "Ardell Duralash Knot-Free Double Individual Lashes Short," May 6, 2016, 3 Pages, Retrieved from [https://web.archive.org/web/20160506053149/https:/www.madamemadeline.com/online_shoppe/proddetail.asp?prod=mm61484].
MADAME MADELINE: "Ardell Duralash Naturals Combo Pack," Sep. 10, 2015, 3 Pages, Retrieved from [https://web.archive.org/web/20150910090349/https:/www.madamemadeline.com/online_shoppe/proddetail.asp?prod=mm65063].
MADAME MADELINE: "Ardell Duralash Naturals Medium Length," Sep. 10, 2015, 3 Pages, Retrieved from [https://web.archive.org/

(56) References Cited

OTHER PUBLICATIONS web/20150910130347/https:/www.madamemadeline.com/online_shoppe/proddetail.asp?prod=adl_ml].
MADAME MADELINE: "Ardell Duralash Naturals Short Length," Sep. 10, 2015, 3 Pages, Retrieved from [https://web.archive.org/web/20150910130042/https:/www.madamemadeline.com/online_shoppe/proddetail.asp?prod=adl_s].
Madame Madeline: "Ardell Duralash Naturals Starter Kit," Sep. 10, 2015, 3 Pages, Retrieved from [https://web.archive.org/web/20150910093438/https:/www.madamemadeline.com/online_shoppe/proddetail.asp?prod=mm240462].
Madame Madeline: "Ardell False Eyelashes Accessories, Invisi Bands & Lash Lites Eyelashes," False Eyelashes, Apr. 10, 2016, 05 Pages, Retrieved from [https://web.archive.org/web/20160410124330/https:/www.madamemadeline.com/online_shoppe/products.asp?cat=Ardell+InvisiBands+%26+LashLites+Eyelashes].
MADAME MADELINE: "Ardell InvisiBands Demi Luvies," Ardell InvisiBands LashLites Eyelashes, Sep. 10, 2015, 3 Pages, Retrieved from [https://web.archive.org/web/20150910131057/https:/www.madamemadeline.com/online_shoppe/proddetail.asp?prod=ail_dlv].
MADAME MADELINE: "Ardell InvisiBands Demi Wispies (New Packing)," Ardell InvisiBands & LashLites Eyelashes, Sep. 10, 2015, 03 Pages, Retrieved from [https://web.archive.org/web/20150910130919/https:/www.madamemadeline.com/online_shoppe/proddetail.asp?prod=mm65012].
MADAME MADELINE: "Ardell Invisibands Wispies (New Packaging)," Sep. 21, 2015, 3 Pages, Retrieved from [https://web.archive.org/web/20150921002822/https:/www.madamemadeline.com/online_shoppe/proddetail.asp?prod=ail_wn].
MADAME MADELINE: Ardell Invisibands Wispies, Sep. 10, 2015, 3 Pages, Retrieved from [https://web.archive.org/web/20150910130131/https:/www.madamemadeline.com/online_shoppe/proddetail.asp?prod=ail_w].
MADAME MADELINE: "Ardell Lash Trios Individual Long Black," Jul. 16, 2017, 3 Pages, Retrieved from [https://web.archive.org/web/20170720061842/https:/www.madamemadeline.com/online_shoppe/products.asp?cat=Ardell+Individual+Trios+Lashes].
MADAME MADELINE: "EVER-EZ Kiss Premium Lashes 11," Madame Madeline, Jul. 8, 2016, 3 Pages, Retrieved from [https://web.archive.org/web/20160708105446/https:/www.madamemadeline.com/online_shoppe/proddetail.asp?prod=mmKPL01].
MADAME MADELINE: "I.ENVY Individual Lashes Classic Flare Combo (KPE03)," Sep. 11, 2015, 5 Pages, Retrieved from [https://web.archive.org/web/20150911044752/https:/www.madamemadeline.com/online_shoppe/products.asp?cat=i-ENVY+Individual+Lashes+by+KISS].
MADAME MADELINE: "I.ENVY Individual Lashes Knot Free Combo KPE06," Sep. 11, 2015, 3 Pages, Retrieved from [https://web.archive.org/web/20150911110942/https:/madamemadeline.com/online_shoppe/proddetail.asp?prod=mmKPE06].
MADAME MADELINE: "I-ENVY Individual Lashes Trio Medium (KPEC02)," Sep. 27, 2015, 3 Pages, Retrieved from [https://web.archive.org/web/20150927140415/https:/www.madamemadeline.com/online_shoppe/proddetail.asp?prod=mmKPEC02].
MADAME MADELINE: "I.ENVY Individual Lashes Trio Short (KPEC01)," Sep. 30, 2015, 3 Pages, Retrieved from [https://web.archive.org/web/20150930045649/https:/madamemadeline.com/online_shoppe/proddetail.asp?prod=mmKPEC01].
MADAME MADELINE: "I-ENVY Individual Lashes Trio Ultra Black Short (KPEC01UB)," Sep. 29, 2015, 3 Pages, Retrieved from [https://web.archive.org/web/20150929123306/https:/madamemadeline.com/online_shoppe/proddetail.asp?prod=mmKPEC01UB].
MADAME MADELINE: "Japonesque Eyelashes Sectinal 4," Japonesque False Eyelashes, Sep. 10, 2015, 3 Pages, Retrieved from [https://web.archive.org/web/20150910073702/https:/www.madamemadeline.com/online_shoppe /proddetail.asp?prod=jpn410].
MADAME MADELINE: "KISS i-Envy Au Naturale Multi-Pack 01 (KPEM08)," Strip Lashes by Kiss-Madame Madeline, Sep. 10, 2015, 2 Pages, Retrieved from [https://web.archive.org/web/20150910075201/https://www.madamemadeline.com/online_shoppe/proddetail.asp?prod=mmKPEM08].
Marilyn: "Ardell False Lashes Including the New Color Impact—Review, Photos and Looks," Mar. 6, 2013, 12 Pages, Retrieved from [https://weheartthis.com/ardell-false-lashes-including-the-new-color-impact-review-photos-and-looks/].
"MATA: Mahkota Tri Angjaya," Jul. 12, 2016, 1 Page, Retrieved from [https://web.archive.org/web/20160712154019/ http:/www.mata-lashes.com].
MATA: "Process of Making Flare Eyelashes," PT. Mahkota Tri Angjaya, Nov. 12, 2015, 16 Pages, Retrieved [https://www.youtube.com/watch?v=UuJ3WNqiZWM].
Office Action for Chinese Patent Application No. 202110625150.1, mailed Aug. 30, 2024, 27 Pages.
Premier Lashes: "Exhibit A-42, Defendant's Final Invalidity Contentions," Jul. 12, 2023, United States District Court for the Western District of Texas—Waco Division, Case No. 6:22-cv-00776-ADA-DTG, *Lashify Inc*, v. *Qingdao Lashbeauty Cosmetic Co, Ltd. d/b/a Worldbeauty and Qingdao Hollyren Cosmetics Co, Ltd. d/b/a Hollyren*, 4-5 Pages.
Pretty Casual: "Lashtite Glue DIY Eyelash Extensions—Apply Under My Lashes For A More Natural Look!," Mar. 26, 2016, 42 Pages, Retrieved from [https://www.youtube.com/watch?v=Td6Bi9aVmeQ].
QUEENIE-CHAN: "Invisible Eyelash Extension Method—How to Apply False Eyelashes in a Special Way," BeautyQQ, Aug. 9, 2009, 20 Pages, Retrieved from [https://www.youtube.com/watch?v=lalQMuLByU].
Shu Uemura: "Slim Partial," Dec. 14, 2011, 1 Page, Retrieved from [https://web.archive.org/web/20111214144618/ http:/www.shuuemura-usa.com/_us/_en/accessories/false-eyelashes/accent/slim-partial.htm].
STEALE02: "How to Apply Individual Lashes," Steale02 Video, Apr. 5, 2010, 35 Pages, Retrieved from [https://www.youtube.com/watch?v=9X84CUIWqgo].
Toni Valentine: "How to Apply Individual Lashes," Mar. 16, 2013, 101 Pages, Retrieved from [https://www.youtube.com/watch?v=aLHE2SqzlO].
WALMART: Customer Reviews for KISS Looks So Natural, False Eyelashes, Shy, 14 mm, 1 Pair, 2 Pages, [Retrieved on Oct. 3, 2024], Retrieved from [https://www.walmart.com/reviews/product/34400580].
Wayback Machine: "Slim Partial—Accent Lashes by Shu Uemura Art of Beauty", Feb. 1, 2013, p. 1, Retrieved from https://web.archive.org/web/20130201021908/ http:/www.shuuemura-usa.com/_us/_en/accessories/false-eyelashes/accent/slim-partial.htm.
"WORLDBEAUTY: Knot Free Flare Lashes," Exhibit A-44, Defendant's Final Invalidity Contentions, Jul. 12, 2023, 1 Page, United States District Court for the Western District of Texas—Waco Division, Case No. 6:22-cv-00776-ADA-DTG, *Lashify Inc*, v. *Qingdao Lashbeauty Cosmetic Co, Ltd. d/b/a Worldbeauty and Qingdao Hollyren Cosmetics Co, Ltd. d/b/a Hollyren*.
"WORLDBEAUTY: Knot Free Flare Lashes", Aug. 17, 2012, 3Pages, Retrieved from [https://web.archive.org/web/20120817103827/http:/www.worldbeautylashes.com:80/category/flare-eyelashes.html].

* cited by examiner

CASES FOR STORING LASH EXTENSIONS AND METHODS FOR USE AND MANUFACTURE THEREOF

CROSS REFERENCE TO RELATED APPLICATIONS

This Application is a continuation application of U.S. patent application Ser. No. 16/644,948, filed Mar. 5, 2020, which is the National Phase of International Application No. PCT/US2019/057104, filed Oct. 19, 2019; which claims a benefit of U.S. Provisional Application No. 62/748,335, filed Oct. 19, 2018; the contents of all are hereby incorporated by reference in their entirety herein.

TECHNICAL FIELD

This disclosure relates to cases for storing lash extensions.

BACKGROUND

A lash extension can be stored in a case. However, the lash extension can be displaced from the case during transport, which can damage the lash extension or result in the lash extension being lost.

SUMMARY

Broadly, this disclosure enables various cases for storing lash extensions and methods of use and manufacture thereof. In particular, these cases can include gaskets or inclined floors, which can help the lash extensions to avoid being displaced from the case during transport.

In an embodiment, a case comprises: a lid; a gasket; a body coupled to the lid such that the body and the lid define a window and such that the gasket is positioned between the lid and the body, the window being configured to enable a lash extension having a base and a plurality of hairs extend out of the window as the gasket resiliently contacts the base or the hairs.

One embodiment of a method of manufacturing a case for carrying artificial eyelash extensions may include providing a lid, providing a gasket, and providing a body. The lid may be coupled to the body such that the body and the lid define a window The gasket may be coupled to either the lid or the body between the lid and the body, where the window may be configured to enable a lash extension having a base and a plurality of hairs that extend out of the window as the gasket resiliently contacts the base or the hairs.

DETAILED DESCRIPTION

Broadly, this disclosure enables various cases for storing lash extensions and methods of use and manufacture thereof.

In particular, these cases can include gaskets or inclined floors, which can help the lash extensions to avoid being displaced from the case during transport.

Figure 7:
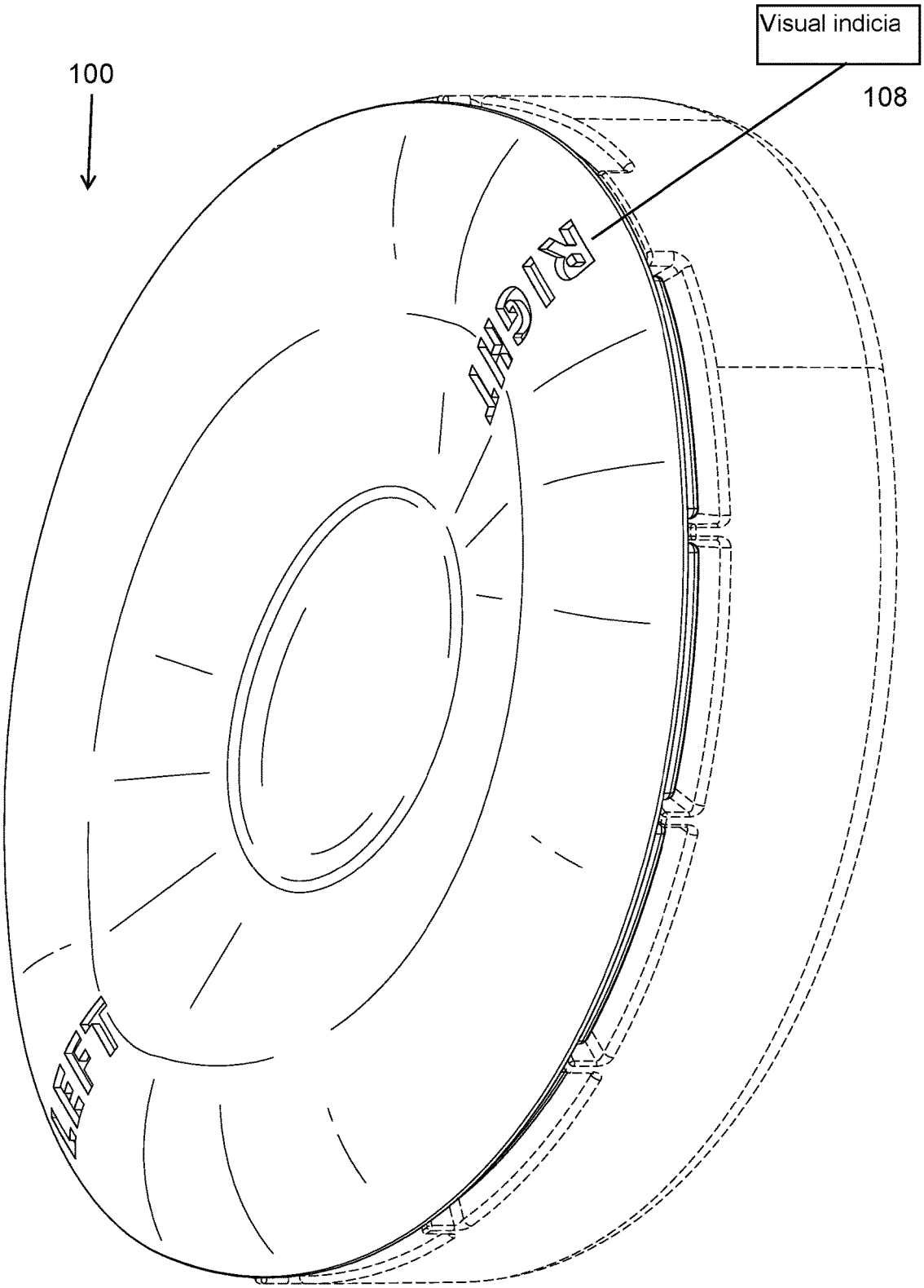
FIG. 7 shows an embodiment of a lid hosting a visual indicia thereon according to this disclosure.
Figure 8:
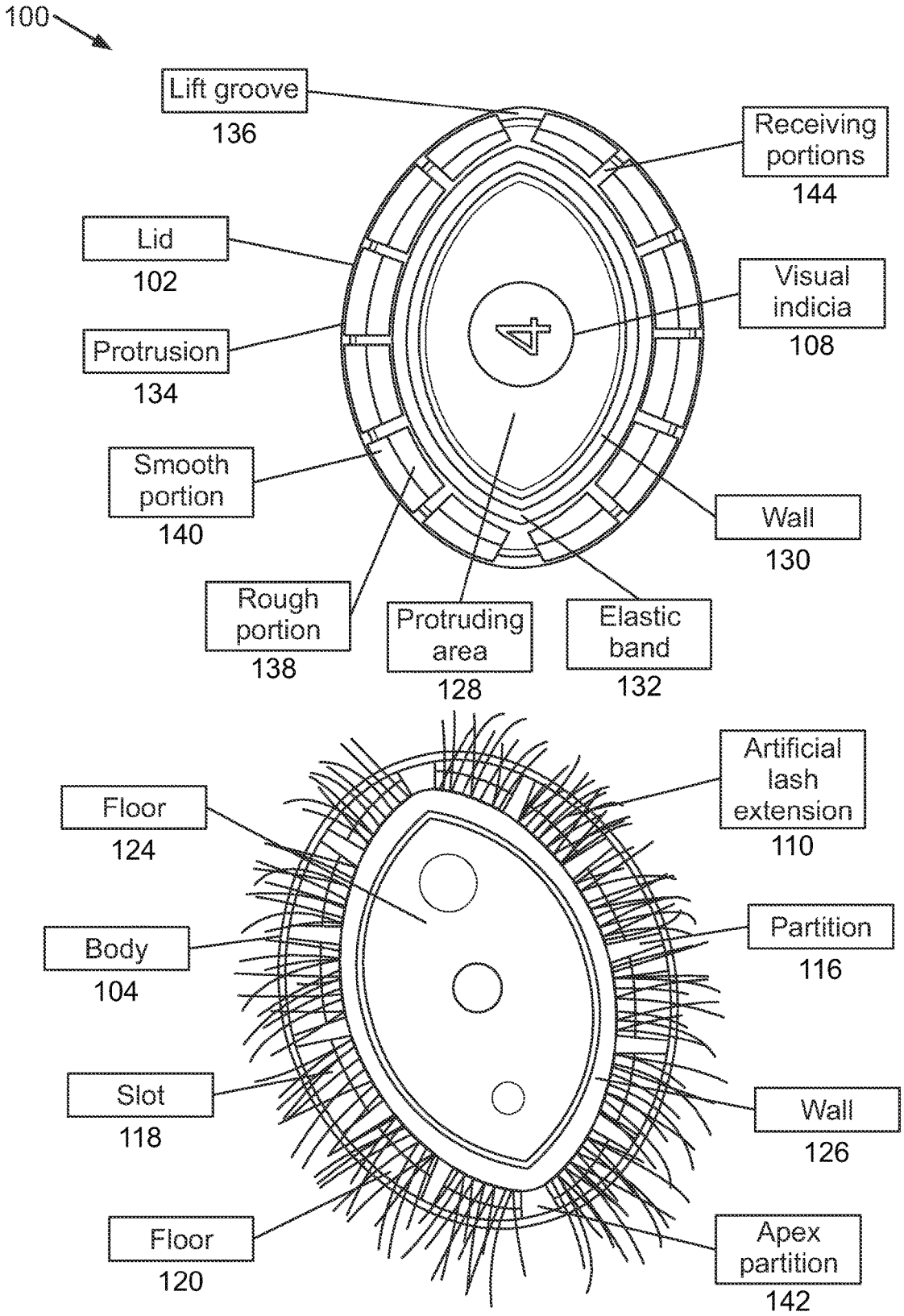
FIG. 8 shows an embodiment of a lid and a body according to this disclosure.
Figure 9:
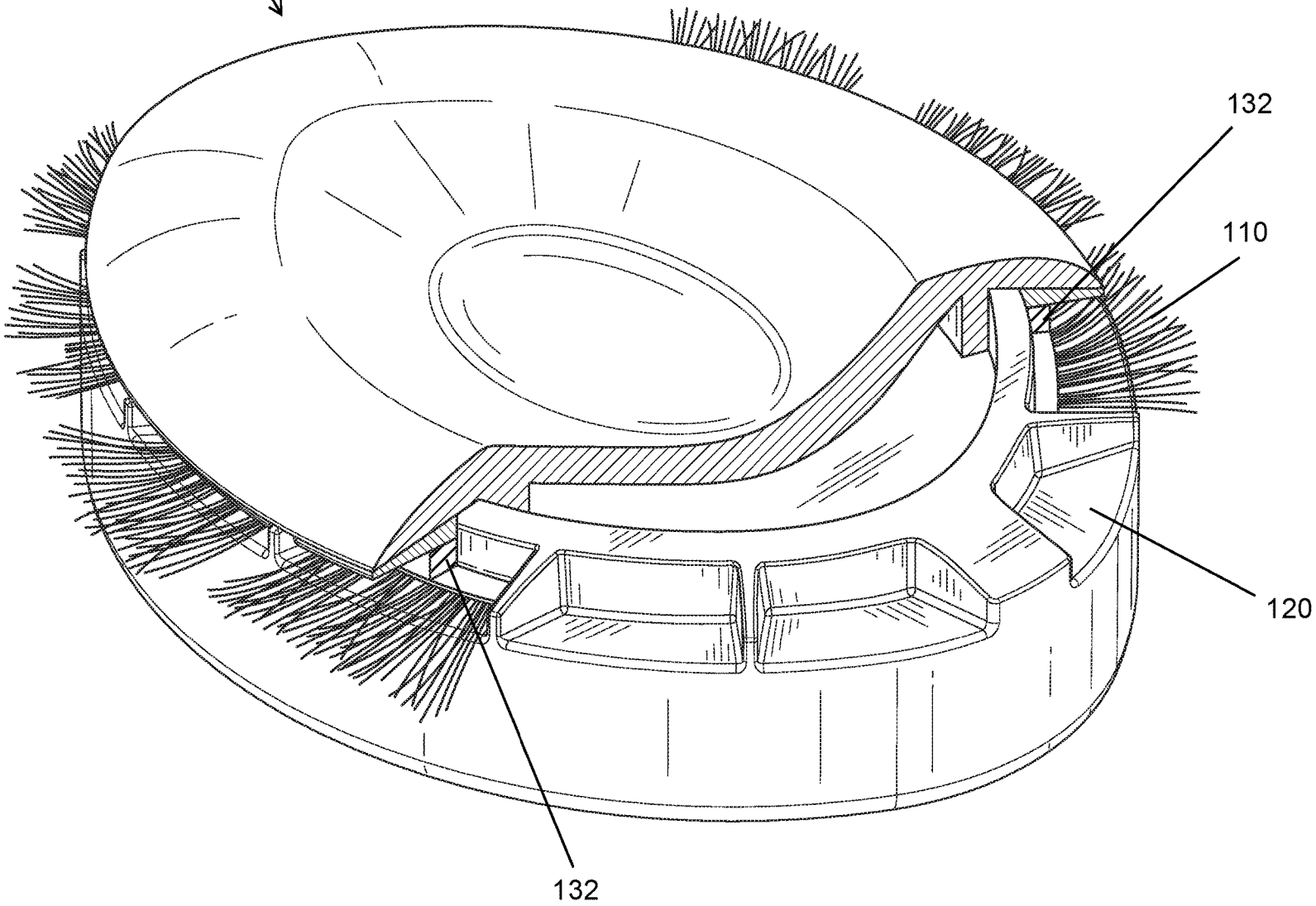
FIG. 9 shows an embodiment of a gasket and an inclined floor according to this disclosure.
Figure 10:
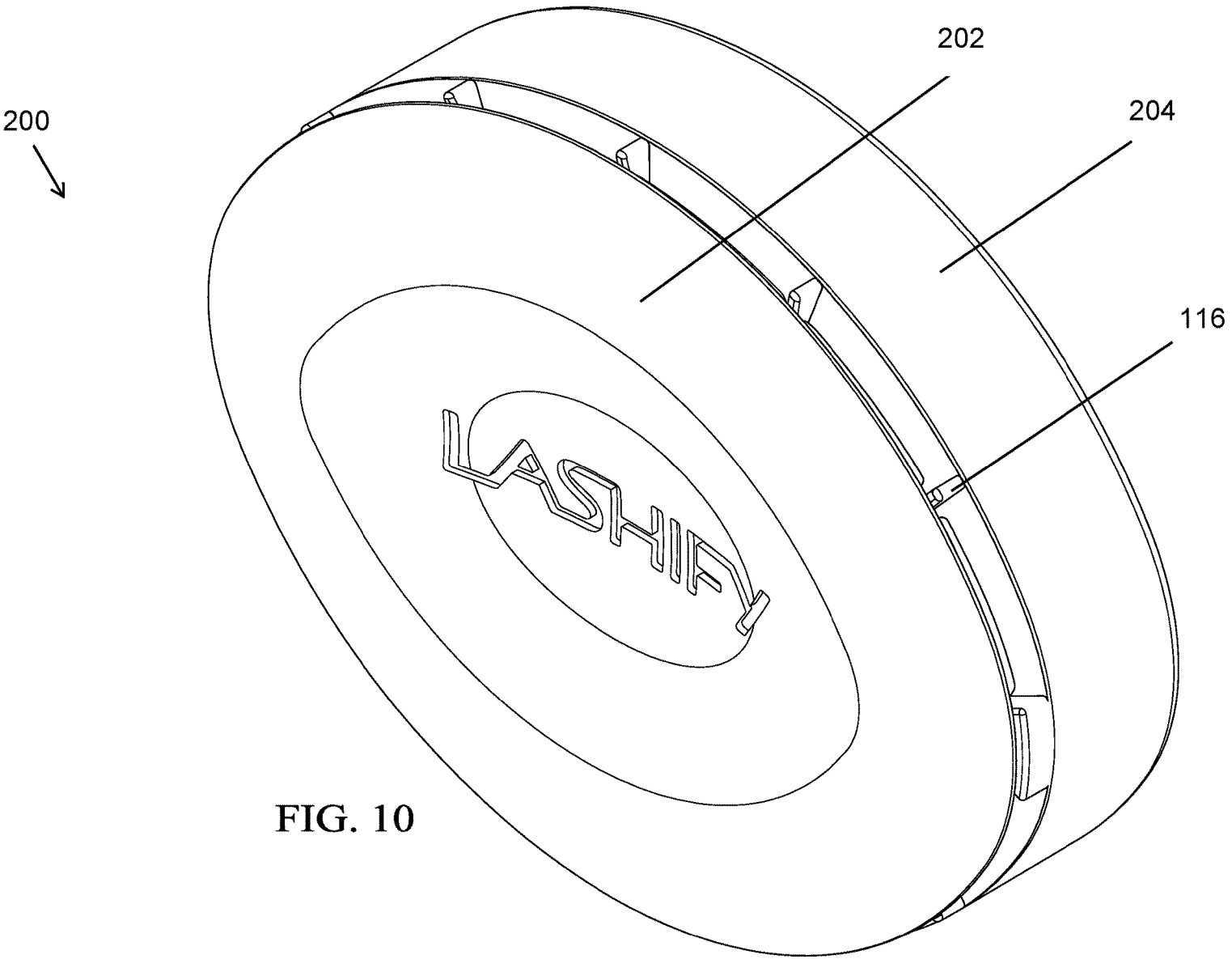
FIGS. 10-33 show an embodiment of a case where a gasket is separate and distinct from a lid and a body according to this disclosure.
Figure 11:
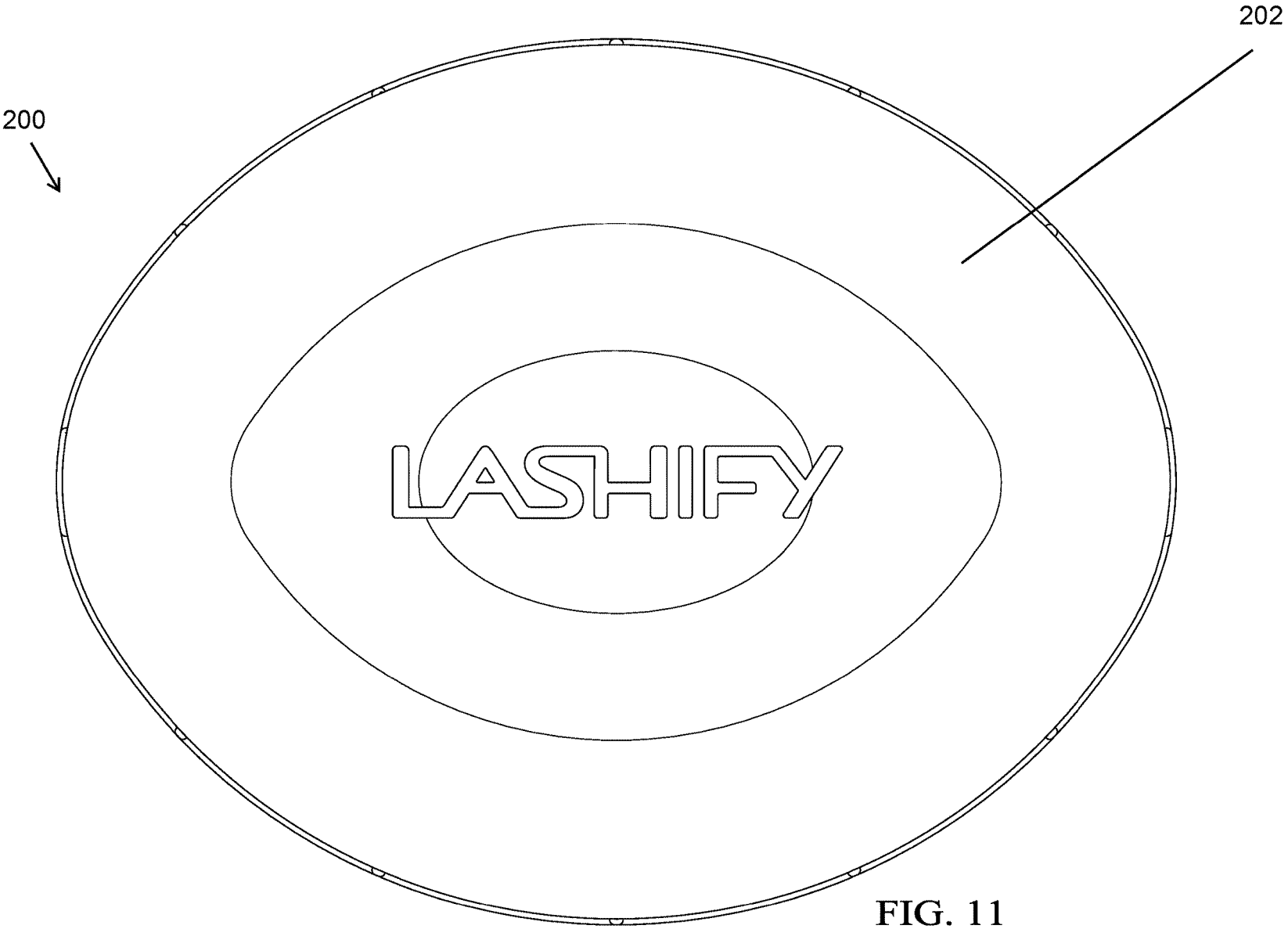
Figure 12:
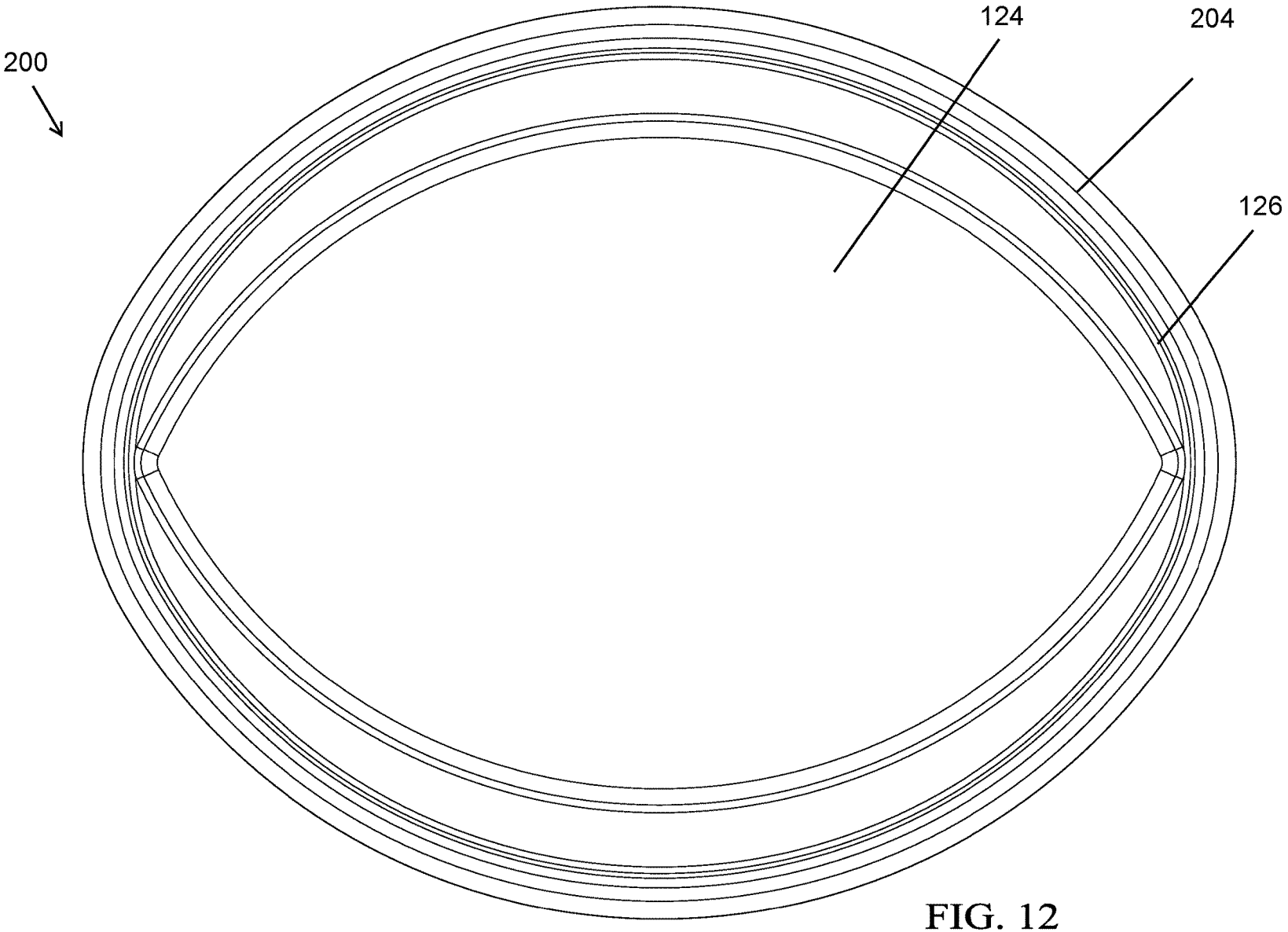
Figure 14:
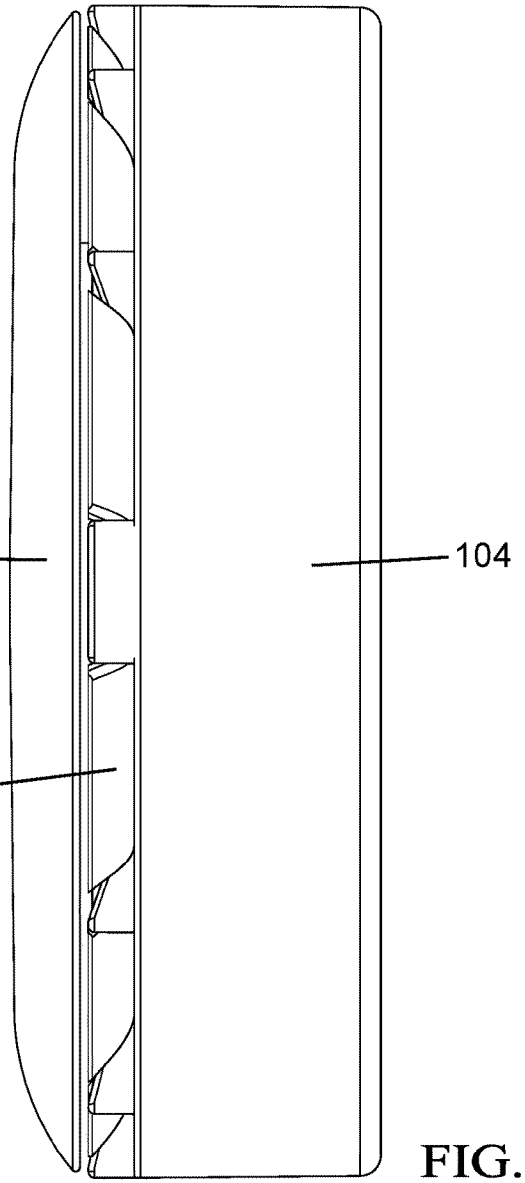
Figure 13:
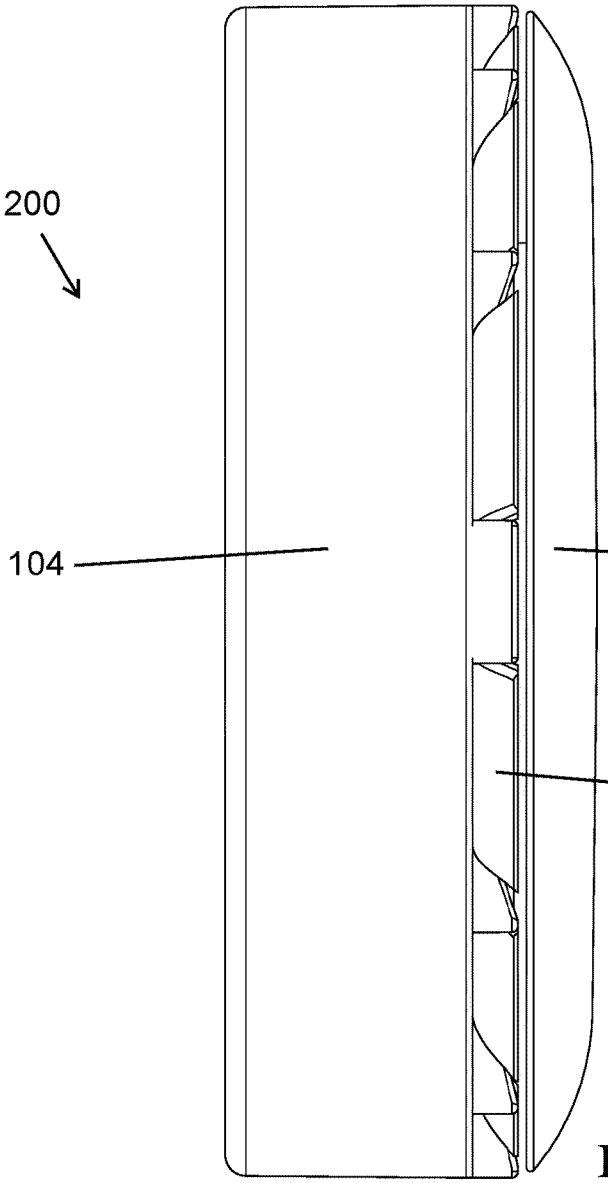
Figure 15:
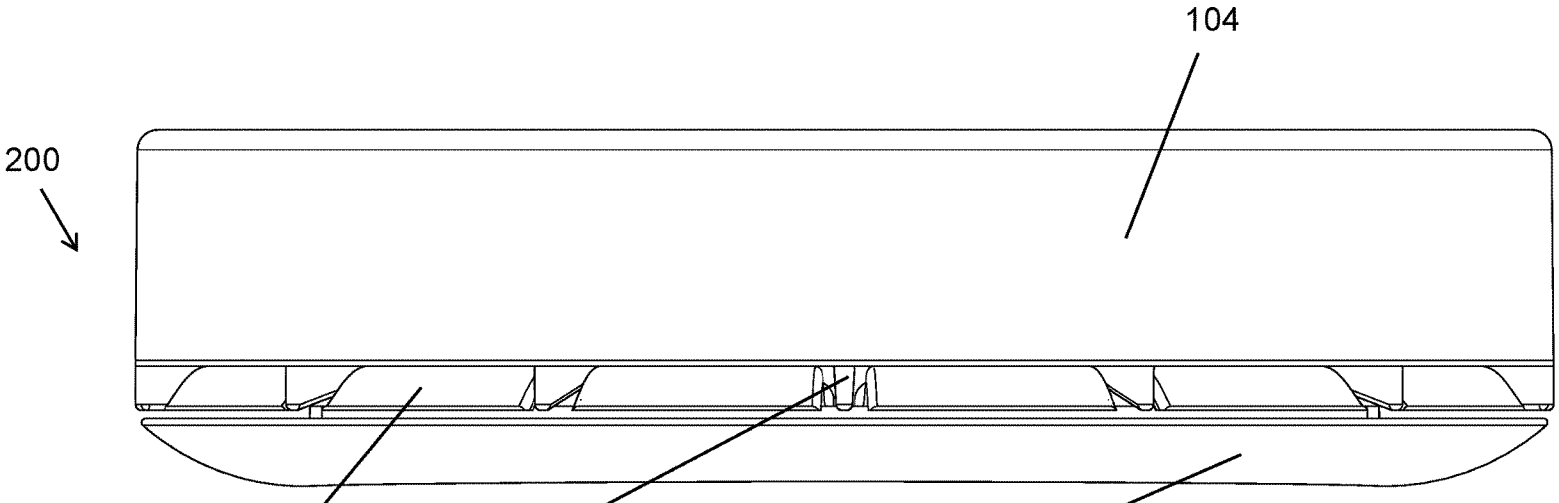
Figure 16:
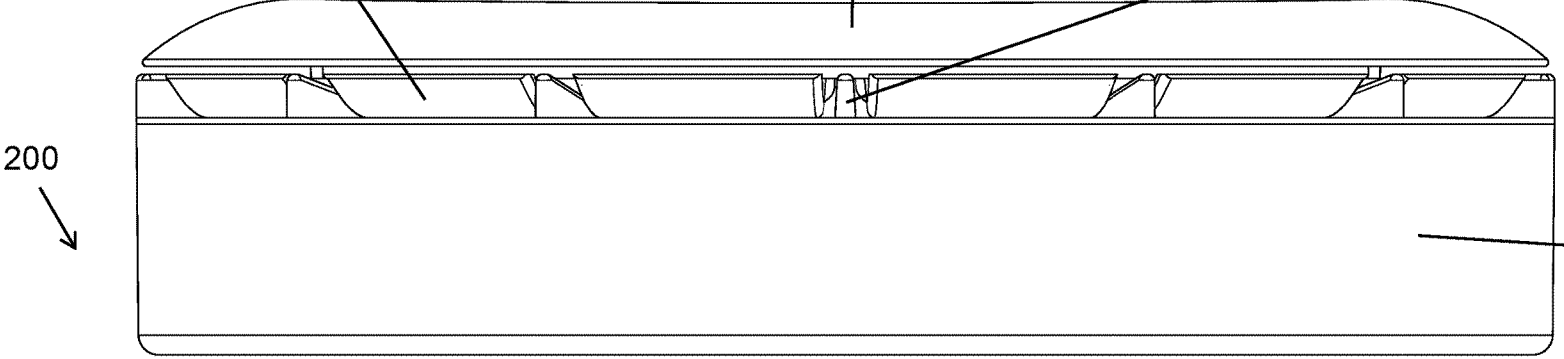
Figure 17:
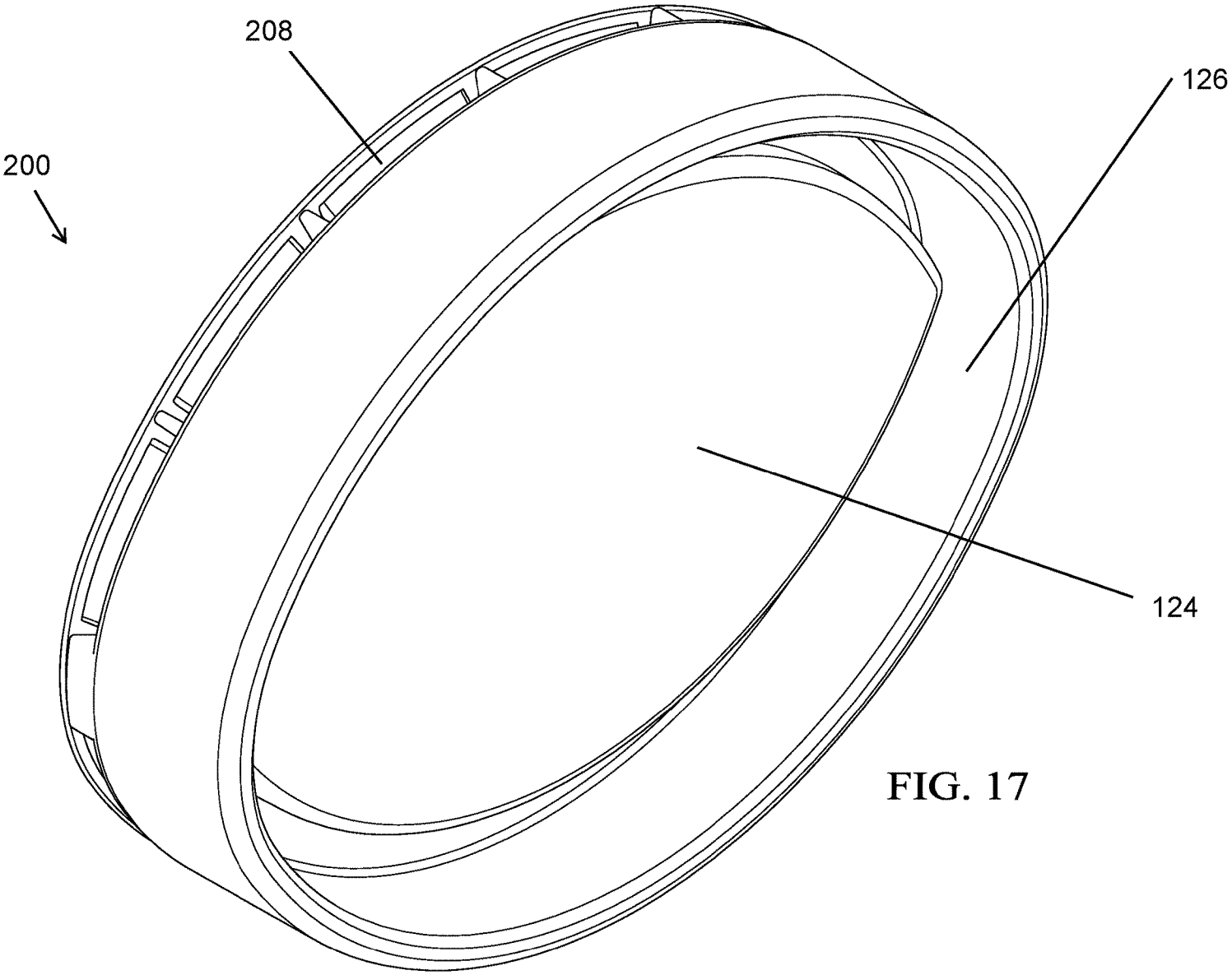
Figure 18:
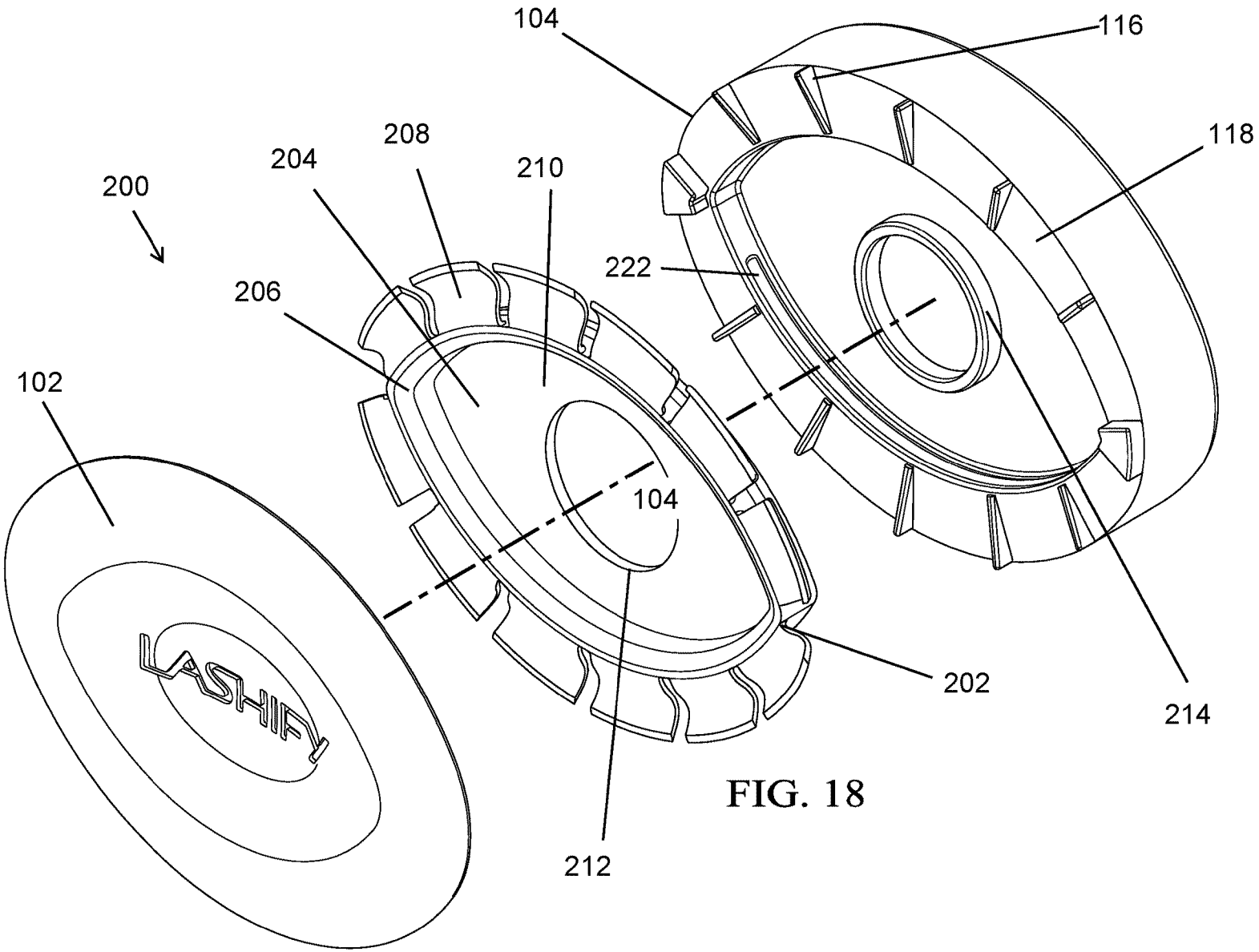
Figure 19:
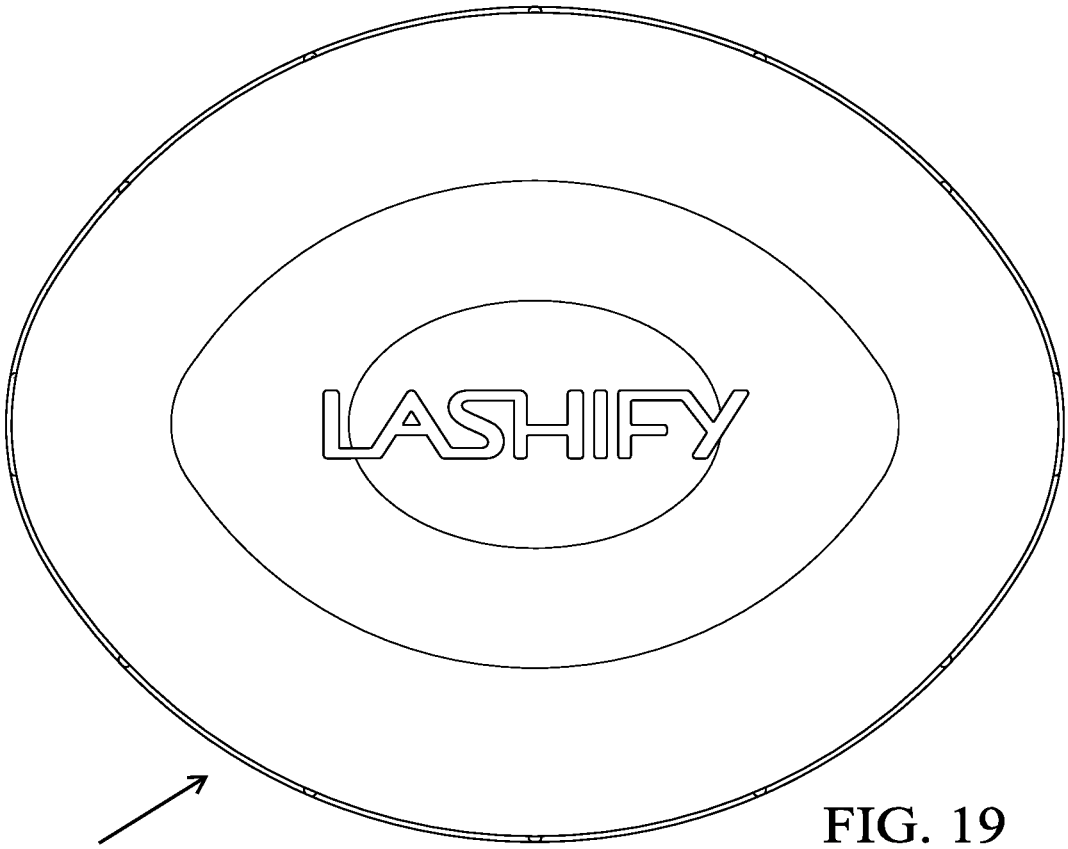
Figure 20:
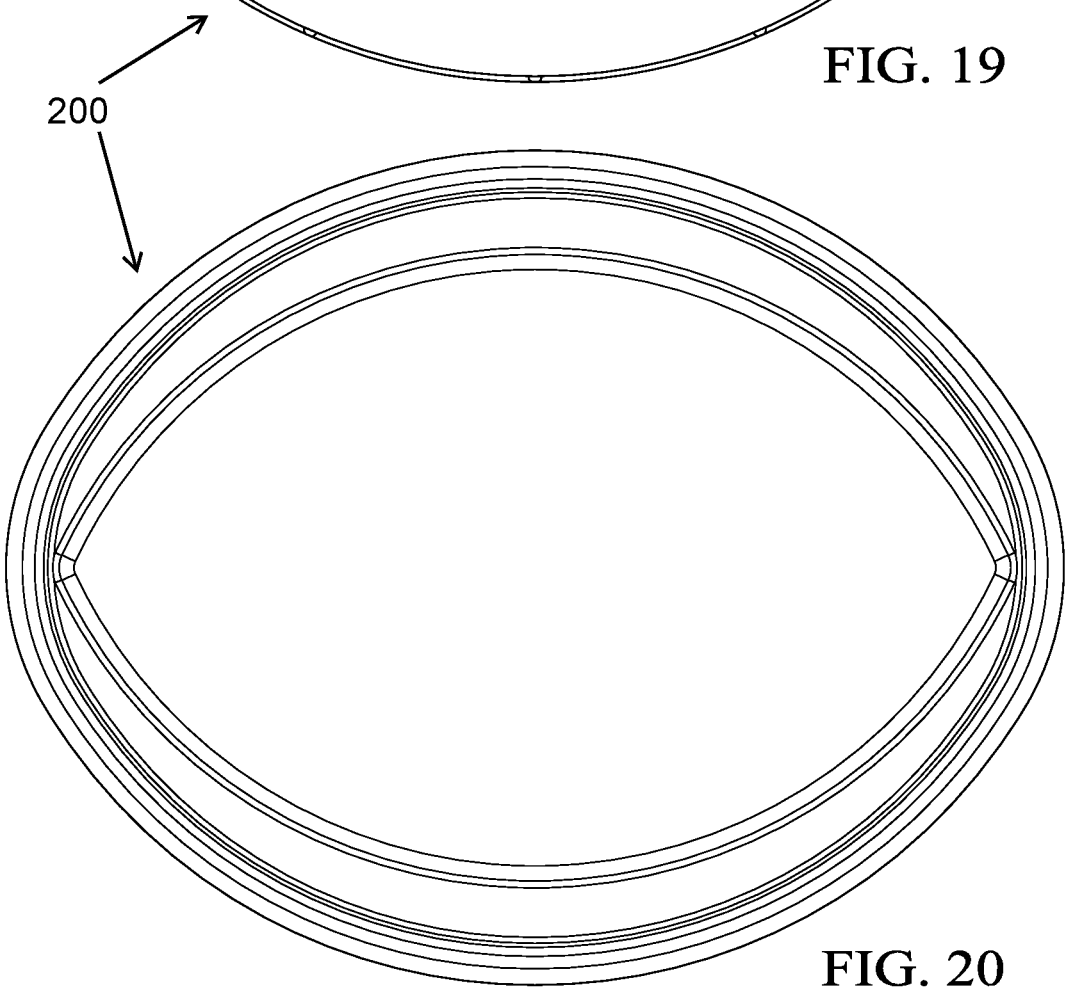
Figure 21:
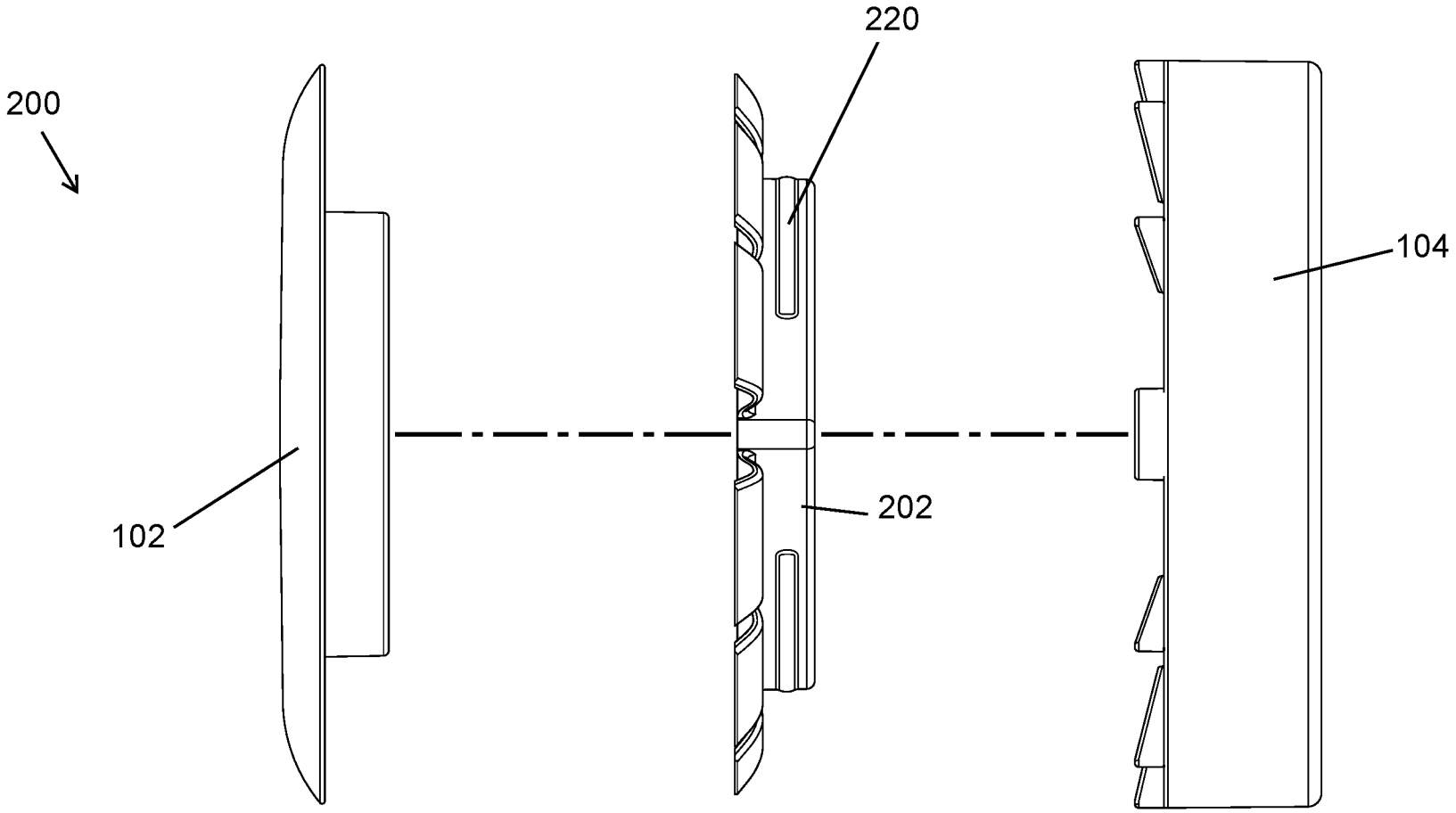
Figure 22:
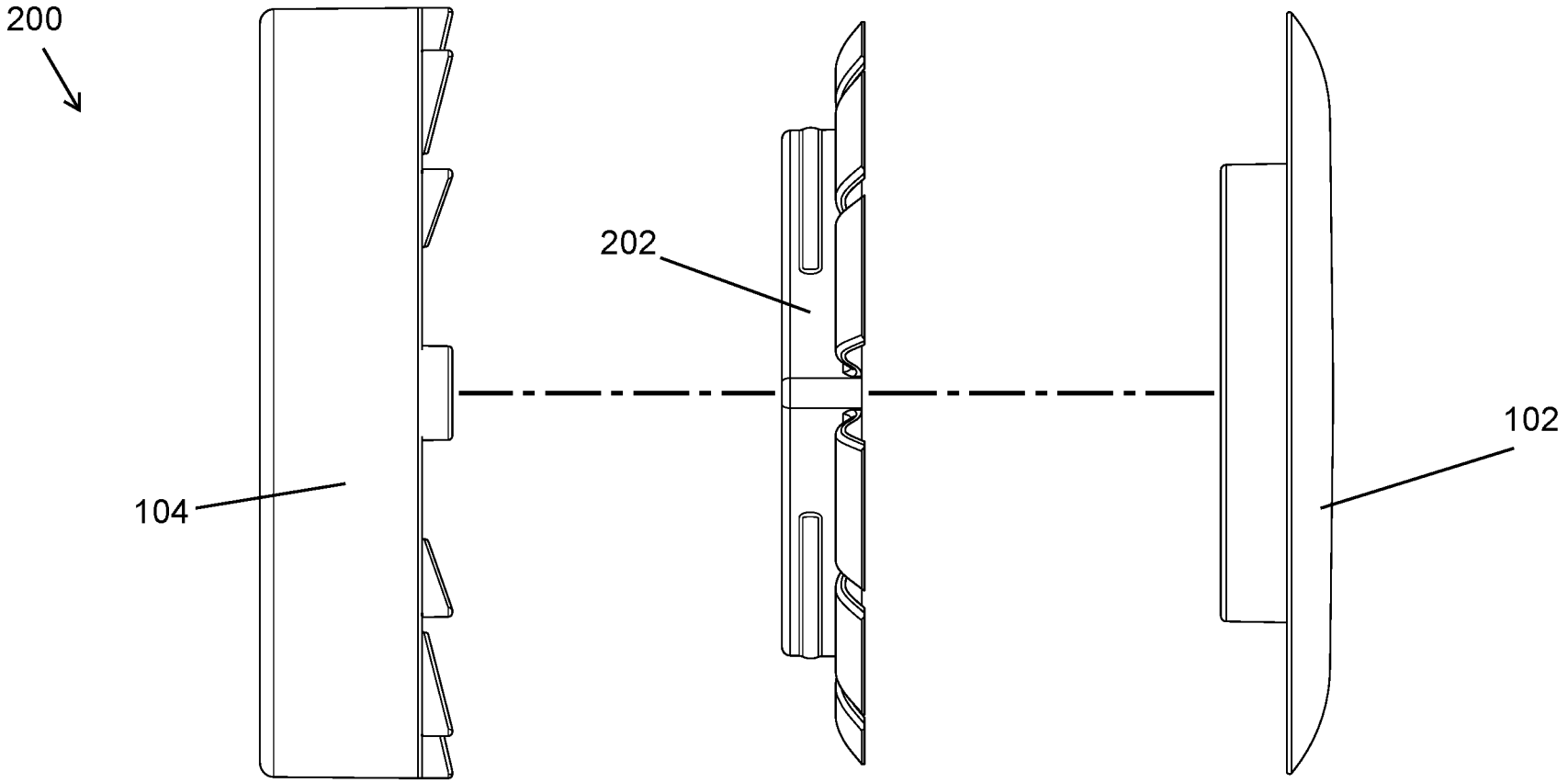
Figure 23:
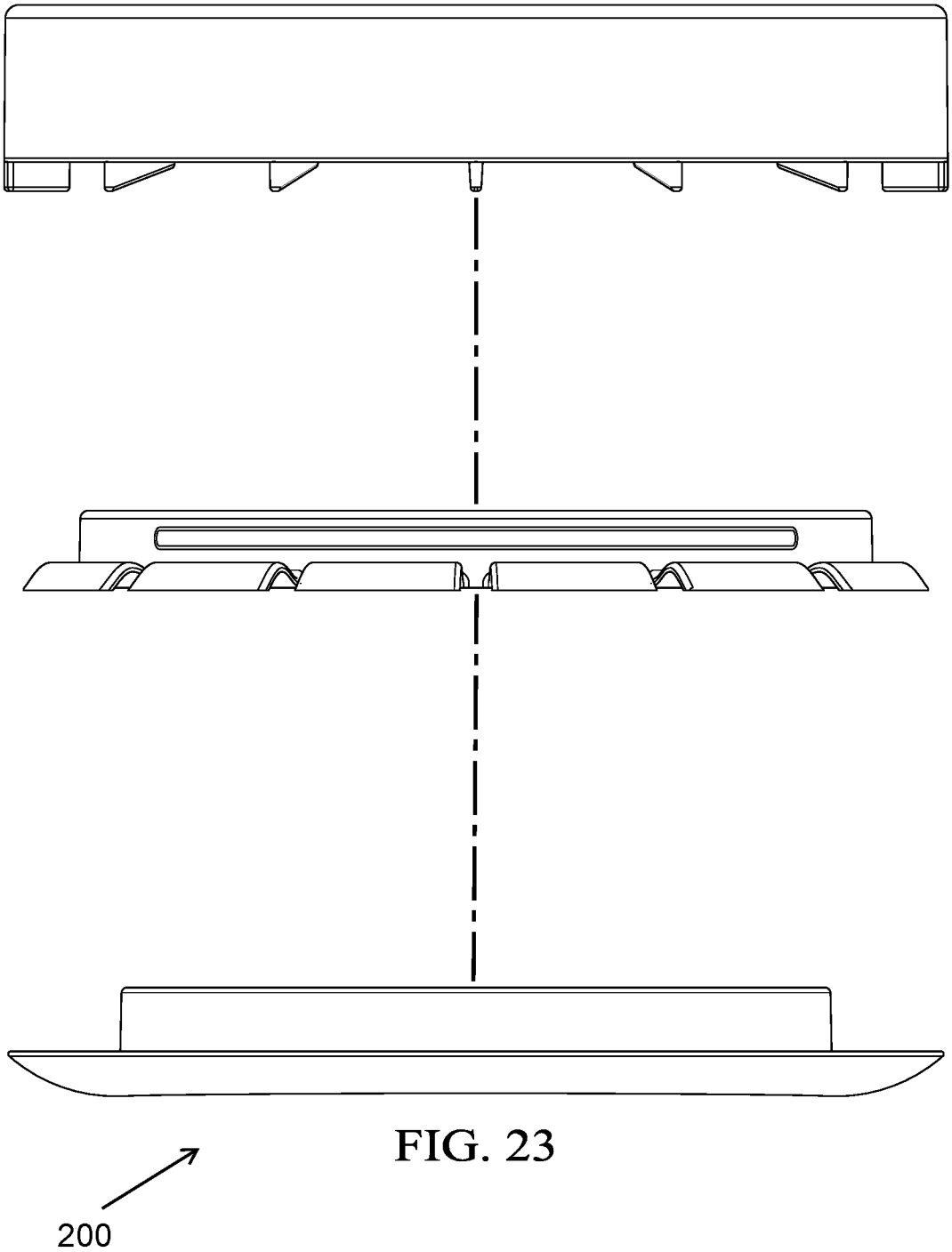
Figure 24:
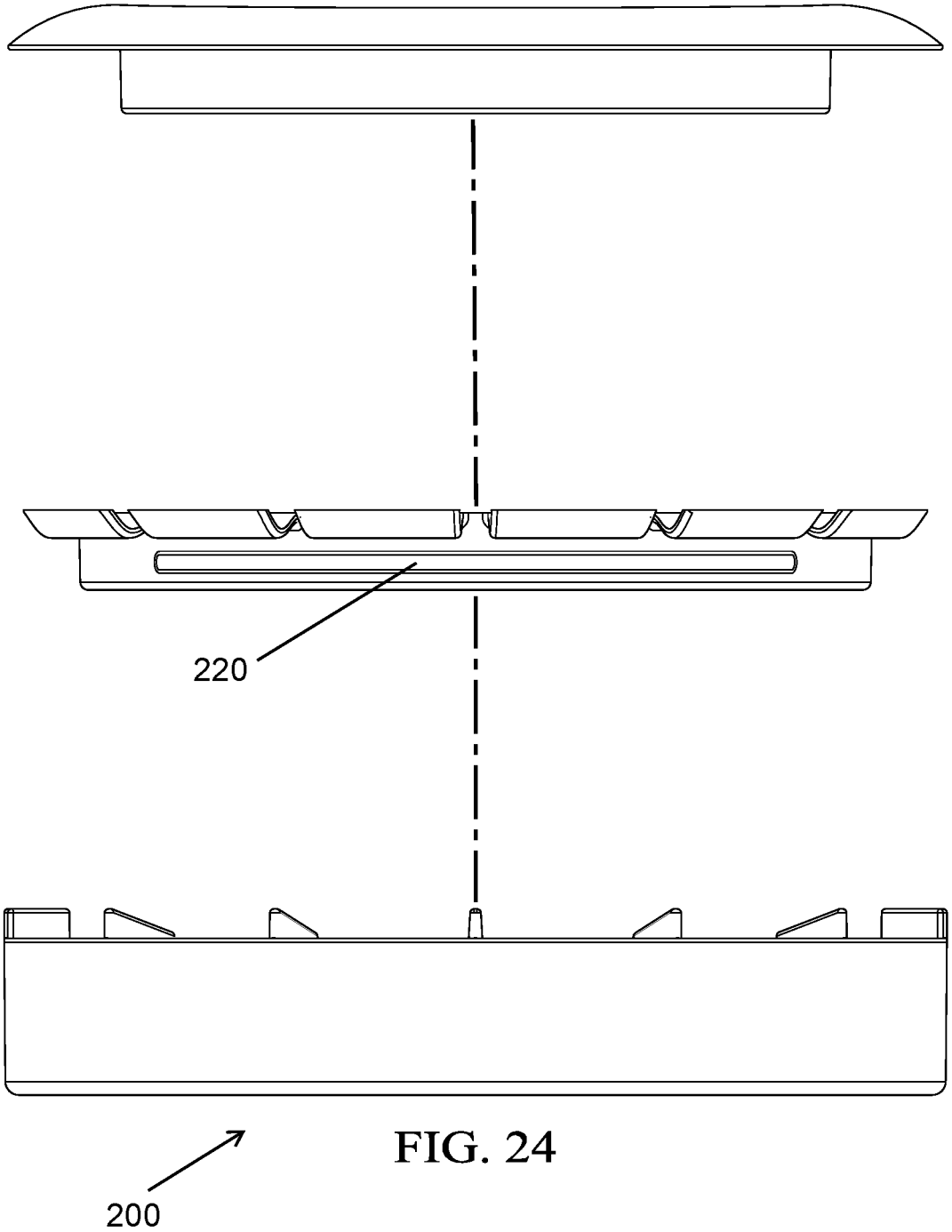
Figure 25:
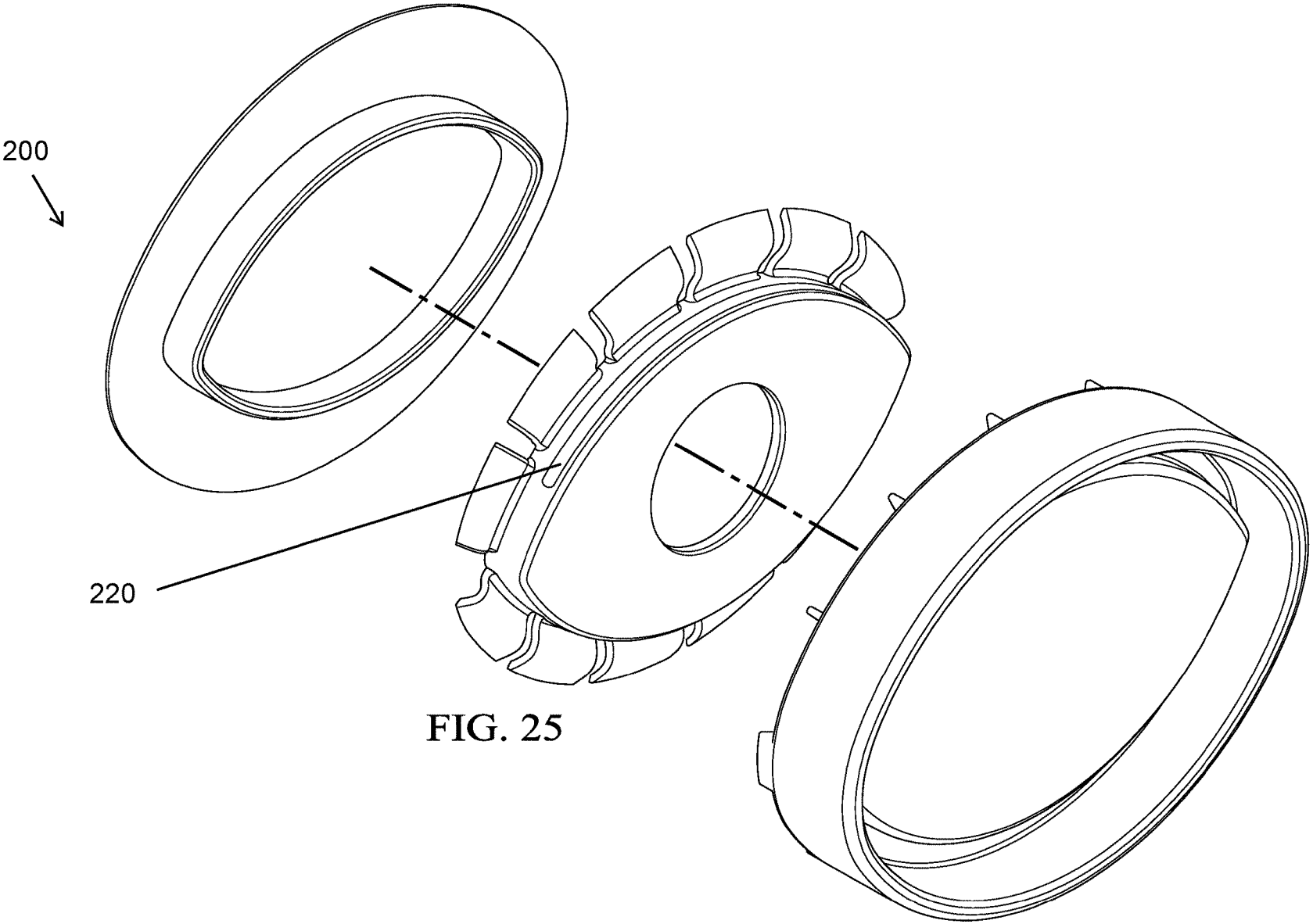
Figure 26:
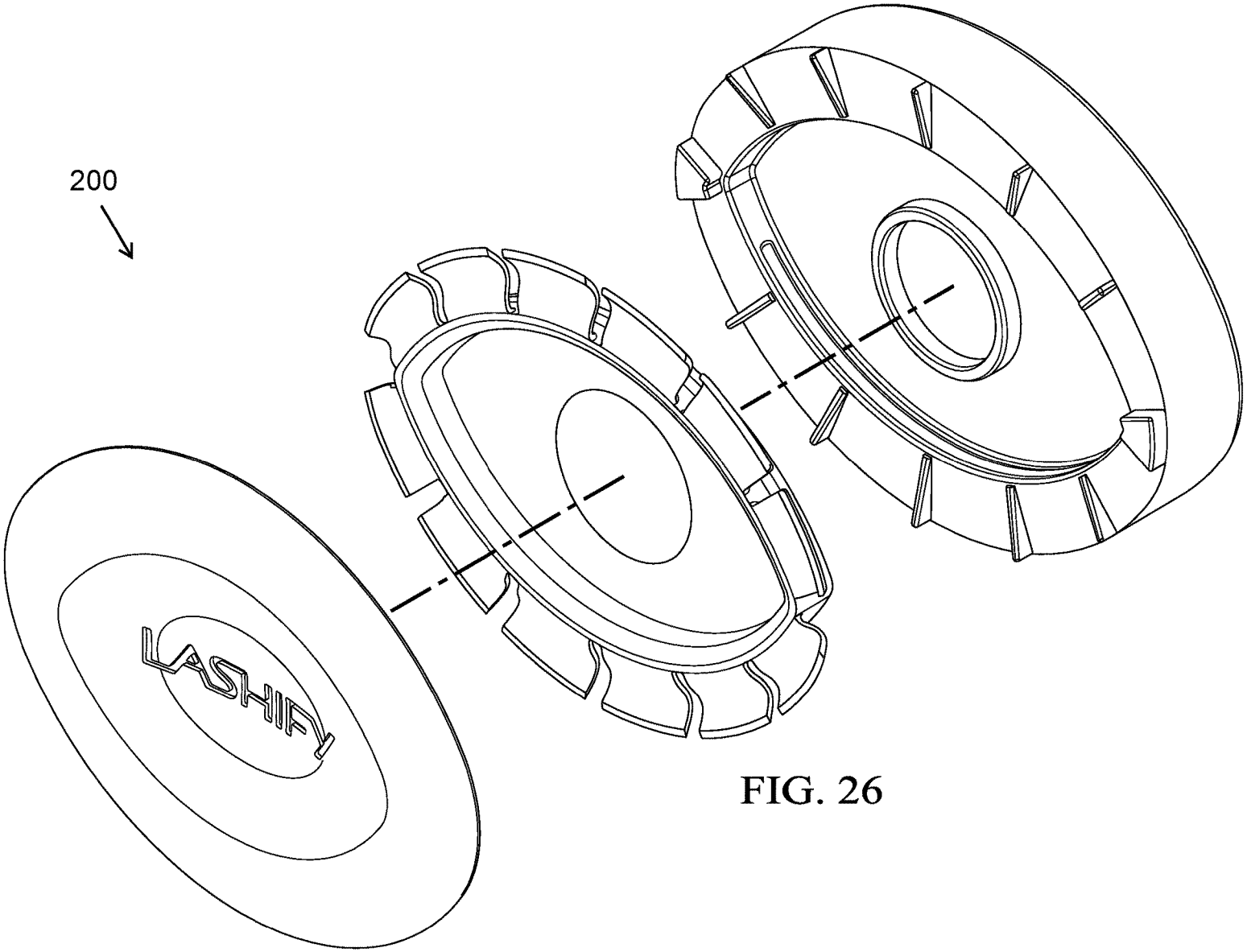
Figure 27:
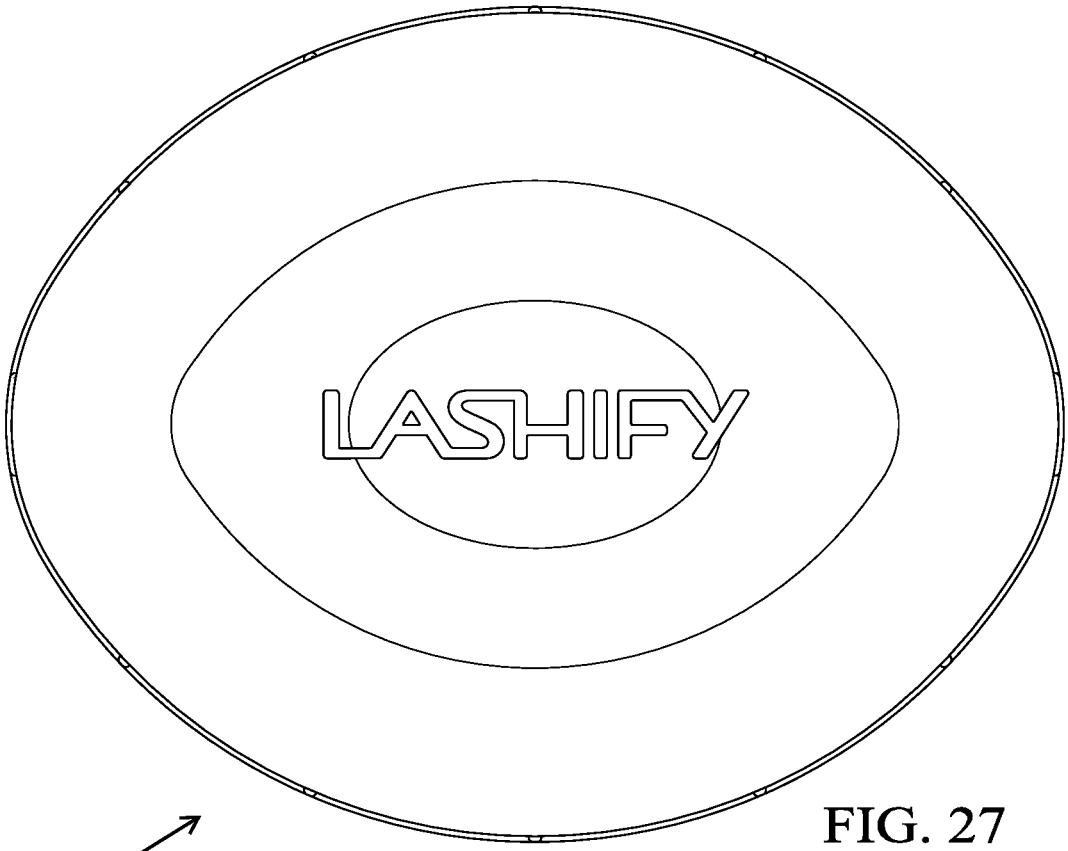
Figure 28:
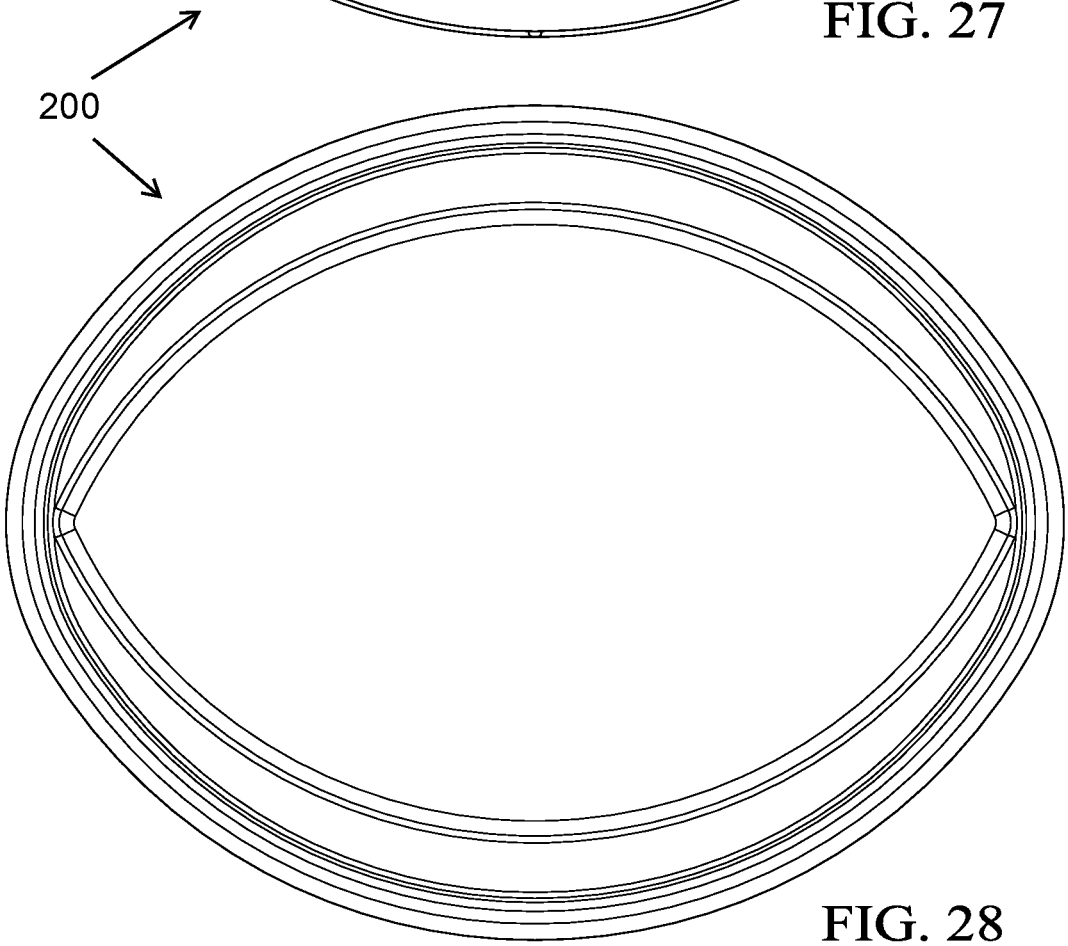
Figure 29:
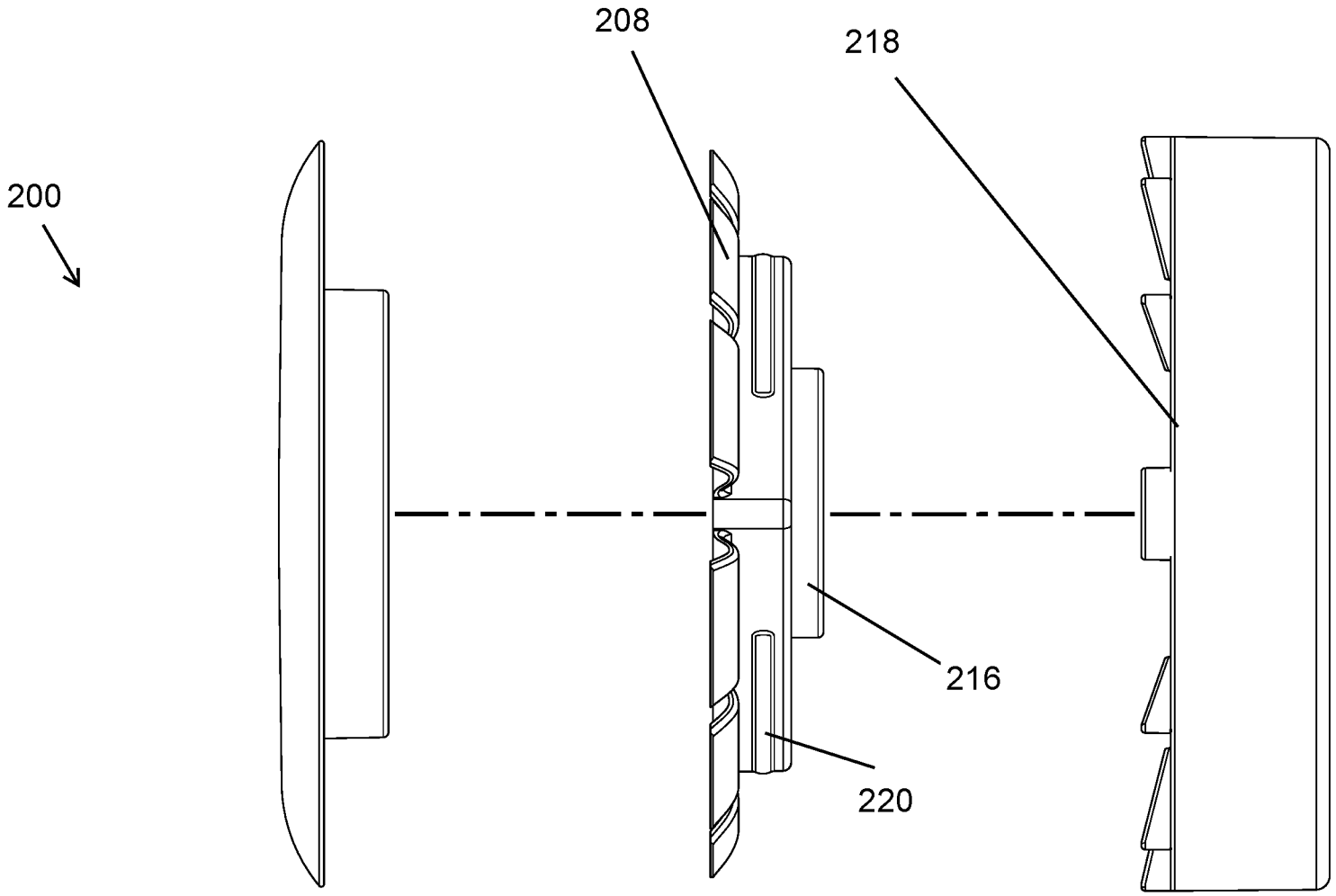
Figure 30:
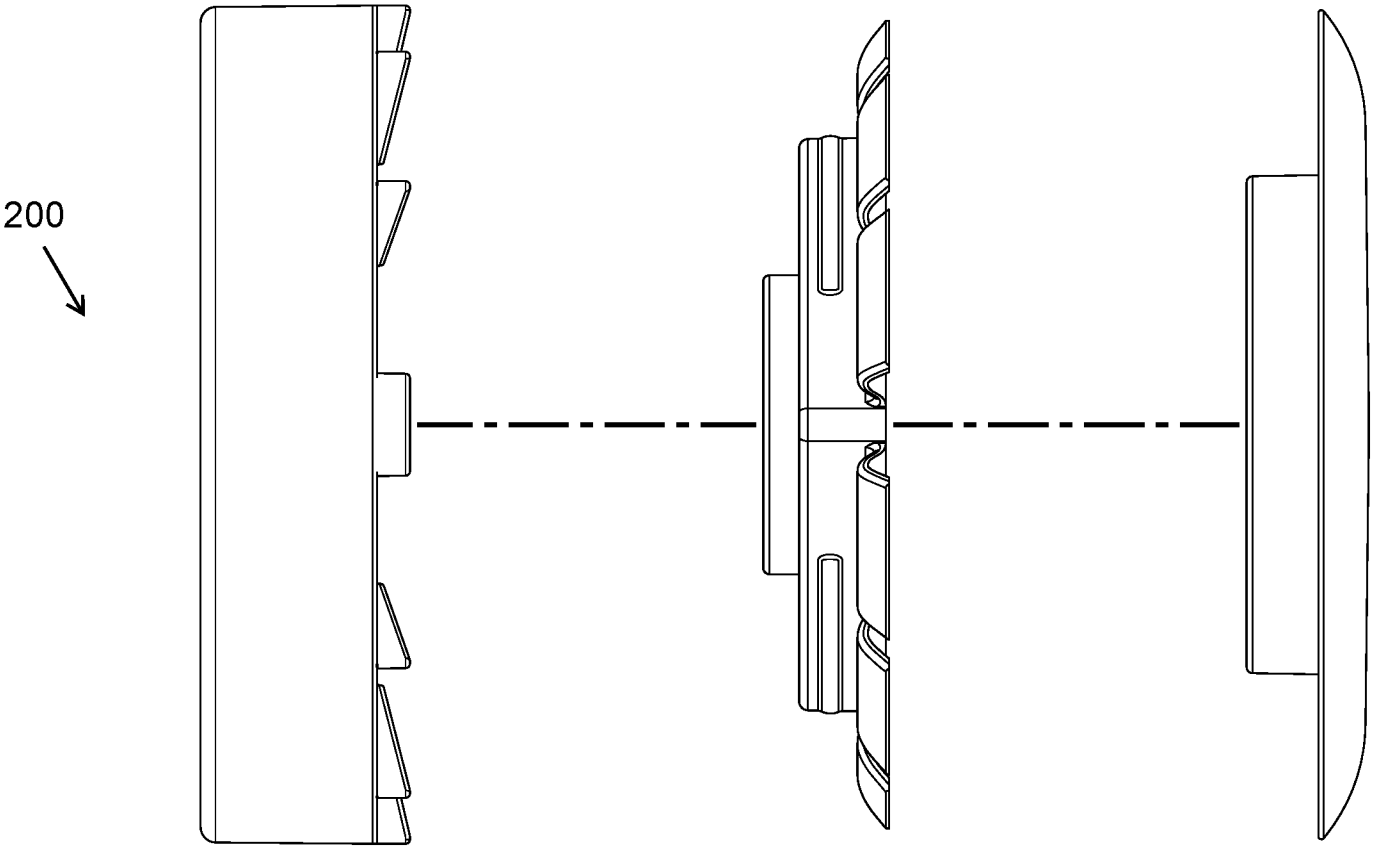
Figure 31:
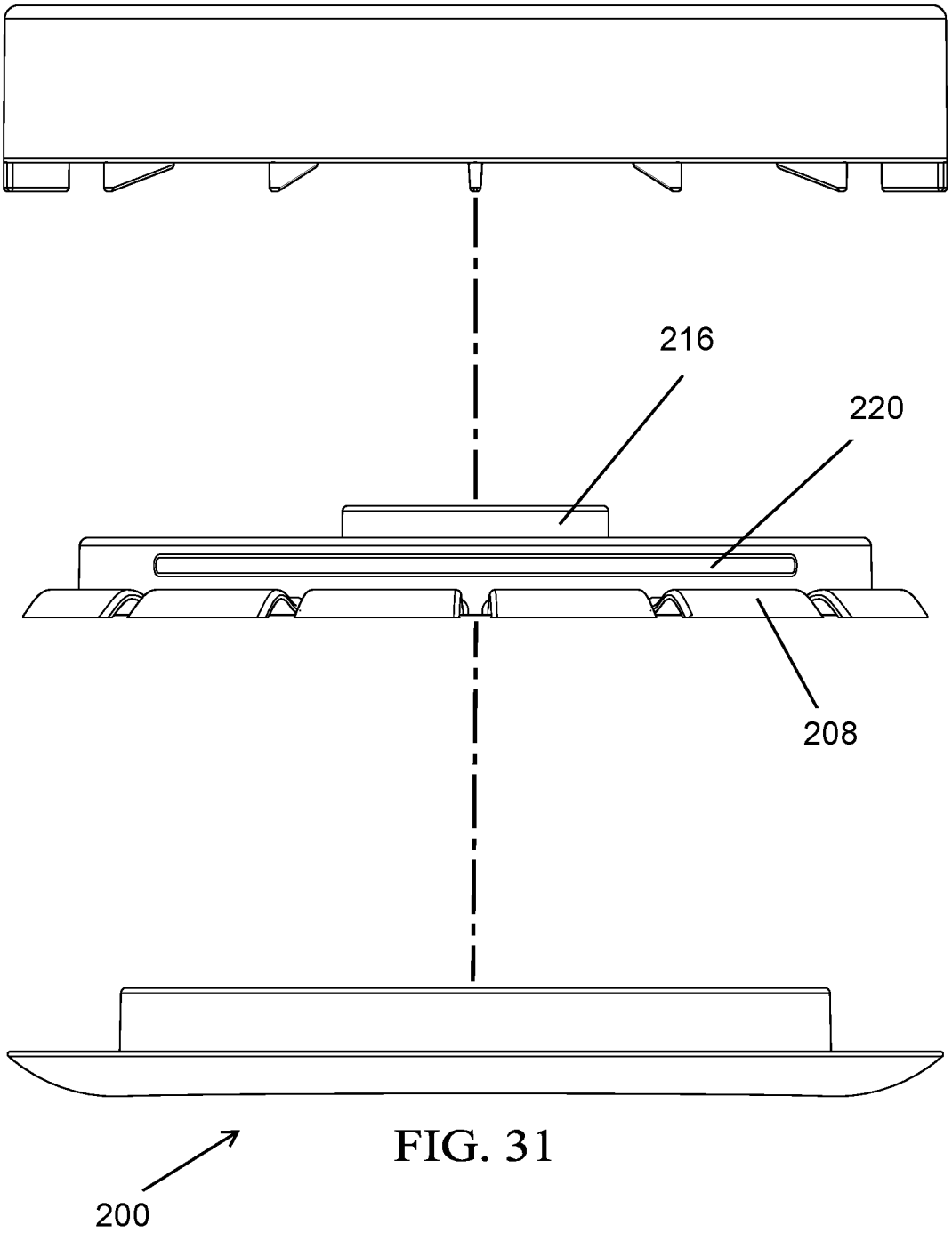
Figure 32:
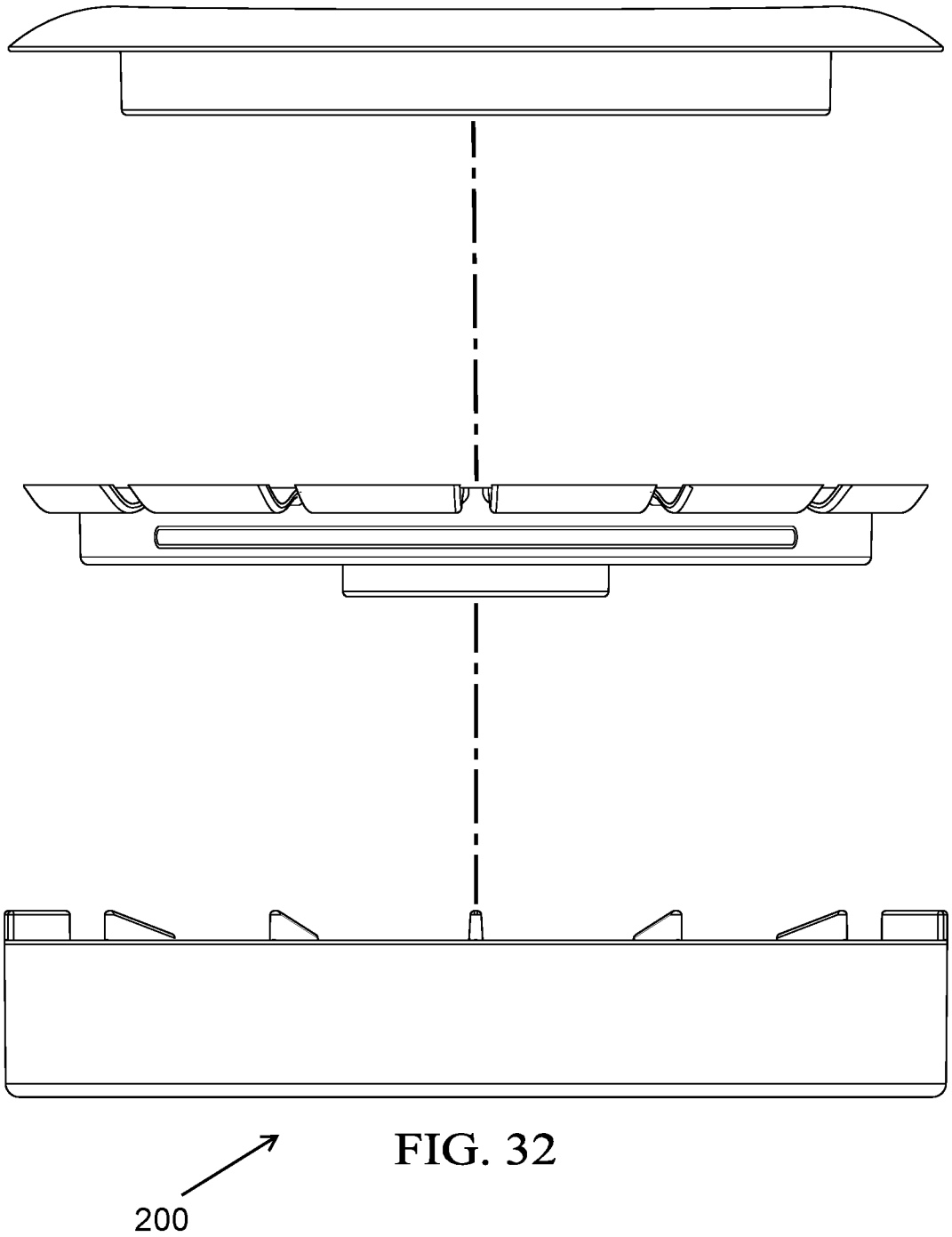
Figure 33:
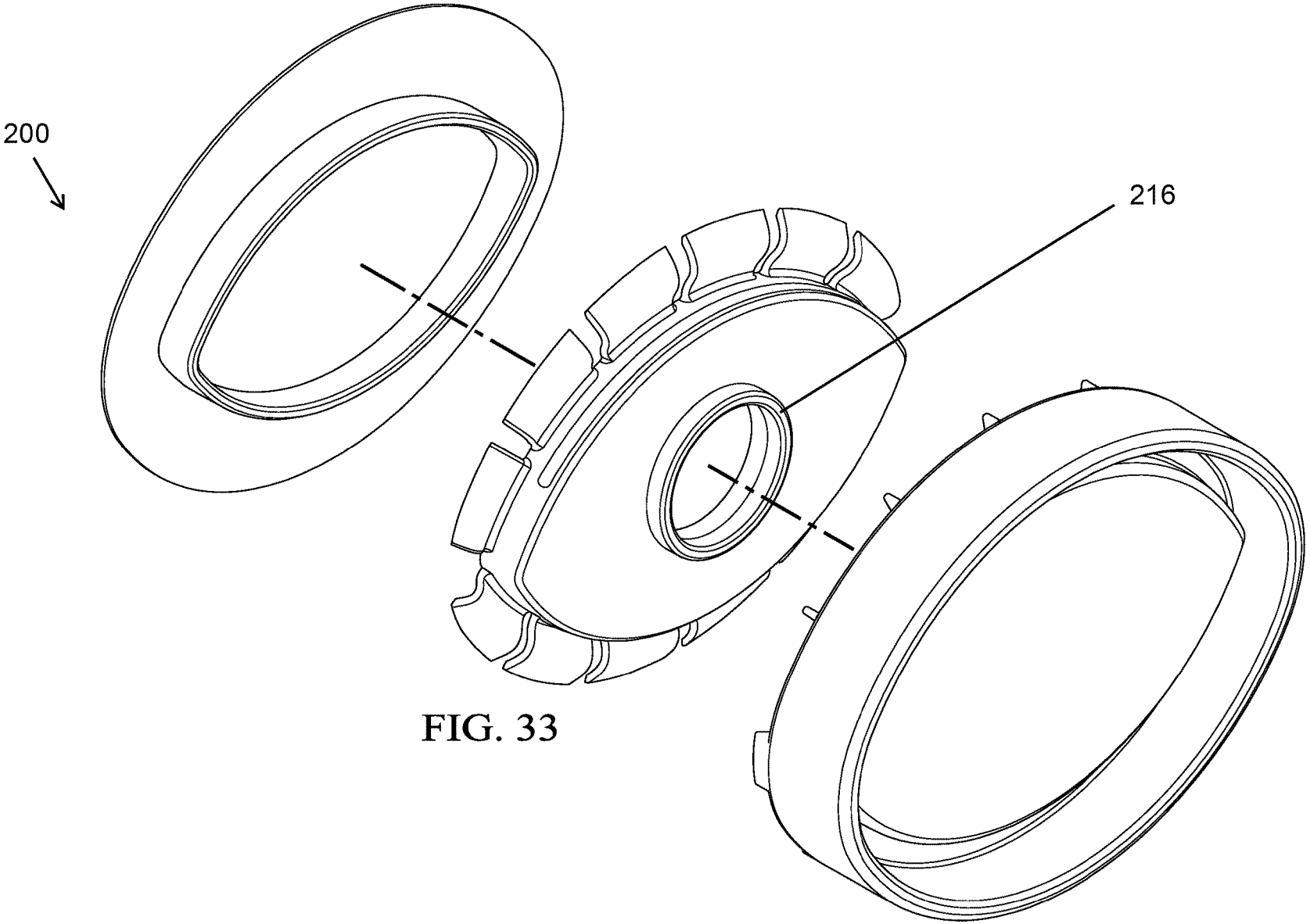

FIGS. 1-6 show an embodiment of a case for hosting a plurality of artificial lash extensions according to this disclosure. FIG. 7 shows an embodiment of a lid hosting a visual indicia thereon according to this disclosure. FIG. 8 shows an embodiment of a lid and a body according to this disclosure. FIG. 9 shows an embodiment of a gasket and an inclined floor according to this disclosure. In particular, a case 100 has a lid 102 and a body, housing, or pedestal 104.

The lid 102 includes plastic, but can include other materials, such as metal, rubber, wood, foam, or others. The lid 102 is opaque, but can be transparent or translucent. The lid 102 is eye-shaped, although other shapes are possible, whether open-shape or closed-shape, whether symmetrical or asymmetrical, such as a circle, square, rectangle, pentagon, octagon, triangle, trapezoid, or any other polygonal shape. The lid 102 sits or rests on the body, which can be securely, such as via mating, fastening, interlocking, adhering, magnetizing, hook-and-looping, or others.

The lid 102 has an outer side 106 that can host various visual indicia 108 thereon, such as a brand indicia, an orientation indicia, a type or sub-type of artificial lash extension or others. The visual indicia 108 can include alphanumerics and images, whether adhered, stamped, engraved, embossed, holographic, barcode, QR code, augmented reality marker, or others. For example, a kit, a package, a container, an envelope, a box, an intermodal container, or a system can include a plurality of artificial lash extension types 1 10 each of which can be solely hosted in the case 100 and the lid 102 of the case 100 can host a visual indicia 108 of type of artificial lash extension 1 10 or others (e g., B.12 or A.14 or C.10). The outer side 106 hosts an inward central dimple 112, although a flat surface or a central or offset bump or offset inward dimple is possible. The inward central dimple 1 12 can host the visual indicia 108.

The body 104 includes plastic, but can include other materials, such as metal, rubber, wood, foam, or others. The body 104 is translucent, but can be opaque or transparent. The body 104 is configured to support the lid 102, which can be securely, such as via mating, fastening, interlocking, adhering, magnetizing, hook-and-looping, or others. The body 104 is internally structured to accommodate for the central inward dimple 1 12 of the lid 102.

The body 104 has an outer sidewall 114 with an outer side that is longitudinally eye-shaped, although other shapes are possible, whether open-shape or closed-shape, whether symmetrical or asymmetrical, such as a circle, square, rectangle, pentagon, octagon, triangle, trapezoid, or any other polygonal shape. The outer sidewall 114 hosts a plurality of vertical partitions 1 16 that define a plurality of storage slots 1 18 (e.g., ledges) structured for storing the artificial lash extensions 110, such as in a one-to-one correspondence, although other types of correspondences are possible, such as one storage slot 1 18 for at least two artificial lash extensions 110 stacked one on top of another or positioned side-by-side in any orientation. At least one of the vertical partitions 116 can have a top surface that is level or inclined, whether inwardly or outwardly. For example, at least one of the vertical partitions 116 can be square, rectangular, oval, arcuate, triangular, pyramidal, dome, wedged, or another shape.

Figure 1:
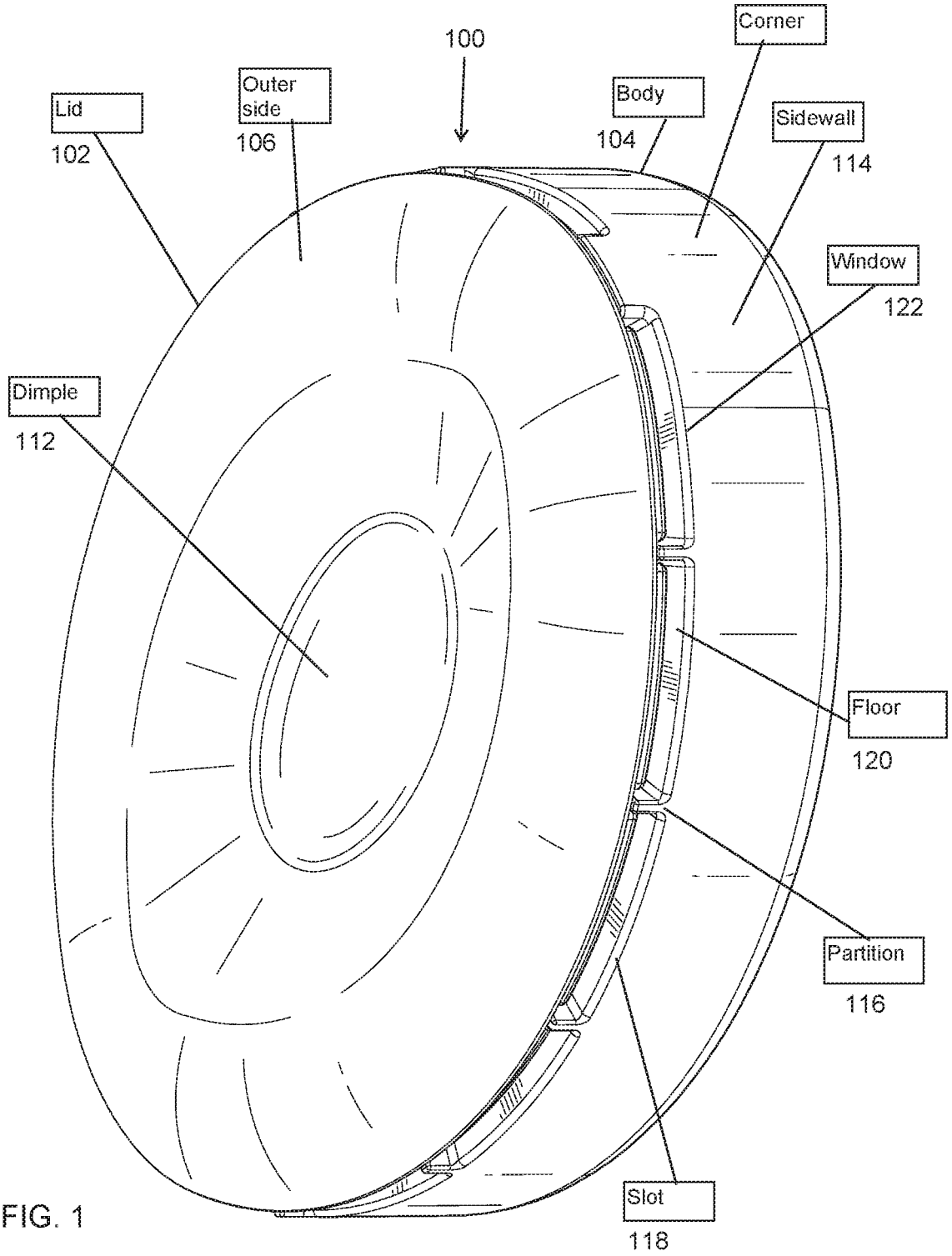
FIGS. 1-6 show an embodiment of a case for hosting a plurality of artificial lash extensions according to this disclosure.
Figure 2:
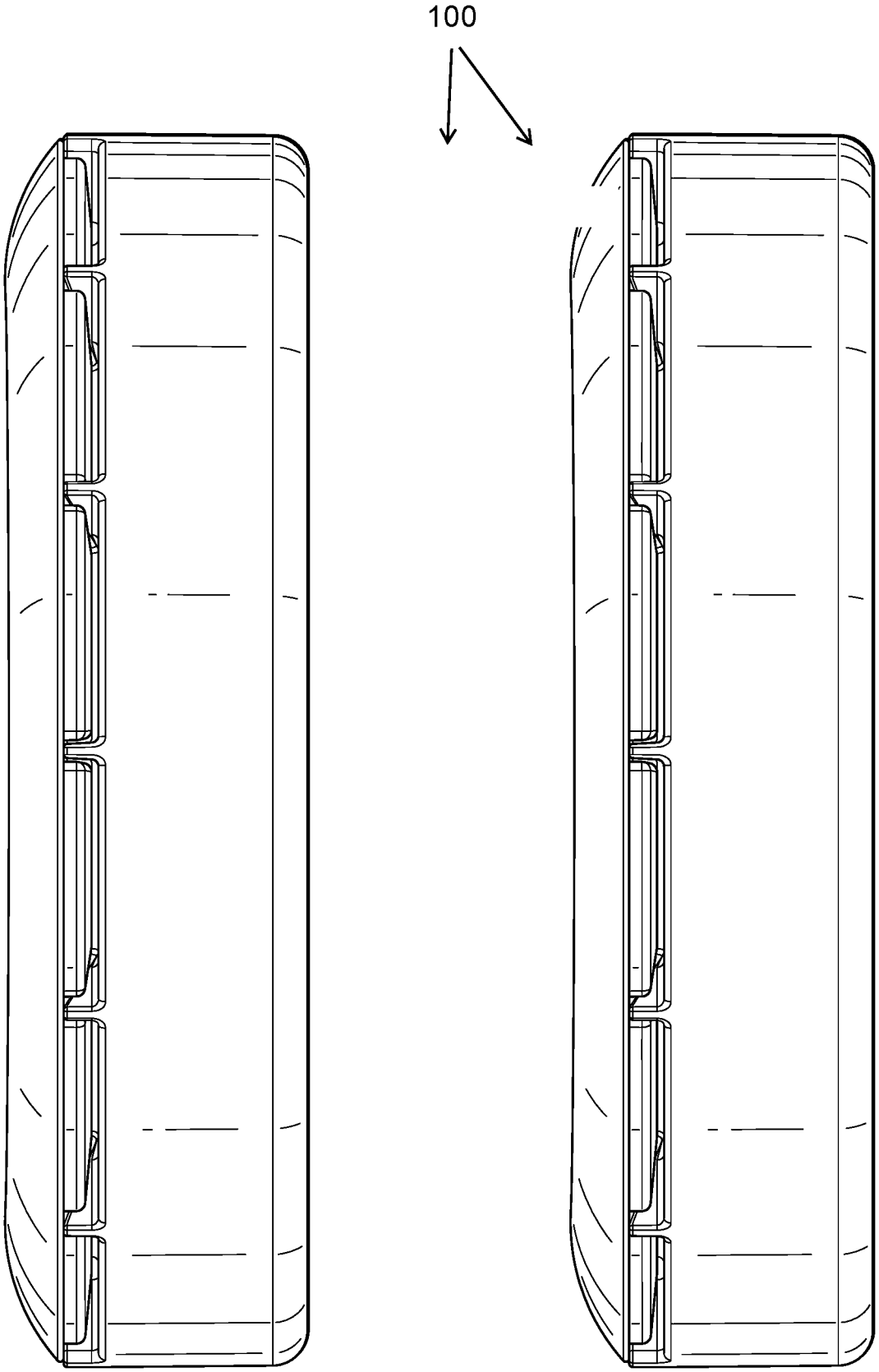
Figure 3:
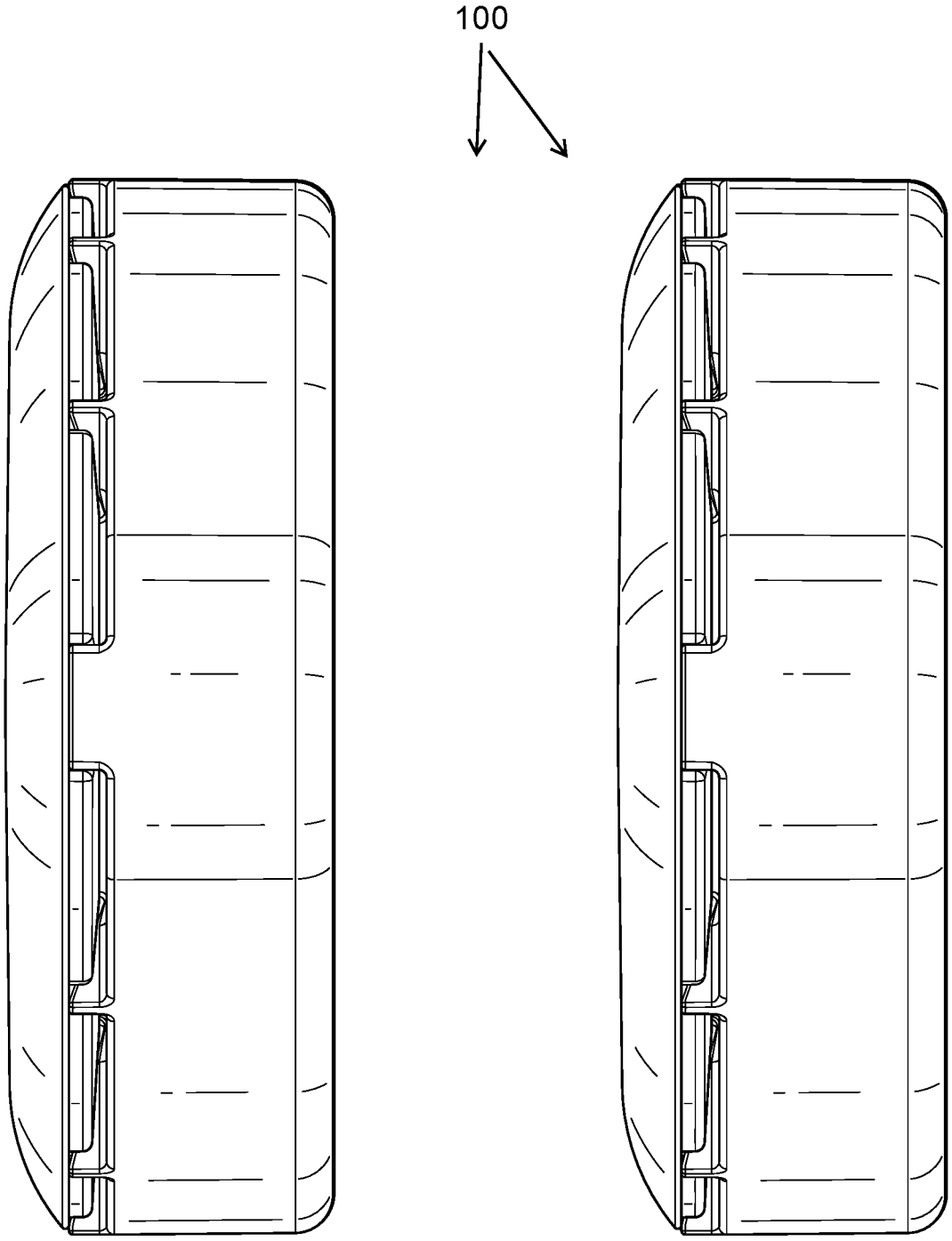
Figure 4:
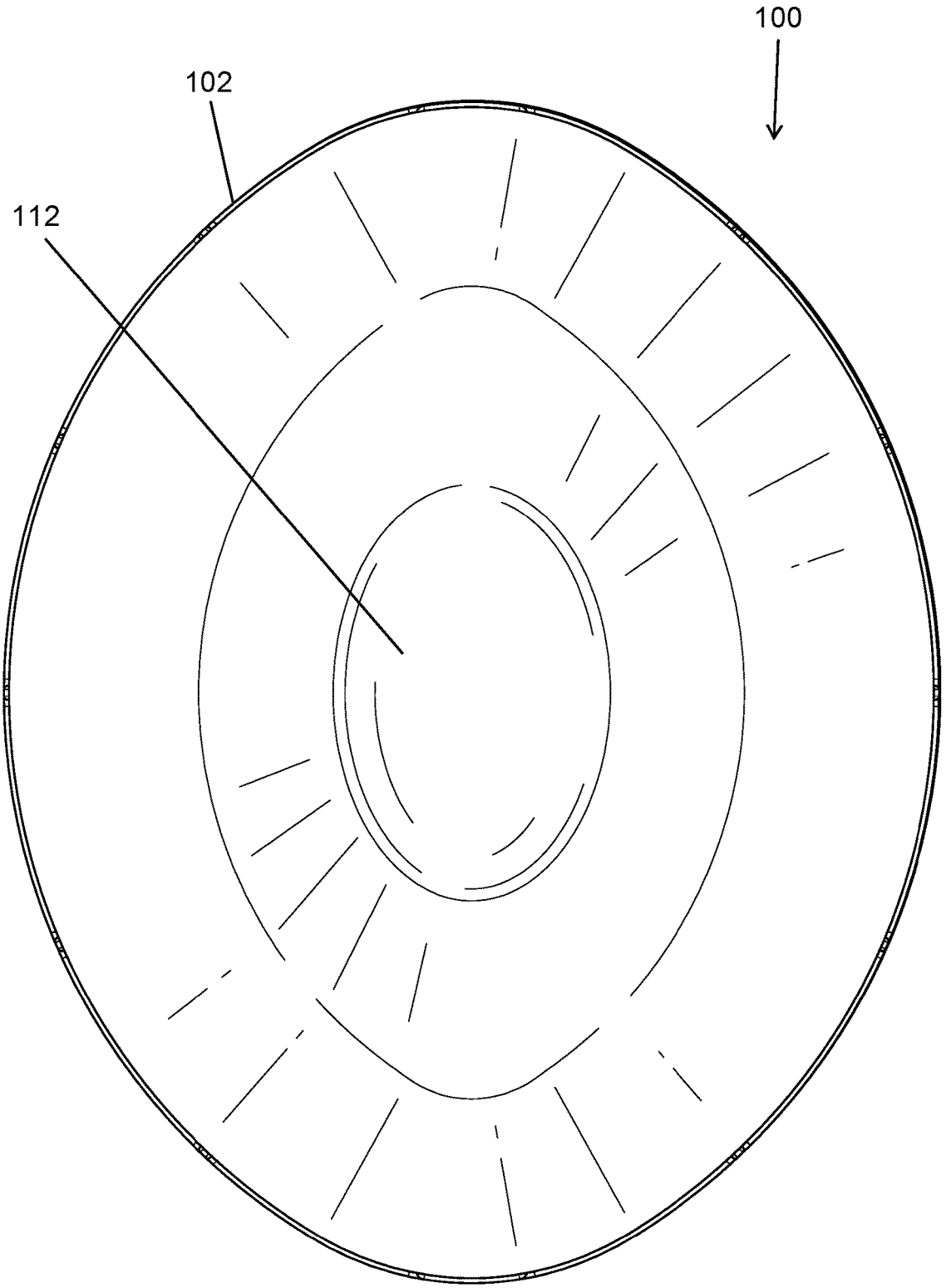
Figure 5:
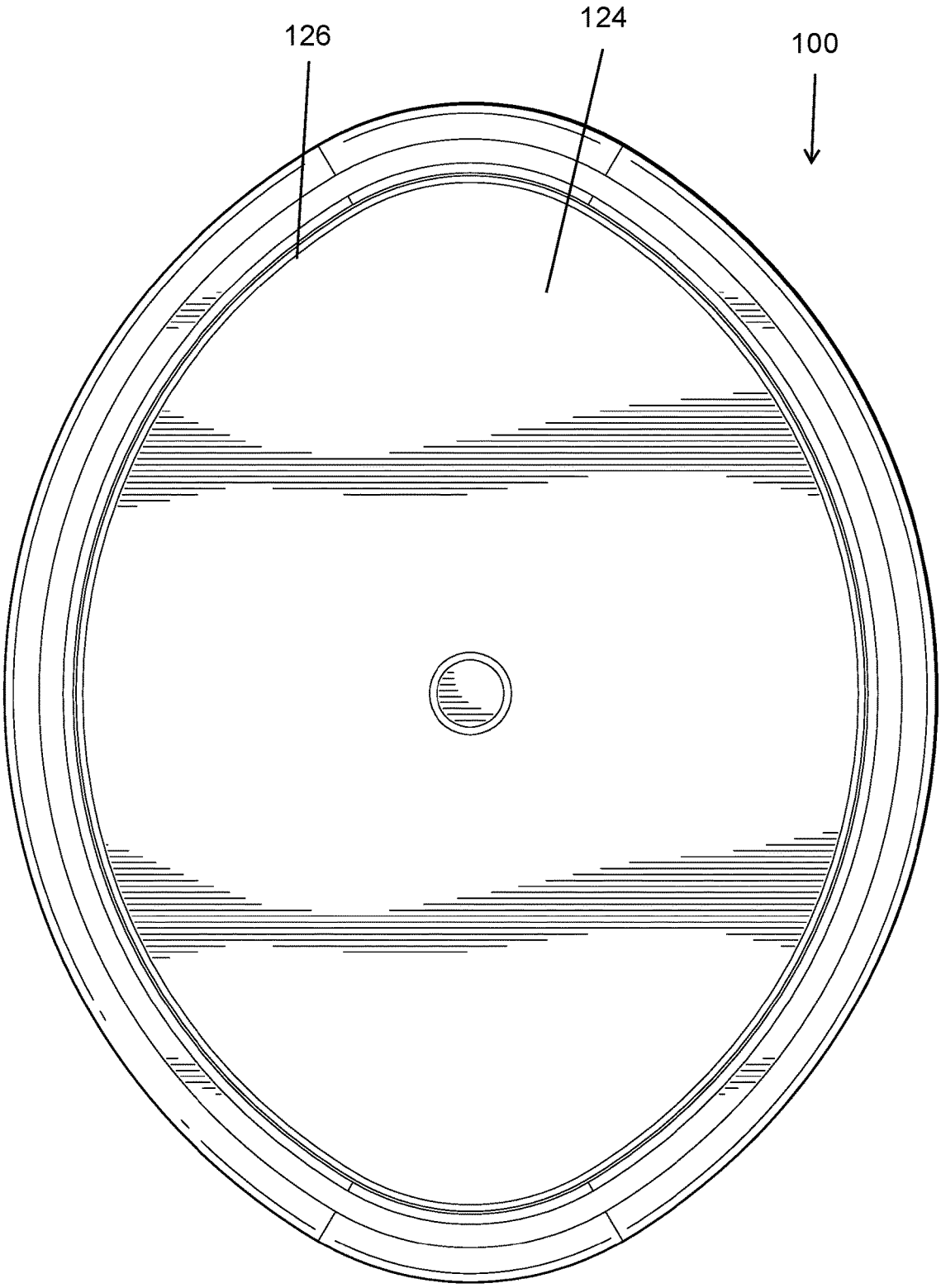
Figure 6:
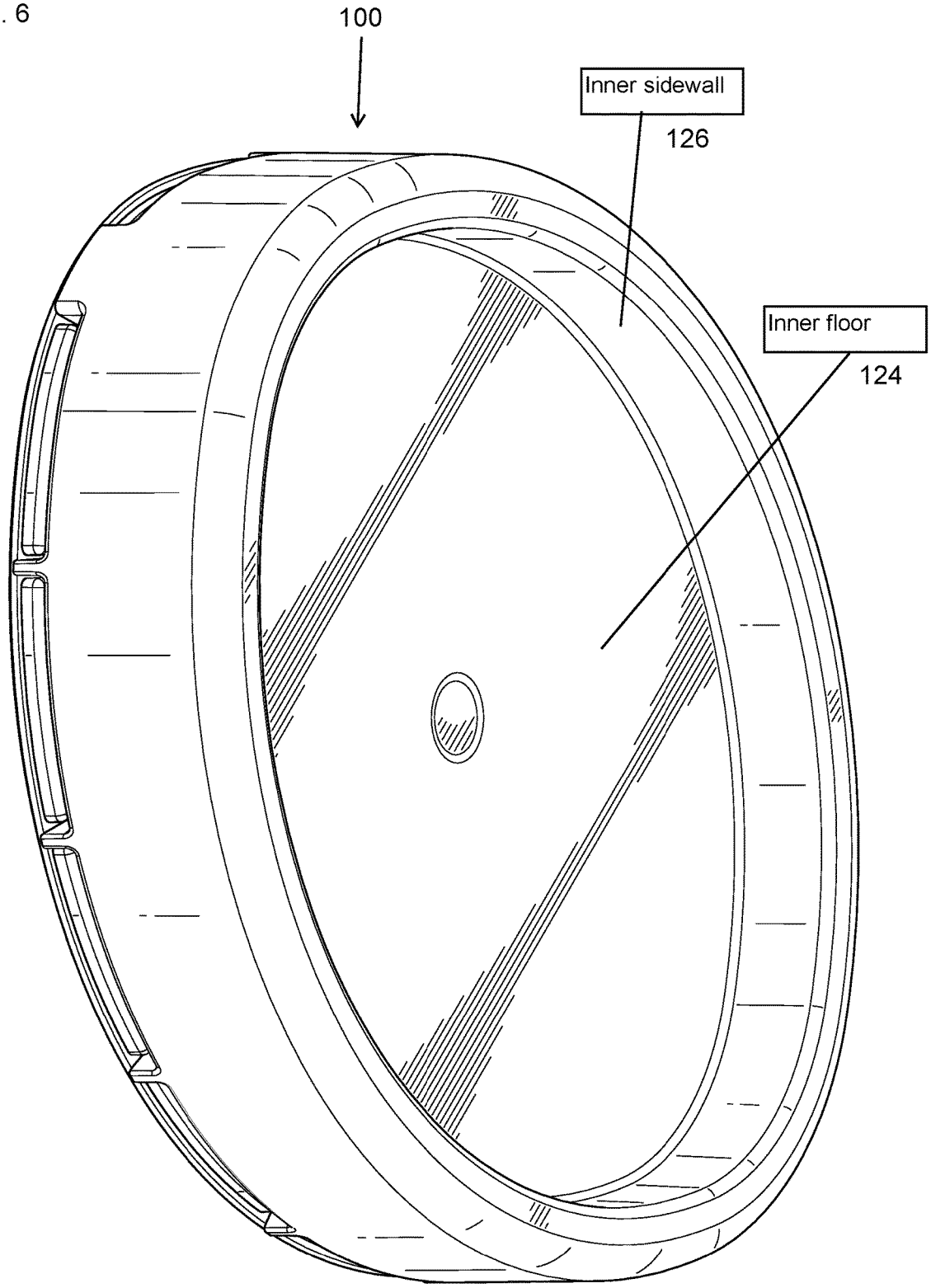

Each of the slots 1 18 has a floor 120 extending between a pair of vertical partitions 116 such that a U-shaped or C-shaped or V-shaped or W-shaped area is defined (e.g., at least one of the vertical partitions 1 16 can be acute, obtuse or perpendicular relative to the floor 120). The floor 120 extends up to an outer side of an inner sidewall 126, which contacts (e.g., at a perpendicular, acute, obtuse angle) an inner central floor 124 that faces the inward projection of the inward central dimple 112, as shown in FIG. 8. Note that the inner floor 124 can be lacking as well such that the inward projection of the inward central dimple 112 is exposed. The outer side of the inner sidewall 126 is longitudinally eye-shaped, as shown in FIGS. 5 and 8, although other shapes are possible, whether open-shape or closed-shape, whether symmetrical or asymmetrical, such as a circle, square, rectangle, pentagon, octagon, triangle, trapezoid, or any other polygonal shape. For example, at least one of the slots 1 18 can have a trapezoidal, square, or rectangular area. The outer side of the inner sidewall 126 structurally extends mimicking the outer side of the outer sidewall 1 14. The inner sidewall 126 defines an internal area into which the central inward dimple 1 12 of the lid 102 projects. The internal area can be used for storage, such as of a fluid, a gel, a powder, a physical item, or others. The floor 120 may or may not be coated with a friction enhancing or reducing coating. For example, the friction enhancing coating can be rubber. For example, the friction reducing coating can be polytetrafluoroethylene (PTFE), silicon, or others.

The floor 120 can be level or inclined relative to the outer sidewall 114, whether inward or outward (e.g., the floor 120 can be acute, obtuse or perpendicular relative to the outer sidewall 1 14). As shown in FIG. 9, this incline can be less than about 90 degrees, less than about 75 degrees, less than about 60 degrees, less than about 50 degrees, less than about 45 degrees, less than about 30 degrees, less than about 15 degrees, less than about 10 degrees, less than about 7 degrees, less than about 5 degrees, less than about 3 degrees, or others including any intermediate values. For example, when the floor 120 is acutely inclined inward toward the center of the case 100 at or less than about 30 degrees relative to the outside sidewall 1 14, then the artificial lash extension 110 stored therein can be propped up or angled upwards and less likely to fall out during use, such as transport of the case.

The floor 120 can be smooth or rough. For example, the floor 120 can be textured (e.g., parallel lines, intersecting lines) to reduce artificial lash extension 1 10 movement during use, such as transport of the case 100. The floor 120 can be textured in various ways, such as knurled, hatched, spiked, bumped, or others, whether inward or outward. The floor 120 can be grooved or ridged. For example, the floor 120 can host a plurality of longitudinal projections radially or non-radially projecting outwards (e.g., like rays of sun) toward the outer sidewall 1 14. For example, the floor 120 can host at least two parallel or non-parallel, rectilinear or non-rectilinear, continuous or discontinuous projections, which can have a U-shaped, C-shaped, D-shaped, B-shaped, W-shaped, V-shaped, or any other shaped projections.

The slots 1 18 can be equivalent or non-equivalent in volume when the lid 102 is positioned on the body 104 or vice versa. The slots 118 can have identical or nonidentical window shape and/or size 122 when the lid 102 is positioned on the body 104 (e.g., vary in length or height). The slots 1 18 can reduce or not reduce in volume or area or window shape 122 as the slots 1 18 get closer to corners of the body 104 (e.g., artificial lash extensions 110 can vary in length or width or thickness at center relative to those at corners or artificial lash extensions 1 10 can be mixed and matched by users). The slots 118 can store an identically sized or structured artificial lash extensions 110, which can be or avoid being of same type. The slots 1 18 can store non-identically sized or structured artificial lash extensions 1 10, which may or may not be of same type. For example, the case 100 can store an identically sized or structured artificial lash extensions 110 (e.g., specific artificial lash extension type or identical in length of hairs extending from base or length of base or number of hair clusters per base or hair thickness). For example, a fused bundle of hairs can be between about 30 to about 40 hairs, which can be between about 30-35, which can be between about 31-33.

When the lid 102 is secured onto the body 104 and the slots 118 contain the artificial lash extensions 1 10, the lid 102 and the body 104 structurally cooperate not to apply undue pressure onto the artificial lash extensions 110 (e.g., protect the curls of the artificial lash extensions 1 10 and minimize downward pressure from the lid 102) yet structurally cooperate so that the artificial lash extensions 1 10 do not fall out from the case 100.

FIG. 8 shows an example of the case 100 being open, with the case 100 having the lid 102 and the body 104 detached from each other, as described herein. The lid 102 is opaque, but can be transparent or translucent. The lid 102 has an inner side (e.g., underside) that hosts a central outwardly protruding area 128 that corresponds to the central inwardly protruding dimple 1 12, as described herein. The central outwardly protruding area 128 centrally hosts the visual indicia 108 corresponding to a type of artificial lash extensions that are stored in this case 100, as described herein. Note that the visual indicia 108 can be non-centrally hosted as well. The central outwardly protruding area 126 can also be non-protruding, such as flat or inwardly dimpled.

The central outwardly protruding area 128 is surrounded by a wall 130 (e.g., continuous, discontinuous, solid, perforated) that extends from the inner side (e.g., perpendicularly, acutely, obtusely) of the lid 102. The wall 130 is longitudinally eye shaped, although other shapes are possible, whether open-shape or closed-shape, whether symmetrical or asymmetrical, such as a circle, square, rectangle, pentagon, octagon, triangle, trapezoid, or any other polygonal shape.

The wall 130 may be surrounded by an elastic band 132, although a resilient, flexible, deformable, bendable, or non-rigid member is possible. The elastic band 132 may function as a gasket against the artificial lash extensions 110, as explained herein. The elastic band 132 can include rubber or foam or plastic, but other materials are possible, such as an inflatable balloon or a tubular container containing a fluid (e.g., liquid or gas) or sand or powder or beads/spheres (e.g., rigid or flexible or resilient) or others. The elastic band 132 is longitudinally continuous along the perimeter of the wall 130. However, the elastic band 132 can be a plurality of elastic strips spaced apart from each other, such as discontinuous. The elastic band 132 can be shaped as any closed or open shape (e.g., O-shape, C-shape, U-shape, V-shape, J-shape, D-shape, eye-shape, circle, square, triangle, pentagon, hexagon, octagon, polygon, symmetrical, asymmetrical, oval, ellipse, ovoid). The elastic band 132 can be generally closed shaped, but specifically shapeless (e.g., dynamically changed depending on how held) before mounting over the wall 130 and then specifically shaped when mounted over the wall 130 to shapely correspond to the wall 130. The elastic band 132 can be specifically shaped before mounting over the wall 130 to correspond to the shape of the wall 130. The elastic band 132 can remain in place via elastic friction or inward pressure against the wall 130. The elastic band 132 can be attached or secured to the inner side (e.g., adhering, bonding, mating, hooking, fastening, interlocking, bracketing). The elastic band 132 can be or avoid being visually distinct from the lid 102 (e.g., color, hatching, patterns).

The inner side of the lid 102 hosts a plurality of protrusions 134 longitudinally spaced apart from each other and longitudinally extending around the elastic band 132. The protrusions 134 extend outwardly from the inner side of the lid 102 such that a plurality of hollow receiving portions 144 (e.g., U-shape, V-shape, C-shape) are defined therebetween. However, at both apexes of the inner side of the lid 102, the protrusions 134 define a pair of lift grooves 136 or open spaces (e.g., triangular, V-shaped, trapezoidal) therebetween, which can help in removing the lid 102 from the body 104 or vice versa (e.g., form a grasping area to apply a separation force). The protrusions 134 are unitary with the inner side of the lid 102 (e.g., molded, 3D printed, cast, stamped, routed) and include same material (e.g., plastic, rubber, metal). However, the protrusions 134 can also be attached to the inner side of the lid 102 (e.g., adhering, magnetizing, fastening, interlocking, mating, bonding).

The protrusions 134 can be identical or non-identical to each other in shape or volume per longitudinal side. The protrusions 134 are shaped as blocks (e.g., trapezoidal, cuboid, conical, D-shaped), whether symmetrical or asymmetrical. The protrusions 134 can change in volume or shape per longitudinal side (e.g., protrusions 134 closer to corners are smaller in volume or shape relative to protrusions 134 further from corners).

At least one of the protrusions 134 has an outer side that faces and contacts an artificial lash extension 1 10 when the lid 102 is positioned on the body 104 or vice versa and the body 104 stores the artificial lash extension 110 in the slot 118. This side has a rough area 138 proximal to the elastic band 132 and a smooth area 140 distal to the elastic band 132. The rough area 138 and the smooth area 140 are immediately adjacent to each other, although the rough area 138 and the smooth area 140 can be separated by an intermediate area. The rough area 138 can be coated with a friction enhancing material (e.g., rubber, plastic, foam) or include a textured portion (e.g., parallel lines, intersecting lines) to help in limiting movement of the artificial lash extension 1 10 in the slot 118 or from the slot 1 18 when the rough area 138 contacts the artificial lash extension 110 in the slot 118. The textured portion can be textured in various ways, such as knurled, hatched, spiked, bumped, or others, whether inward or outward. However, note that this side of the protrusion 134 can also lack the smooth area 140 or the rough area 138.

The body 104 includes the inner floor section 124 (e.g., flat, inwardly depressed, outwardly projected) that faces the protruding area 128 of the lid 102. However, the inner floor section 124 can be lacking as well. The inner floor section 124 is opaque, but can be transparent or translucent. The inner floor section 124 is surrounded by the wall 126 from which the partitions 1 16 extend radially and thereby define the slots 1 18 storing the artificial lash extensions 1 10 therein. The wall 126 has a pair of apex partitions 140 (e.g., triangular, V-shaped, trapezoid) that correspond to the lift grooves 136 of the lid 102 or vice versa.

When the case 100 is closed, the body 104 stores the artificial lash extensions 110 in the slots 1 18 between the partitions 1 16 and the lid 102 sits or rests on the body 104, which can be securely positioned, as described herein. During such state, the inner wall 130 of the lid 102 is concentrically engaged with the inner wall 126 of the body 104 (e.g., the inner wall 126 of body 104 is concentrically positioned between the elastic band 132 and the inner wall 130 of the lid 102). The partitions 1 16 of the body are received in the receiving portions 144. The lift grooves 136 face the apex partitions 142. The protrusions 134 face the slots 118 and contact the artificial lash extensions 110, which can be via the rough areas 138 of the inner sides to frictionally engage the artificial lash extensions 110, while ensuring that the artificial lash extensions 110 do not fall out from the slots 1 18, yet avoid applying or exerting undue pressure onto the artificial lash extensions 110, based on the elastic band 132 dynamically or resiliently or deformably flexing (e.g., like a gasket or a dynamic barrier), especially when the artificial lash extensions 110 are of different types (e.g., vary by length, width, thickness, hair material) or when the artificial lash extensions 1 10 are not of same type per longitudinal side of the body 104 (e.g., artificial lash extensions proximal 110 to corners differ relative to artificial lash extensions 100 distal from corners). Note that the elastic band 132 can be absent, but the lid 102 is then structured (e.g., angled floors 120 for sufficient clearance between the lid 102 and the artificial lash extensions 1 10) to avoid applying or exerting undue pressure onto the artificial lash extensions 110, while ensuring that the artificial lash extensions 110 do not fall out from the slots 118. In an embodiment, an adhesive or friction coating, for example, may be disposed on the floor 120 to help prevent the artificial lash extensions 1 10 from falling out of the slots 118. The amount and type of adhesive, of course, may be such that the artificial lash extensions 110 are not damaged when removed from the slots 1 18.

The case 100 may be partially or entirely composed of metal, plastic, or some other material (e.g., foam). For example, in some embodiments the case 100 includes a die case metal body (e.g., for strength and durability) having a smooth powder coating (e.g., for aesthetics and improved cleanability), while in other embodiments the case 100 includes a recyclable (i.e., disposable) plastic body that is not intended for significant durations of use (e.g., months or years). Those skilled in the art will recognize that any suitable material may be used. For example, in some embodiments plastic may be desirable because it is recyclable and resistant to the adhesives typically applied to lash fusions before fixation to an individual's natural lashes.

Moreover, the outer surfaces of the case 100 may be substantially smooth and continuous. Thus, the outer surfaces of these components may be substantially free of any gaps, ridges, or fasteners that would make cleaning difficult or that may inadvertently capture artificial lashes.

FIGS. 10-33 show an embodiment of a case where a gasket is separate and distinct from a lid and a body according to this disclosure. A case 200 is similar to the case 100 in size and function, but has some notable differences. In particular, the case 200 has the lid 102 and the body 104 being separate and distinct from a gasket 202, as shown in FIGS. 18, 21-26, and 29-33. Further, the inner central floor 124 is spaced apart from the sidewall 114, as shown in FIGS. 12, 17, 20, 25, 28, and 33, which can be beneficial from usage of less material. Also, the gasket 202 mates with the body 104 or vice versa, as shown in FIGS. 18, 21-26, and 29-33.

The gasket 202 has a floor 204, a sidewall 206, and a plurality of tabs 208. The floor 202 is monolithic, but can be assembled (e.g., puzzle, mated, interlocked, adhered, magnetized, fastened). The sidewall 206 is monolithic, but can be assembled (e g., puzzle, mated, interlocked, adhered, magnetized, fastened). At least one of the tabs 208 is monolithic, but can be assembled (e.g., puzzle, mated, interlocked, adhered, magnetized, fastened). At least one of the floor 204, the sidewall 206, or at least one of the tabs 208 includes plastic, metal, rubber, foam, alloy, wood, or others. The tabs 208 should be flexible or deformable to maintain lash extensions in the slot 1 18, as further provided herein.

The floor 204 is eye-shaped, but can be shaped differently, whether open-shape or closed-shaped, whether symmetrical or asymmetrical (e.g., square, rectangle, circle, oval, triangle, pentagon, hexagon, octagon, U-shape, C-shape, D-shape). The sidewall 206 extends from the floor 204 such that an internal cavity 210 is defined thereby The sidewall 206 is monolithic with the floor 204, but can be assembled therewith (e.g., fastened, mated, interlocked, magnetized). The sidewall 206 is eye shaped, but can be shaped differently, whether open-shape or closed-shaped, whether symmetrical or asymmetrical (e.g., square, rectangle, circle, oval, triangle, pentagon, hexagon, octagon, U-shape, C-shape, D-shape). As such, the cavity 210 is eye-shaped, but can be shaped differently, whether open-shape or closed-shaped, whether symmetrical or asymmetrical (e.g., square, rectangle, circle, oval, triangle, pentagon, hexagon, octagon, U-shape, C-shape, D-shape). The floor 204 has a central opening 212, but can avoid the central opening 212. The central opening 212 is circular, but can be shaped differently, whether open-shape or closed-shaped, whether symmetrical or asymmetrical (e.g., square, rectangle, circle, oval, triangle, pentagon, hexagon, octagon, U-shape, C-shape, D-shape).

The tabs 208 are spaced apart from each other and radially and cantileveredly extend from the sidewall 206 away from the cavity 210 not over the floor 204 or the cavity 210. For example, at least one of the tabs 208 extends from the sidewall 206 in an L-shaped manner. The tabs 208 can be visible from frontally looking into the windows 122. The tabs 208 are monolithic with the sidewall 206, but can be assembled therewith (e.g., fastened, mated, interlocked, magnetized). The tabs 208 are V-shaped, but can be shaped differently, whether open-shaped or closed-shaped, whether symmetrical or asymmetrical (e.g., I-shaped, L-shaped, U-shaped, C-shaped, W-shaped, M-shaped, D-shaped, S-shaped, J-shape, Y-shaped, P-shaped). For example, since the tabs 208 are V-shaped, each of the tabs 208 has a central apex which can resiliently engage a respective artificial lash extension 1 10 within a respective slot 1 18 to resiliently secure the respective lash extension 110 within the respective slot 118.

As shown in FIGS. 18, 21-26, and 29-33, the gasket 202 can be sandwiched between the lid 102 and the body 104 when the lid 102 is coupled to the body 104 and the artificial lash extensions 1 10 are positioned within the slots 118 and the wall 130 faces, contacts, or engages the floor 204 around the central opening 212, while the floor 204 is positioned between the protruding area 128 of the lid 102 and the floor 124 of the body 104. As such, the tabs 208 extend within the slots 1 18 between the partitions 1 16 over the floors 120 such that the tabs 208 resiliently engage the artificial lash extensions 110 within the slots 1 18, thereby resiliently securing the artificial lash extensions 1 10 within the slots 1 18. Therefore, when a user desires to remove an artificial lash extension 110 from a slot 1 18, whether by hand or via an applicator, as the artificial lash extension 1 10 is resiliently secured within the slot 1 18 via a tab 208, the user can pull the artificial lash extension 1 10 in a direction (e.g., radial, lateral) away from the tab 208 such that the artificial lash extension 110 slides out from the tab 208 and the slot 118. Alternatively or additionally, the user can lift the tab 208 in order to resiliently unsecure the artificial lash extension 1 10 and then pull the artificial lash extension 110 in a direction (e.g., radial, lateral) away from the tab 208 such that the artificial lash extension 1 10 slides out from the slot 118. In an embodiment, the lid 102 may be configured to be pressed against the gasket 202 to cause the gasket 20 to be pushed down so that tabs 208 apply pressure to the lash extensions 1 10 disposed between the tabs 208 and floor 1 18. If the lid 102 is raised, but not removed from the body 104, then pressure to the gasket 202 may be reduced, thereby resulting in less pressure from the tabs 208 onto the lash extensions 1 10.

Although the tabs 208 are shown in a one-to-one correspondence with the slots 1 18, this can vary (e.g., multiple tabs 208 within single slot 1 18). Further, although the tabs 208 are spaced apart from each other thereby defining the tabs 208, this configuration can vary and there can be a single tab 208 per plurality of slots 1 18 (e.g., tabs 208 are not spaced apart from each other thereby defining single tab 208). Additionally, note that the inwardly dimpled portion 126 can be axially co-aligned with the central opening 212 and the male portion 214 (e.g., axis of symmetry, axis of rotation).

When the body 104 has a male portion 214 (e.g., projection, column, pedestal), whether internally hollow or solid, then the gasket 202 can mate with the body 104 via the male portion 214 being inserted, which can also include fastening, into the central opening 212, as shown in FIGS. 18, 21-26, and 29-33, or vice versa. However, a reverse is possible as well, where the gasket 202 has a male portion 216 (e.g., column, pedestal), whether internally solid or hollow) and the body 104 has a central opening 218. As such, the gasket 202 can mate with the body 104 via the male portion 216 being inserted, which can include fastening, into the central opening 218, as shown in FIGS. 18, 21-26, and 29-33, or vice versa. Note that the opening 212 or the opening 218 can be non-central as well. As such, the male portion 214 or 216 can be non-central as well.

The gasket 202 can snugly or non-snugly rest within the body 104. As shown in FIGS. 18, 21-26, and 29-33, the sidewall 206 hosts a plurality of mating portions 220. As such, if the mating portions 220 are male (e.g., projection, column, pedestal), then the inner side of the wall 126 has a plurality of female portions 222 (e.g., depressions, openings) that can mate with the mating portions 220. Conversely, if the mating portions 220 are female (e.g., depressions, openings), then the inner side of the wall 126 has a plurality of male portions (e.g., projection, column, pedestal) that can mate with the mating portions 220. As such, this enables the gasket 202 to snugly rest within the body 104. For example, the gasket 202 can snap fit into the body 104 or vice versa. However, if the mating portions 220 are absent, then the gasket 202 can non-snugly (e.g., freely) rest within the body 104. Further, note that due to shaping of the body 104 and the gasket 202, the gasket 202 can still be snug within the body 104. For example, due to eye-shaping of the gasket 202 and the body 104, the gasket 202 can still remain snug and not be able to rotate within the body 104 unless the gasket 202 is removed from the body 104 and then be rotated and then be inserted back. Note that the mating portion 220 can be spaced apart from each other or the mating portions 220 can avoid being spaced apart from each other such that a single mating portion 220 is defined. In an embodiment, the gasket 202 may be part of or connected to the lid 102 so that the case is formed of two or effectively two components (i.e., the body 104 and lid/gasket 102/202).

One embodiment of a method of manufacturing a case for carrying artificial eyelash extensions may include providing a lid, providing a gasket, and providing a body. The lid may be coupled to the body such that the body and the lid define a window The gasket may be coupled to either the lid or the body between the lid and the body, where the window may be configured to enable a lash extension having a base and a plurality of hairs that extend out of the window as the gasket resiliently contacts the base or the hairs.

This disclosure is was described with reference to FIGS. 1-33, in which some embodiments of this disclosure are shown. This disclosure may, however, be embodied in many different forms and should not be construed as necessarily being limited to the embodiments disclosed herein. Rather, these embodiments are provided so that this disclosure is thorough and complete, and fully conveys various concepts of this disclosure to skilled artisans.

Various terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

As used herein, a term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances.

Although the terms first, second, etc. can be used herein to describe various elements, components, regions, layers and/or sections, these elements, components, regions, layers and/or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from the teachings of the present disclosure.

Furthermore, relative terms such as "below," "lower," "above," and "upper" can be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings were turned over, then the elements described as being on the "lower" side of other elements would then be oriented on "upper" sides of the other elements. Similarly, if the device in one of the figures were turned over, elements described as "below" or "beneath" other elements would then be oriented "above" the other elements. Therefore, the example terms "below" and "lower" can encompass both an orientation of above and below.

The terminology used herein is for describing particular example embodiments and is not intended to be necessarily limiting of the present disclosure. As used herein, the singular forms "a," "an" and "the" are intended to include the plural forms as well, unless the context clearly indicates otherwise. Also, as used herein, the term "a" and/or "an" shall mean "one or more," even though the phrase "one or more" is also used herein. The terms "comprises," "includes" and/or "comprising," "including" when used in this specification, specify the presence of stated features, integers, steps, operations, elements, and/or components, but do not preclude the presence and/or addition of one or more other features, integers, steps, operations, elements, components, and/or groups thereof. Furthermore, when the present disclosure states herein that something is "based on" something else, then such statement refers to a basis which may be based on one or more other things as well. In other words, unless expressly indicated otherwise, as used herein "based on" inclusively means "based at least in part on" or "based at least partially on."

Features described with respect to certain example embodiments may be combined and sub-combined in and/or with various other example embodiments. Also, different aspects and/or elements of example embodiments, as disclosed herein, may be combined and sub-combined in a similar manner as well. Further, some example embodiments, whether individually and/or collectively, may be components of a larger system, wherein other procedures may take precedence over and/or otherwise modify their application. Additionally, a number of steps may be required before, after, and/or concurrently with example embodiments, as disclosed herein. Note that any and/or all methods and/or processes, at least as disclosed herein, can be at least partially performed via at least one entity in any manner.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (30) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, a gemstone, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical to and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

As used herein, the term "about" and/or "substantially" refers to a +/−10% variation from the nominal value/term. Such variation is always included in any given value/term provided herein, whether or not such variation is specifically referred thereto.

If any disclosures are incorporated herein by reference and such disclosures conflict in part and/or in whole with the present disclosure, then to the extent of conflict, and/or broader disclosure, and/or broader definition of terms, the present disclosure controls. If such disclosures conflict in part and/or in whole with one another, then to the extent of conflict, the later-dated disclosure controls.

Although preferred embodiments have been depicted and described in detail herein, skilled artisans can make various modifications, additions, substitutions and the like can be made without departing from this disclosure, and these are, therefore, considered to be within scope of this disclosure, as claimed.

What is claimed is:

1. A case for storing artificial lash extensions comprising:

a body comprising:

a first outer sidewall having first curved surface; and a first plurality of storage slots extending inward from the first curved surface of the first outer sidewall, wherein each of the first plurality of storage slots comprises a first floor that extends inward from the first curved surface; and a gasket configured to releasably hold the artificial lash extensions in the first plurality of storage slots.

2. The case of claim 1, wherein the body further comprises:

a second outer sidewall opposite the first outer sidewall, the second outer sidewall having a second curved surface; and a second plurality of storage slots extending inward from the second curved surface of the second outer sidewall, wherein each the second plurality of storage slots comprises a second floor that extends inward from the respective curved surface, and wherein the gasket configured to releasably hold the artificial lash extensions in the second plurality of storage slots.

3. The case of claim 2, wherein the first plurality of storage slots and the second plurality of storage slots are configured such that the artificial lash extensions at least in part extend within respective storage slots.

4. The case of claim 3, wherein the first plurality of storage slots and the second plurality of storage slots are configured such that the artificial lash extensions extend entirely within respective storage slots.

5. The case of claim 2, wherein the body further comprises:

a first plurality of partitions that define the first plurality of storage slots; and a second plurality of partitions that define the second plurality of storage slots.

6. The case of claim 5, wherein a plurality of tabs of the gasket are configured to extend within respective ones of the first plurality of storage slots and the second plurality of storage slots, and configured to extend between respective ones of the first plurality of partitions and the second plurality of partitions.

7. The case of claim 5, wherein:

each of a first plurality of floors of the first plurality of storage slots are located between respective adjacent pairs of the first plurality of partitions, and each of a second plurality of floors of the second plurality of storage slots are located between respective adjacent pair of the second plurality of partitions.

8. The case of claim 1, further comprising:

a lid configured to couple to the body.

9. The case of claim 8, wherein the gasket is part of the lid.

10. The case of claim 8, wherein the gasket is separate from the lid.

11. The case of claim 8, wherein the body is configured to couple to the lid such that the gasket is positioned between the lid and the body.

12. The case of claim 1, wherein the body and the gasket are configured to mate with one another.

13. The case of claim 1, wherein the gasket comprises a plurality of tabs that are flexible.

14. The case of claim 13, wherein the plurality of tabs are configured to releasably hold the artificial lash extensions in the first plurality of storage slots.

15. The case of claim 13, wherein the plurality of tabs are spaced apart from each other and radially extend outwards.

16. The case of claim 13, wherein the plurality of tabs comprise projections each configured to contact respective ones of the artificial lash extensions located in respective storage slots of the first plurality of storage slots.

17. A method of manufacturing a case for storing artificial lash extensions comprising:

forming a body, the body comprising:

a first outer sidewall having first curved surface; and a first plurality of storage slots extending inward from the first curved surface of the first outer sidewall, wherein each of the first plurality of storage slots comprises a first floor that extends inward from the first curved surface; and forming a gasket configured to releasably hold the artificial lash extensions in the first plurality of storage slots.

18. The method of claim 17, wherein the body further comprises:

a second outer sidewall opposite the first outer sidewall, the second outer sidewall having a second curved surface; and a second plurality of storage slots extending inward from the second curved surface of the second outer sidewall, wherein each the second plurality of storage slots comprises a second floor that extends inward from the respective curved surface, and wherein the gasket configured to releasably hold the artificial lash extensions in the second plurality of storage slots.

19. The method of claim 18, wherein the body further comprises:

a first plurality of partitions that define the first plurality of storage slots; and a second plurality of partitions that define the second plurality of storage slots.

20. The method of claim 19, wherein:

each of a first plurality of floors of the first plurality of storage slots are located between respective adjacent pairs of the first plurality of partitions, and each of a second plurality of floors of the second plurality of storage slots are located between respective adjacent pair of the second plurality of partitions.

21. The method of claim 19, wherein a plurality of tabs of the gasket are configured to extend within respective ones of the first plurality of storage slots and the second plurality of storage slots, and configured to extend between respective ones of the first plurality of partitions and the second plurality of partitions.

22. The method of claim 18, wherein the first plurality of storage slots and the second plurality of storage slots are configured such that the artificial lash extensions at least in part extend within respective storage slots.

23. The method of claim 17, further comprising:

forming a lid configured to couple to the body.

24. The method of claim 23, wherein the gasket is part of the lid.

25. The method of claim 24, wherein the gasket is separate from the lid.

26. The method of claim 24, wherein the body is configured to couple to the lid such that the gasket is positioned between the lid and the body.

27. The method of claim 17, wherein the body and the gasket are configured to mate with one another.

28. The method of claim 17, wherein the gasket comprises a plurality of tabs that are flexible.

29. The method of claim 28, wherein the plurality of tabs are configured to releasably hold the artificial lash extensions in the first plurality of storage slots.

30. The method of claim 28, wherein the plurality of tabs comprise projections each configured to contact respective ones of the artificial lash extensions located in respective storage slots of the first plurality of storage slots.

* * * * *